US011118854B2

(12) United States Patent
Derus et al.

(10) Patent No.: US 11,118,854 B2
(45) Date of Patent: Sep. 14, 2021

(54) AMMUNITION MOVEMENT SYSTEM AND METHOD FOR FIREARM MAGAZINE LOADERS

(71) Applicant: MagPump, LLC, Henrietta, NY (US)

(72) Inventors: Michael W. Derus, Victor, NY (US); Kenneth P. Green, Lunenburg, VA (US)

(73) Assignee: MagPump, LLC, Henrietta, NY (US)

( * ) Notice: Subject to any disclaimer, the term of this patent is extended or adjusted under 35 U.S.C. 154(b) by 0 days.

(21) Appl. No.: 17/005,813

(22) Filed: Aug. 28, 2020

(65) Prior Publication Data

US 2021/0140731 A1 May 13, 2021

Related U.S. Application Data

(63) Continuation of application No. 16/254,078, filed on Jan. 22, 2019, now Pat. No. 10,788,281.

(60) Provisional application No. 62/620,694, filed on Jan. 23, 2018.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F42B 33/002
USPC ..... 42/87
See application file for complete search history.

(56) References Cited

U.S. PATENT DOCUMENTS

| | | | | | |
|---|---|---|---|---|---|
| 479,819 | A | | 8/1892 | Liddell | |
| 1,786,537 | A | | 12/1930 | Vaclav | |
| 2,098,234 | A | | 11/1937 | Garand | |
| 2,326,816 | A | * | 8/1943 | Woodberry | F42B 39/10 86/45 |
| 2,356,806 | A | * | 8/1944 | Woodberry | F42B 39/10 86/45 |
| 2,377,431 | A | | 6/1945 | Lakso | |
| 2,394,033 | A | * | 2/1946 | Wossum | F41A 9/83 86/47 |
| 2,419,242 | A | * | 4/1947 | Woodberry | F42B 39/10 193/47 |
| 2,451,521 | A | | 10/1948 | Uglum | |
| 2,623,803 | A | * | 12/1952 | Gamble | F42B 39/002 86/46 |
| 2,783,570 | A | | 3/1957 | Kunz | |
| 3,292,293 | A | | 12/1966 | Chiasera et al. | |
| 3,628,273 | A | | 12/1971 | Lach | |
| 3,789,531 | A | | 2/1974 | Kersten et al. | |
| 3,912,120 | A | | 10/1975 | Hoppmann et al. | |

(Continued)

*Primary Examiner* — Derrick R Morgan
(74) *Attorney, Agent, or Firm* — Barclay Damon LLP

(57) ABSTRACT

An ammunition movement system and method are disclosed herein. The ammunition movement system, in an embodiment, includes a first driver moveable to apply a first force to an ammunition cartridge unit. The first force acts along a first axis that extends in a first plane. The system also includes a second driver moveable to apply a second force to the ammunition cartridge unit. The second force acts along a second axis that extends in a second plane. The system also includes an actuator operatively coupled to the first driver and the second driver. The first plane intersects with the second plane. The actuator, the first driver and the second driver are configured to cooperate to move the ammunition cartridge unit through a magazine opening of a firearm magazine.

20 Claims, 68 Drawing Sheets

(56) References Cited

U.S. PATENT DOCUMENTS

| | | | | |
|---|---|---|---|---|
| 4,261,680 | A | 4/1981 | Carnley et al. | |
| 4,570,371 | A | 2/1986 | Mears | |
| 4,614,052 | A | 9/1986 | Brown et al. | |
| 4,736,667 | A | 4/1988 | Kochevar | |
| 4,739,572 | A | 4/1988 | Brandenburg | |
| 4,879,829 | A | 11/1989 | Miller et al. | |
| 4,939,862 | A * | 7/1990 | Brandenburg | F41A 9/83 42/87 |
| 4,949,495 | A | 8/1990 | Mari | |
| 4,970,820 | A * | 11/1990 | Miller | F41A 9/83 42/87 |
| 5,301,449 | A | 4/1994 | Jackson | |
| 5,415,322 | A | 5/1995 | Sala | |
| 5,555,661 | A * | 9/1996 | Yap | F41A 9/71 42/49.02 |
| 5,566,488 | A * | 10/1996 | Yap | F41A 9/71 42/49.02 |
| 6,557,691 | B2 | 5/2003 | Ronchi | |
| 6,754,987 | B1 | 6/2004 | Cheng | |
| D503,960 | S | 4/2005 | Gangi et al. | |
| 7,059,077 | B2 | 6/2006 | Tal | |
| 7,950,517 | B2 | 5/2011 | Marti Sala et al. | |
| 8,051,971 | B2 | 11/2011 | Marti Sala et al. | |
| 8,096,403 | B2 | 1/2012 | Marti Sala et al. | |
| 8,898,946 | B1 * | 12/2014 | Johnson | F41A 9/71 42/49.02 |
| 9,091,500 | B1 | 7/2015 | Kim | |
| 9,354,008 | B1 | 5/2016 | Cifers et al. | |
| 9,612,070 | B2 | 4/2017 | Hatch | |
| 9,719,741 | B1 * | 8/2017 | Cifers | F41A 9/83 |
| 9,976,826 | B2 * | 5/2018 | Hefer | F41A 9/83 |
| 9,989,342 | B1 | 6/2018 | Lougeay et al. | |
| 10,006,730 | B1 * | 6/2018 | Pikielny | F41A 9/65 |
| D823,420 | S | 7/2018 | Fischer | |
| 10,132,582 | B1 * | 11/2018 | Zhou | F41A 9/83 |
| 10,156,408 | B1 | 12/2018 | Buckner | |
| 10,215,516 | B2 * | 2/2019 | Hefer | F42B 39/26 |
| 10,240,879 | B2 | 3/2019 | Fischer | |
| 10,247,499 | B2 | 4/2019 | Cifers et al. | |
| 10,533,817 | B1 | 1/2020 | Hefer et al. | |
| 10,557,677 | B1 * | 2/2020 | Martelli | F41A 9/83 |
| 10,704,850 | B1 * | 7/2020 | Fischer | F41A 9/83 |
| 2003/0046854 | A1 | 3/2003 | Urchek | |
| 2004/0159036 | A1 | 8/2004 | Newman | |
| 2005/0081421 | A1 | 4/2005 | Tal | |
| 2010/0175294 | A1 * | 7/2010 | Meinel | F41A 9/83 42/87 |
| 2013/0152771 | A1 | 6/2013 | Coma Asensio | |
| 2014/0033592 | A1 * | 2/2014 | Fiorucci | F41A 9/83 42/87 |
| 2014/0260925 | A1 | 9/2014 | Beach et al. | |
| 2014/0311008 | A1 | 10/2014 | McPhee | |
| 2014/0317985 | A1 | 10/2014 | Cauley | |
| 2015/0377573 | A1 | 12/2015 | Niccum | |
| 2016/0202007 | A1 * | 7/2016 | Hatch | F41A 9/83 42/87 |
| 2016/0305726 | A1 * | 10/2016 | Mokuolu | F41A 9/83 |
| 2017/0051991 | A1 * | 2/2017 | Cottrell | F41A 9/83 |
| 2017/0051992 | A1 * | 2/2017 | Cottrell | F41A 9/83 |
| 2017/0067707 | A1 * | 3/2017 | Zivic | F41A 9/83 |
| 2018/0058785 | A1 * | 3/2018 | Hefer | F41A 9/83 |
| 2018/0202735 | A1 * | 7/2018 | Draper | F41A 9/82 |
| 2018/0321004 | A1 * | 11/2018 | Fausti | F41A 9/67 |
| 2019/0170465 | A1 | 6/2019 | Fischer | |
| 2019/0226780 | A1 * | 7/2019 | Slevin | F41A 9/83 |
| 2019/0226781 | A1 * | 7/2019 | Derus | F41A 9/83 |
| 2019/0310041 | A1 * | 10/2019 | Plate | F41A 9/83 |
| 2020/0049438 | A1 * | 2/2020 | Hatch | F41A 9/83 |
| 2020/0158454 | A1 * | 5/2020 | Oross | F41A 9/83 |
| 2020/0256630 | A1 * | 8/2020 | Rosenblum | F41A 9/38 |

* cited by examiner

AMMUNITION MOVEMENT SYSTEM AND METHOD FOR FIREARM MAGAZINE LOADERS

CROSS-REFERENCE TO RELATED APPLICATIONS

This application is a continuation of, and claims the benefit and priority of, U.S. patent application Ser. No. 16/254,078 filed on Jan. 22, 2019, which is non-provisional of, and claims the benefit and priority of, U.S. Provisional Patent Application No. 62/620,694 filed on Jan. 23, 2018. The entire contents of such applications are hereby incorporated herein by reference.

BACKGROUND

Certain types of firearms, such as automatic and semiautomatic guns, are operable with magazines. The user inserts ammunition rounds into a magazine. The user then attaches the magazine to a compatible gun. Upon triggering, the rounds move from the magazine into the gun's chamber for rapid firing. The process of inserting rounds into a magazine can be time consuming and burdensome. This process can also cause fatigue, stress and injury to the users' hands, especially for users involved in repeated loadings over a relatively short span of time.

The foregoing background describes some, but not necessarily all, of the problems, disadvantages and shortcomings related to the loading of firearm magazines.

SUMMARY

In an embodiment, a firearm magazine loader includes: (a) a receptacle configured to receive a plurality of ammunition units; and (b) a body coupled to the receptacle. The body has a loading structure. The loading structure is configured to be coupled to a plurality of different types of magazine adapters. Each one of the magazine adapters includes: (a) a body interface portion configured to be coupled to the loading structure; and (b) a magazine interface portion configured to be coupled to one of a plurality of different types of firearm magazines. Each one of the firearm magazines includes a magazine end defining a magazine opening. The loading structure is configured to be compatible with each one of the magazine adapters. The body defines an ammunition output. When a first type of the firearm magazines is coupled to the magazine interface portion of a first one of the magazine adapters, the body is configured to direct each one of the ammunition units through the ammunition output and into the magazine opening of the first type of firearm magazine. When a second type of the firearm magazines is coupled to the magazine interface portion of a second one of the magazine adapters, the body is configured to direct each one of the ammunition units through the ammunition output and into the magazine opening of the second type of firearm magazine.

In another embodiment, the firearm magazine loader includes: (a) a receptacle configured to receive a plurality of ammunition units; and (b) a body coupled to the receptacle. The body defines a loading structure. The loading structure is configured to be coupled to a plurality of different types of magazine adapters. Each one of the magazine adapters is configured to be coupled to one of a plurality of different types of firearm magazines. With respect to each one of the magazine adapters, the loading structure is configured to cooperate with the magazine adapter so as to: (a) receive a magazine end of the magazine that is coupled to the magazine adapter; and (b) hold the magazine end in a position to receive each one of the ammunition units.

Yet another embodiment includes a method of manufacturing a firearm magazine loader through a plurality of steps. The method includes accessing a receptacle configured to receive a plurality of ammunition units and configuring a body having a loading structure so that: (a) the loading structure is configured to be coupled to a plurality of different types of magazine adapters, wherein each one of the magazine adapters is configured to be coupled to one of a plurality of different types of firearm magazines, wherein each one of the firearm magazines includes a magazine end; and (b) the loading structure is configured to cooperate with each one of the magazine adapters so as to: (i) receive the magazine end of the magazine coupled to the magazine adapter; and (ii) hold the magazine end in a position to receive each one of the ammunition units. The method also includes the step of coupling the body to the receptacle.

Additional features and advantages of the present disclosure are described in, and will be apparent from, the following Brief Description of the Drawings and Detailed Description.

DETAILED DESCRIPTION

Figure 1B:
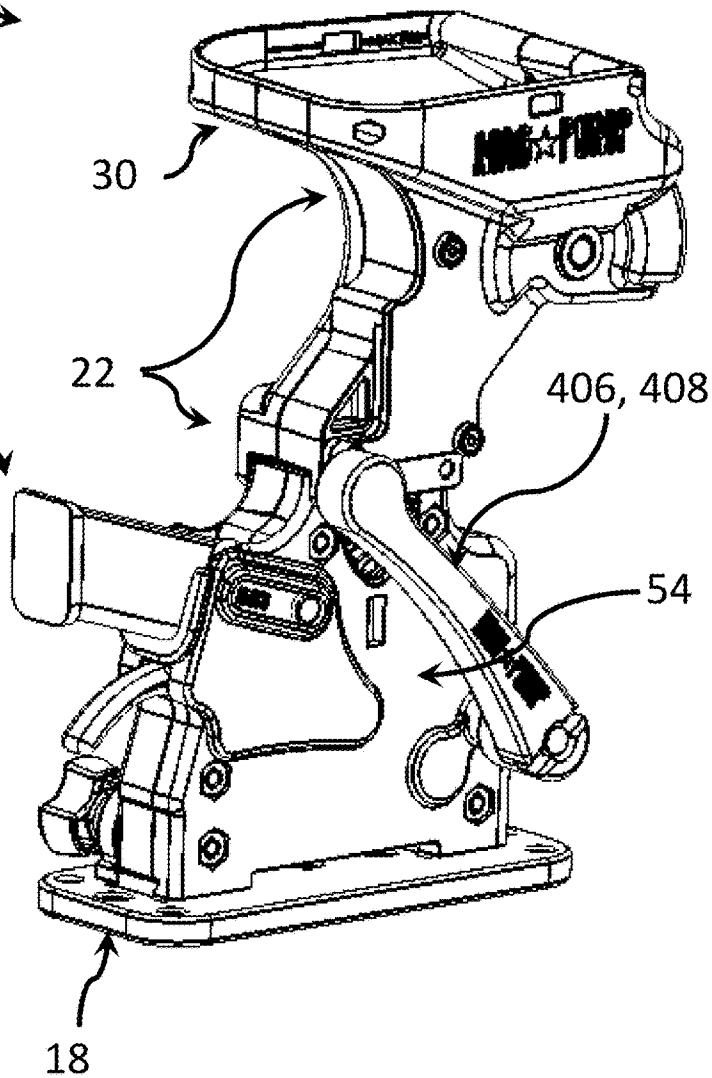
FIG. 1B is another front isometric view of the firearm magazine loader of FIG. 1A.

In an embodiment illustrated in FIGS. 1A-8C and 36, the firearm magazine loader 10 includes: (a) a mount or base 18; (b) a case, housing or body 22 supported by the base 18; (c) an ammunition holder, hopper, container or receptacle 30 supported by the body 22; (d) a mixer or agitator 32 moveably coupled to the receptacle 30; (e) an escapement member or cartridge positioner 35 (FIG. 36) moveably coupled to, and housed within, the body 22; (f) a primary driver 36 (FIG. 36) moveably coupled to, and housed within, the body 22; (g) secondary driver 38 (FIG. 36) moveably coupled to, and housed within, the body 22; (h) a drive coupler or drive assembly 40 (FIG. 36) operatively coupled to the agitator 32, cartridge positioner 35, primary driver 36 and secondary driver 38; and (i) an actuator 42 (FIG. 6) operatively coupled to the drive assembly 40.

As illustrated in FIGS. 7 and 8A-8C, the base 18 includes a plurality of base couplers 44, 46. Each base coupler 44, 46 has a neck 48 and a head 50 that is larger than the neck 48, as shown. The base 18 also defines a plurality of mount holes or mount openings 52. A user can insert fasteners (not shown), such as screws or bolts, through the mount openings 52 to secure, attach or mount the base 18 to a support surface, such as a worktable, vehicle or other structure.

Figure 1A:
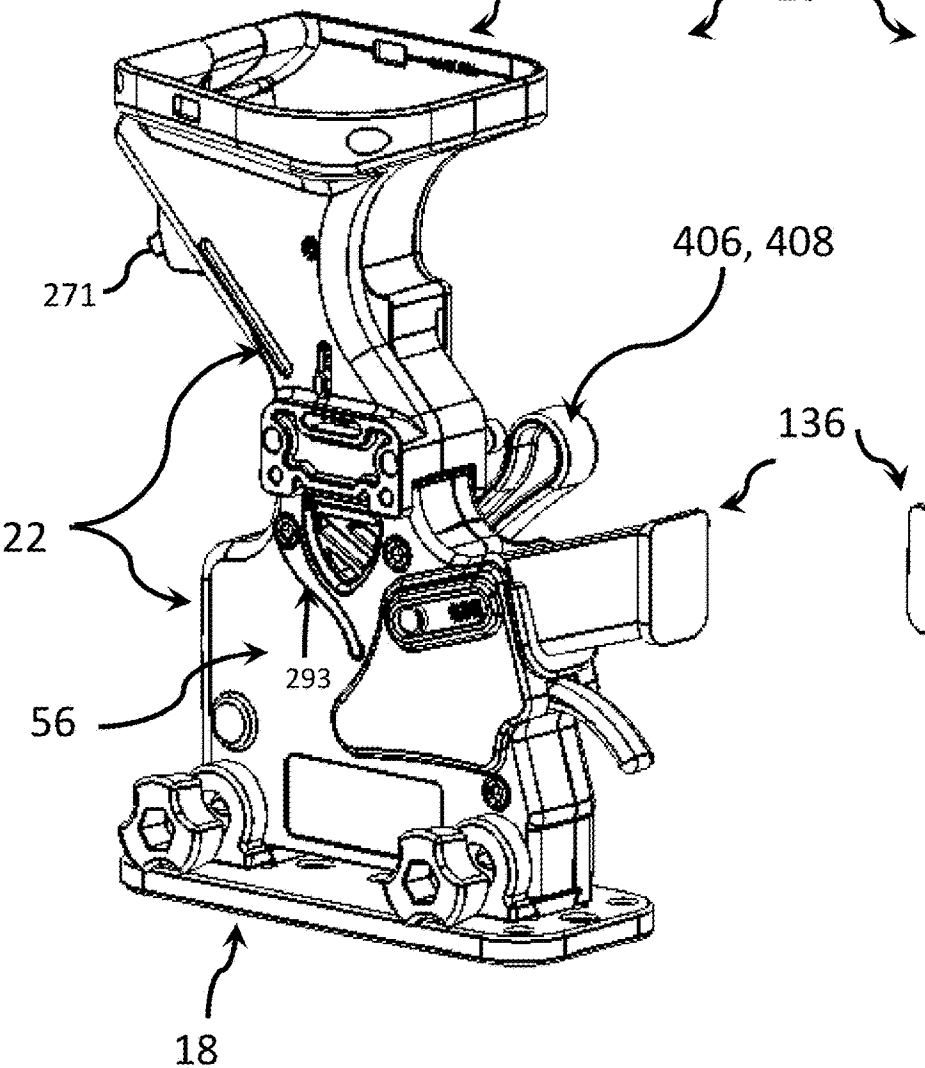
FIG. 1A is a front isometric view of an embodiment of a firearm magazine loader.
Figure 2B:
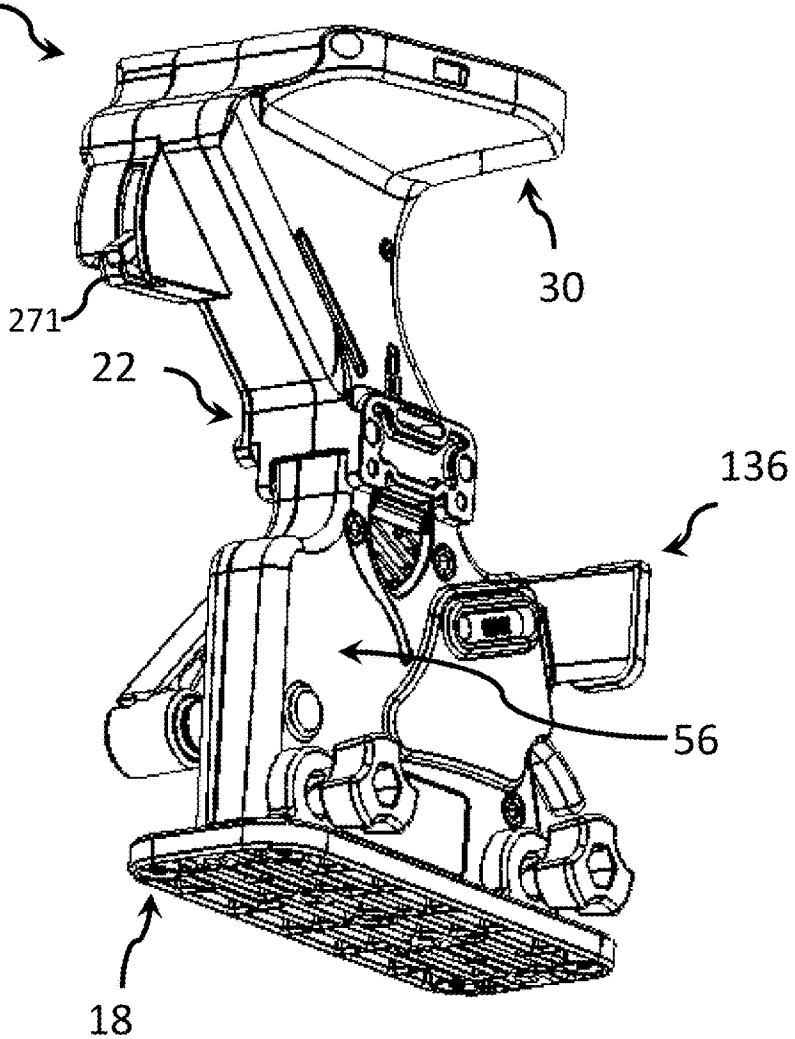
FIG. 2B is another rear isometric view of the firearm magazine loader of FIG. 1A.
Figure 2A:
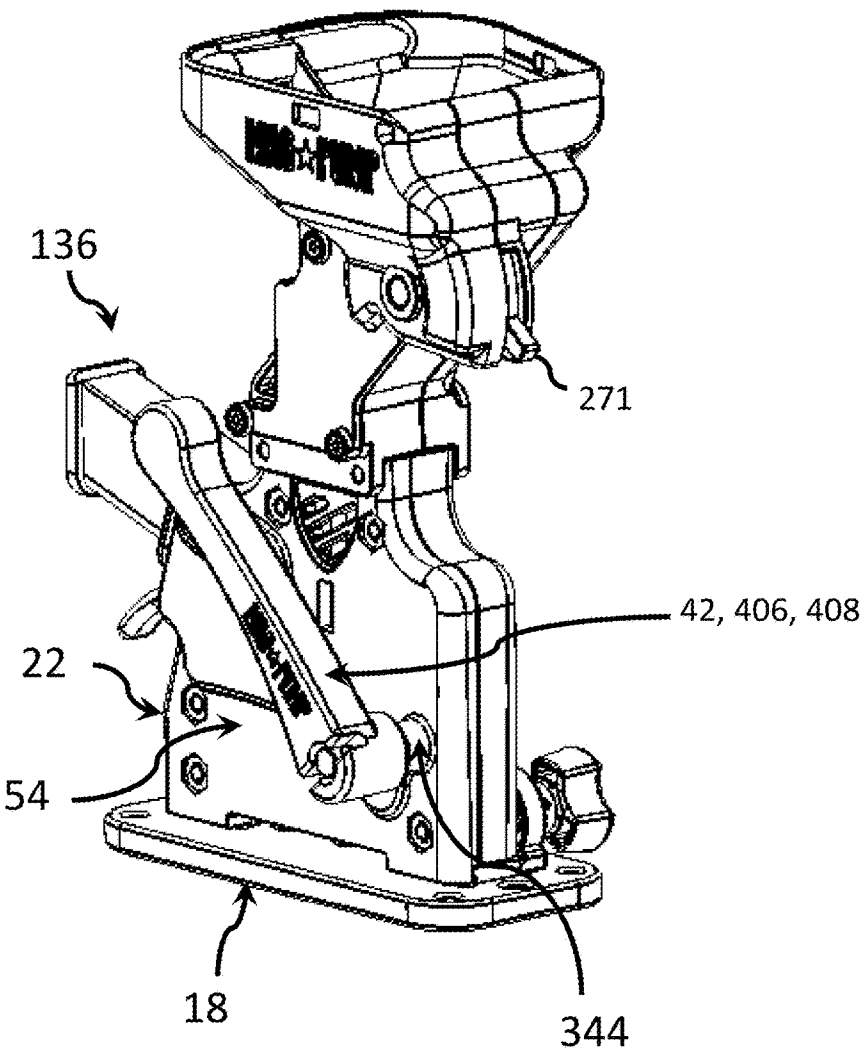
FIG. 2A is a rear isometric view of the firearm magazine loader of FIG. 1A.
Figure 5:
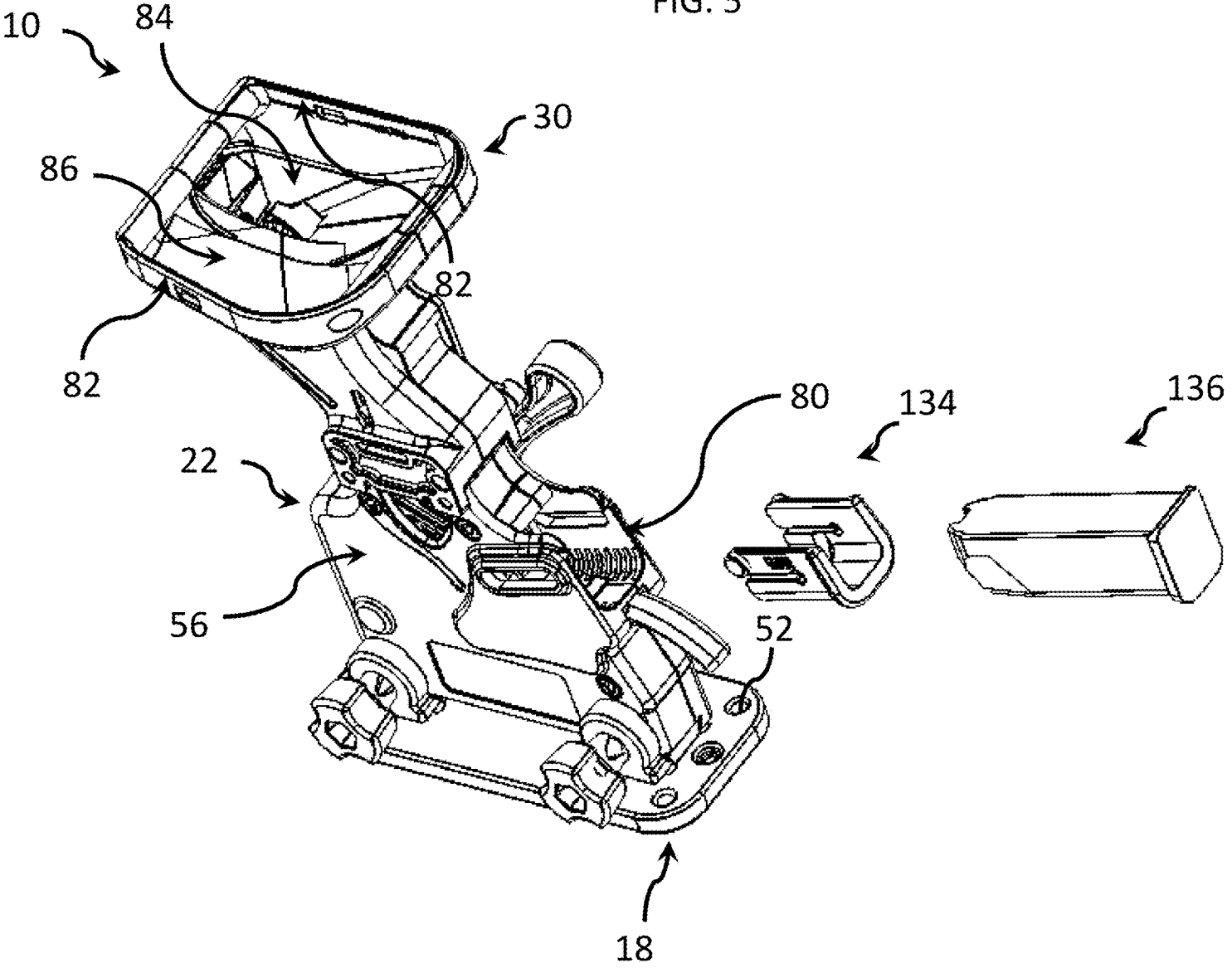
FIG. 5 is a top isometric view of the firearm magazine loader of FIG. 1A, illustrating an embodiment of a magazine adapter uninstalled and a magazine uninstalled from the magazine adapter.
Figure 6:
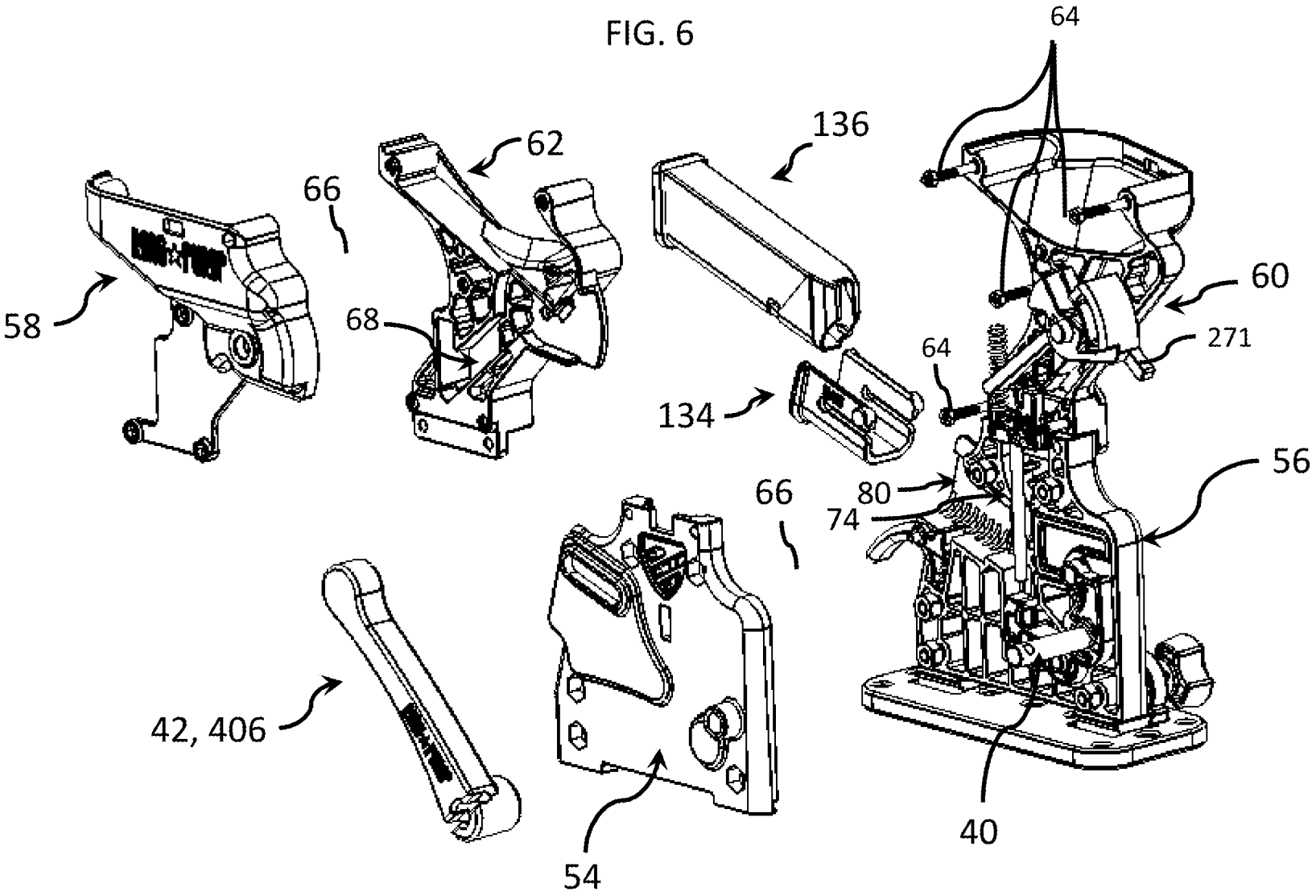
FIG. 6 is an exploded, side isometric view of the firearm magazine loader of FIG. 1A.
Figure 27:
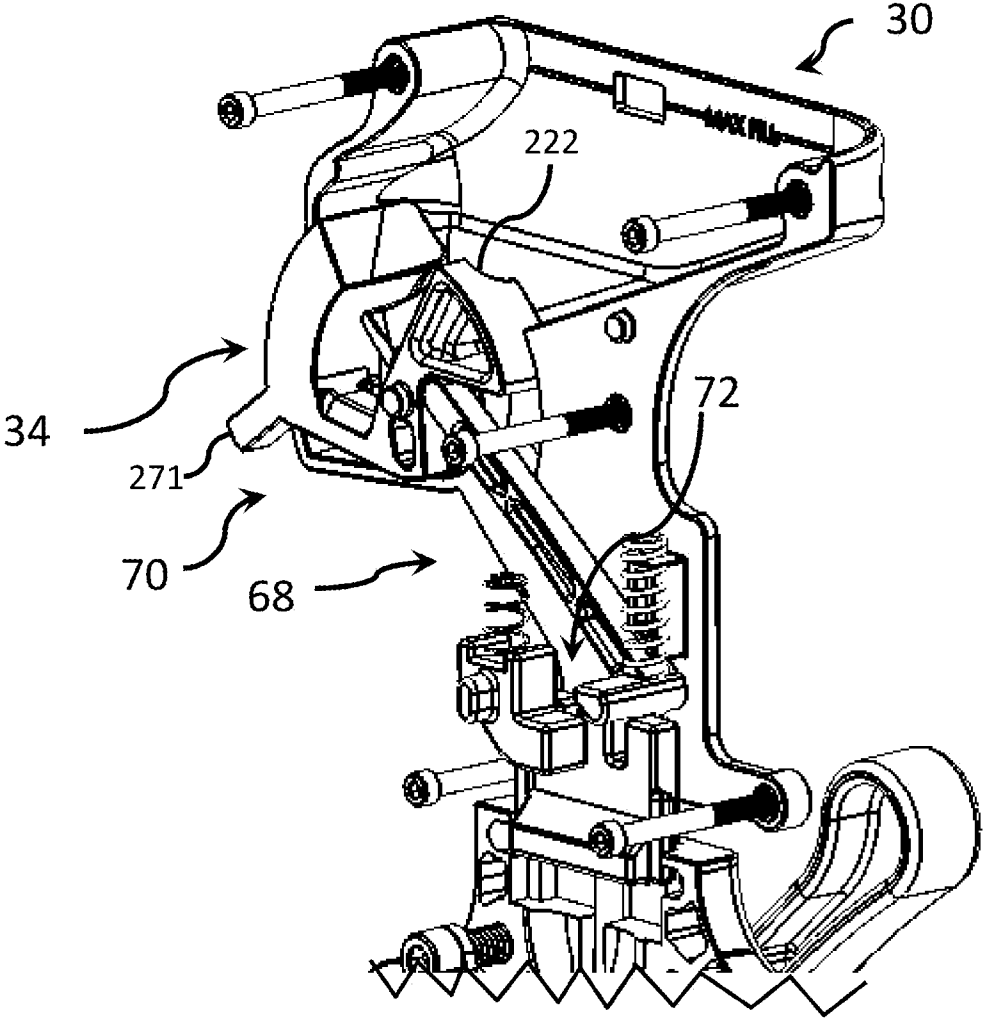
FIG. 27 is yet another isometric view of the firearm magazine loader of FIG. 1A with a panel and intermediate portion removed.
Figure 28:
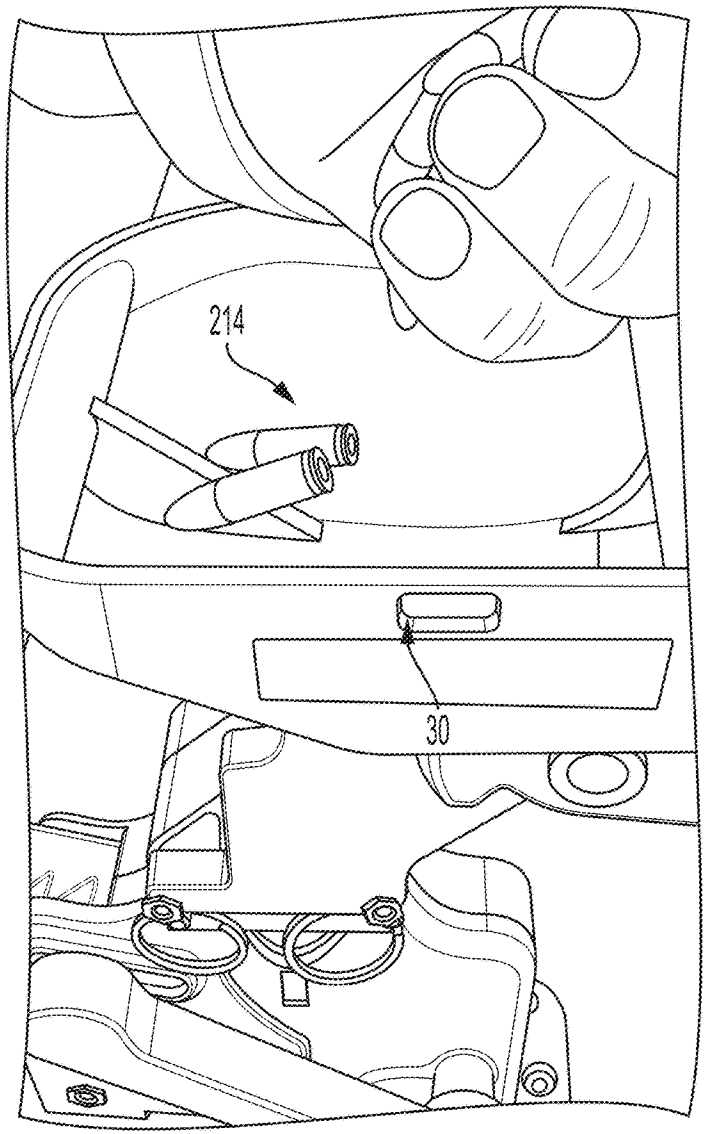
FIG. 28 is an isometric view of the firearm magazine loader of FIG. 1A, illustrating the dropping of ammunition units into the receptacle.
Figure 29C:
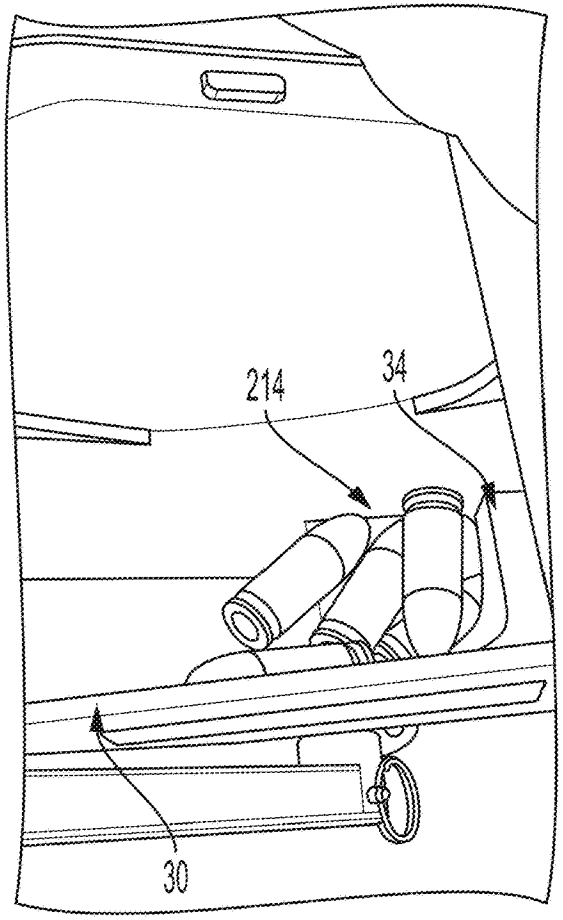
FIG. 29C is a top isometric view of the firearm magazine loader of FIG. 1A, illustrating a pile or plurality of ammunition units randomly orientated in different directions within the receptacle.
Figure 29B:
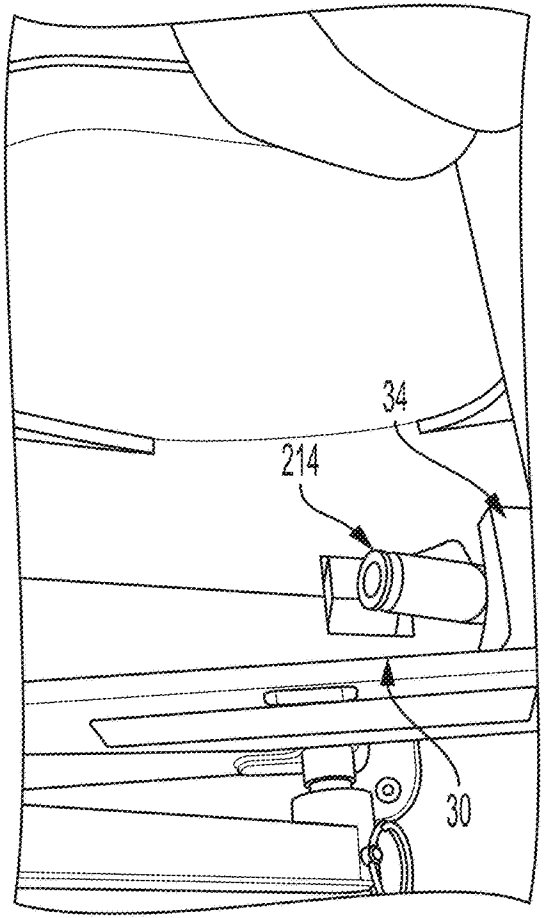
FIG. 29B is a top isometric view of the firearm magazine loader of FIG. 1A, illustrating the second orientation of the first ammunition unit in the receptacle.
Figure 29A:
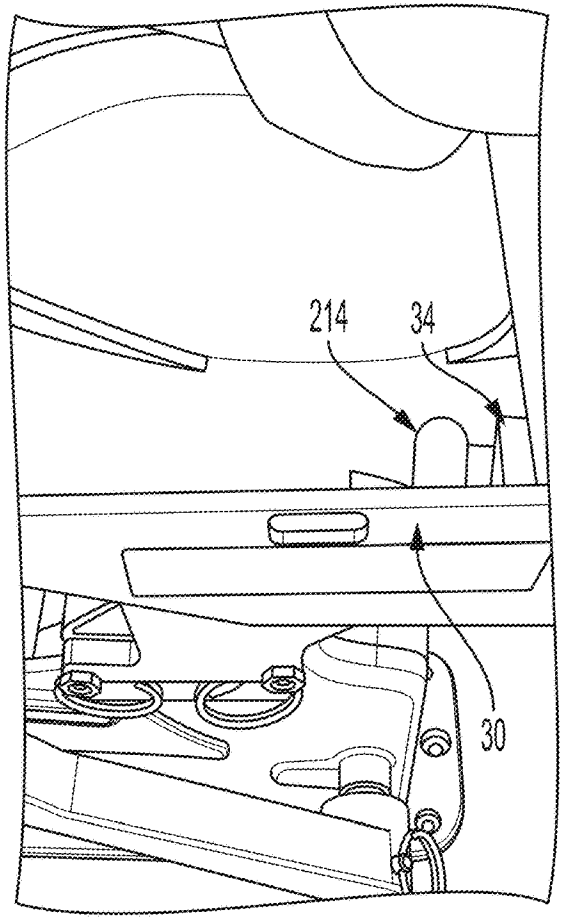
FIG. 29A is a top isometric view of the firearm magazine loader of FIG. 1A, illustrating the first orientation of a first ammunition unit in the receptacle.
Figure 30A:
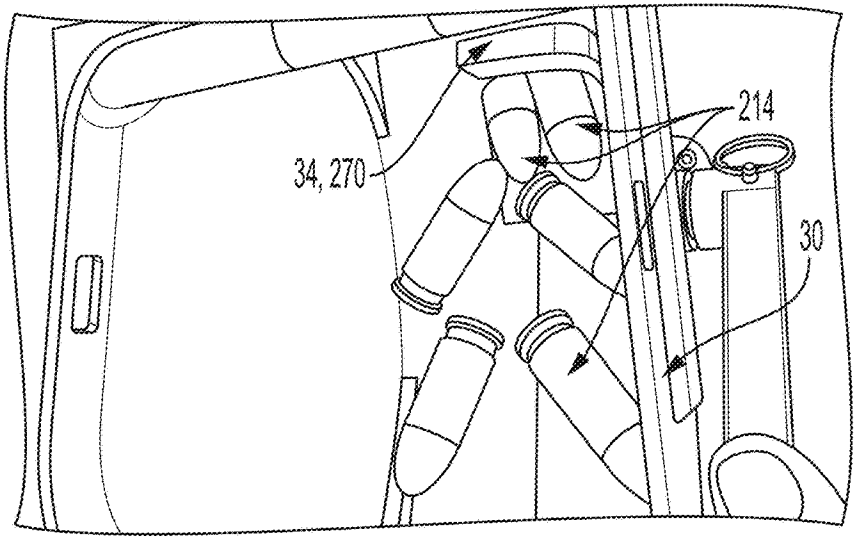
FIG. 30A is a top isometric view of the firearm magazine loader of FIG. 1A, illustrating a pile or plurality of ammunition units randomly orientated in different directions within the receptacle and further illustrating two or more of the ammunition units simultaneously traveling down and through the receptacle opening.
Figure 30B:
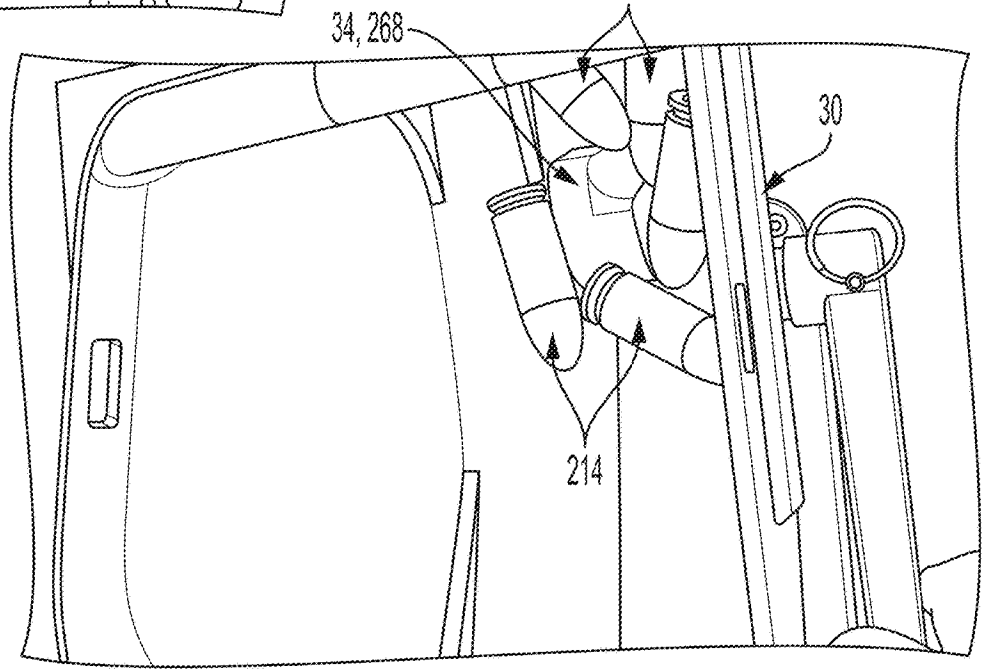
FIG. 30B is a top isometric view of the firearm magazine loader of FIG. 1A, illustrating a pile or plurality of ammunition units randomly orientated in different directions within the receptacle and further illustrating the agitator mixing and agitating the ammunition units.

As illustrated in FIGS. 5-7 and 27, in an embodiment, the body 22 includes lower panels 54, 56, upper panels 58, 60 and an intermediate body portion 62. A plurality of fasteners 64 (FIG. 6), such as threaded bolts, are used to assemble the lower panels 54, 56, upper panels 58, 60 and intermediate body portion 62 together. Once united or assembled together, as shown in FIG. 1A, the body 22 defines an interior space, loading space or output structure 66 (FIG. 6). The output structure or interior space 66 includes one or more recesses, slots, grooves, channels or cavities. In an embodiment, the output structure or interior space 66 includes: (a) a primary passage 68 having a primary input 70 and a primary output 72, as illustrated in FIG. 27; and (b) a secondary passage 74 having a secondary input 76 and a secondary output 78, as illustrated in FIG. 27. In an embodiment, the output structure or interior space 66 also includes ammunition output 67 (FIG. 38), through which ammunition cartridge units may pass into a firearm magazine. Also, the body 22 includes or defines a loading structure 80, as illustrated in FIGS. 5-6 and described below. It should be appreciated that, depending upon the embodiment, the base 22 can be unitary, such as a single structure having an internal cavity, or the base 22 can include any suitable quantity of parts and components that are connectable to each other through suitable fasteners.

As illustrated in FIGS. 3 and 5-7, the receptacle 30, having a bowl shape, includes: (a) an upper receptacle portion 82; (b) a lower receptacle portion 84; and (c) a downwardly slanted or sloped surface 86 (FIG. 7) extending between the upper receptacle portion 82 and the lower receptacle portion 84. As described below, the lower receptacle portion 84 defines a receptacle chute or receptacle opening 88 (FIG. 24) that provides access to the primary input 70.

Figure 7:
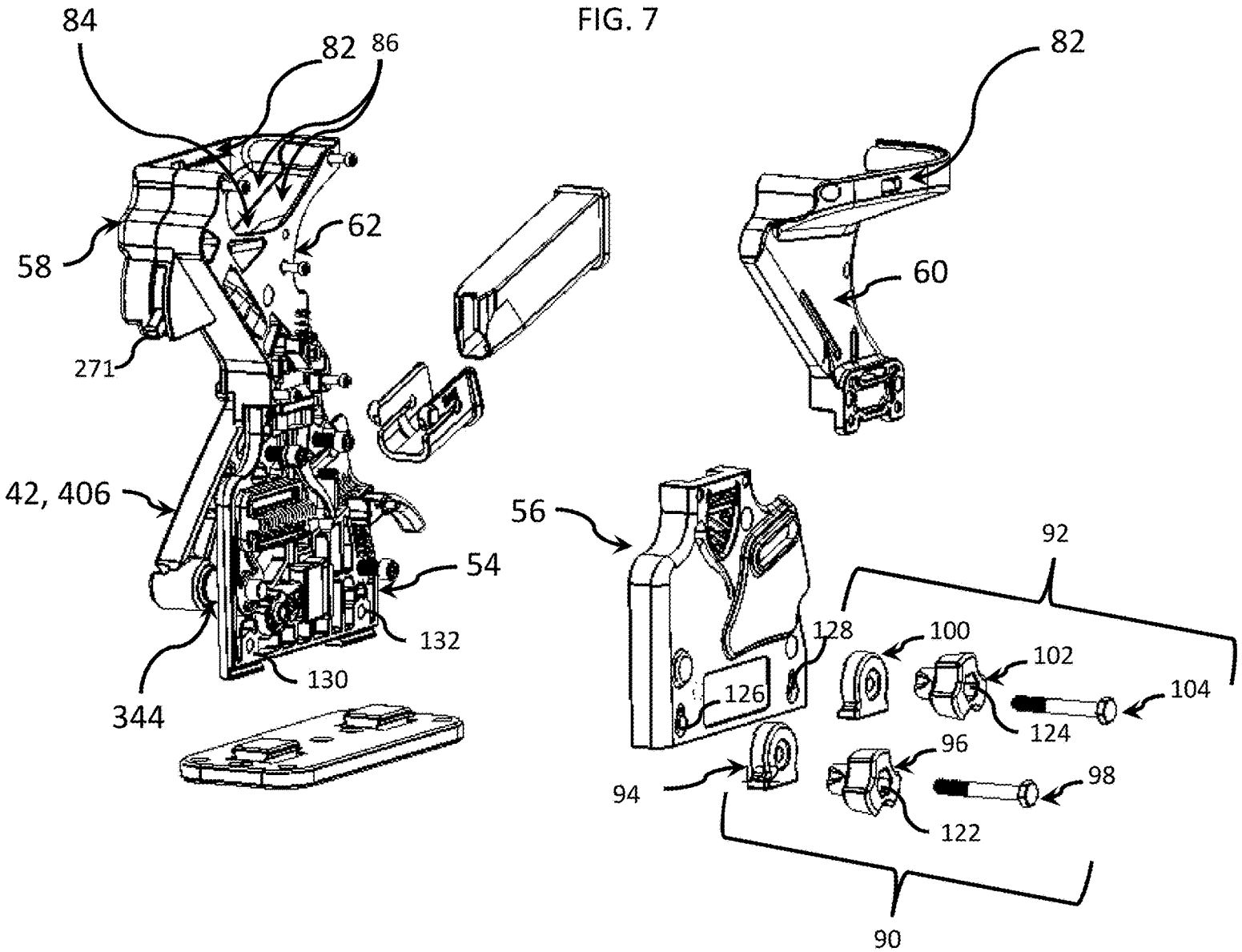
FIG. 7 is an exploded, side isometric view of the firearm magazine loader of FIG. 1A.
Figure 8B:
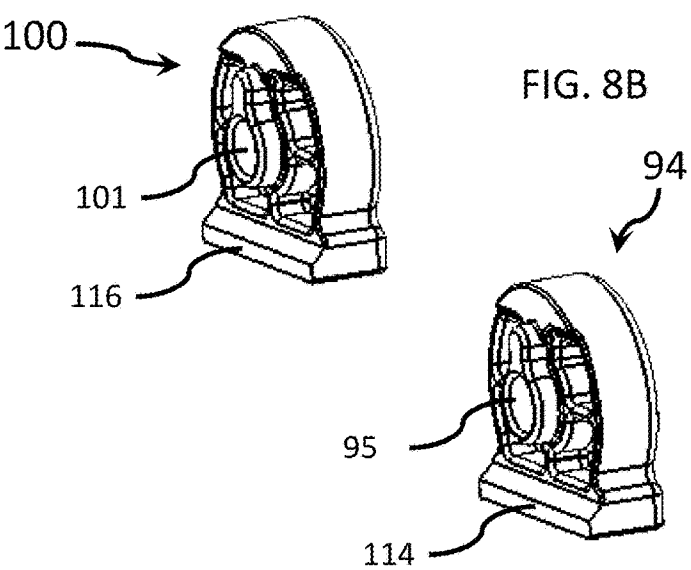
FIG. 8B is an enlarged, isometric view of an embodiment of the wedges of the firearm magazine loader of FIG. 1A.
Figure 8A:
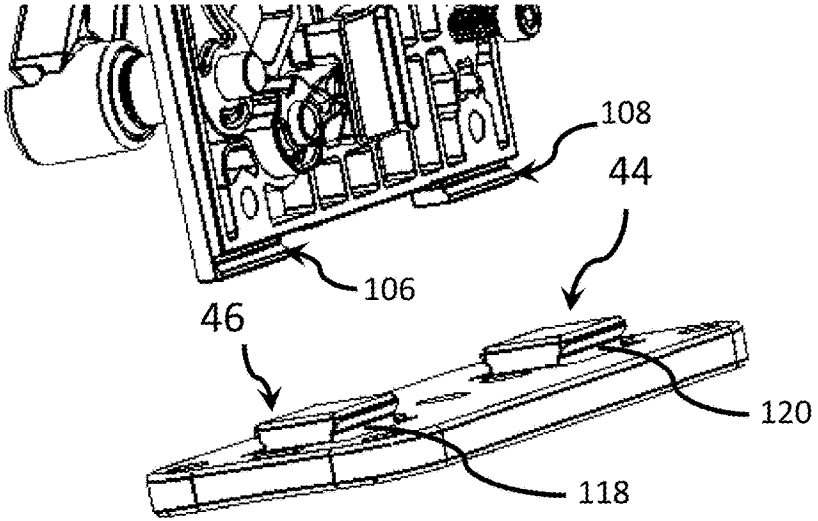
FIG. 8A is an enlarged, exploded, fragmentary isometric view of the firearm magazine loader of FIG. 1A, illustrating an embodiment of the base.
Figure 8C:
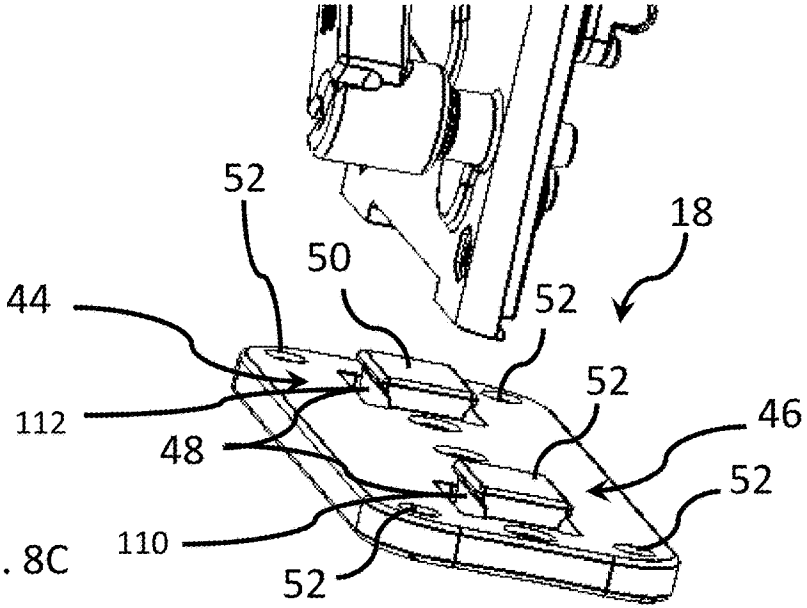
FIG. 8C is an enlarged, isometric view of the firearm magazine loader of FIG. 1A, illustrating the base.

Referring to FIGS. 7-8C, the firearm magazine loader 10 includes a plurality of coupler assemblies 90, 92 configured to couple or secure the body 22 to the base 18. Coupler assembly 90 includes a wedge 94, a knob 96 and a fastener 98. Coupler assembly 92 includes a wedge 100, a knob 102 and a fastener 104. The wedges 94, 100 and knobs 96, 102 each define an opening configured to receive one of the fasteners 98, 104. For example, the wedges 94, 100 define wedge openings 95, 101 (FIG. 8B). As shown, the lower panel 54 includes a plurality of panel wedges 106, 108. To attach or mount the body 22 to the base 18, a user can insert the panel wedges 106, 108 into the recesses 110, 112, respectively, as illustrated in FIGS. 7 and 8C. Then, the user can slide the lower wedge portions 114, 116 into the recesses 118, 120, respectively, as illustrated in FIGS. 8A and 8B. Next, as illustrated in FIG. 7, the user can insert the fasteners 98, 104 through the knob openings 122, 124, respectively, then through the wedge openings 95, 101 (FIG. 8B), respectively, then through the panel openings 126, 128, respectively, and then into the threaded panel openings 130, 132. The knobs 96, 102 are configured to receive and mate with the heads of the fasteners 98, 104. Consequently, by rotating the knobs 96, 102, the user can tighten the fasteners 98, 104 into the threaded panel openings 130, 132, respectively. This forces the panel wedges 106, 108 against the base couplers 44, 46, respectively, and this also forces the lower wedge portions 114, 116 against the base couplers 44, 46. Consequently, the body 22 is compressed onto the base couplers 44, 46 of the base 18. This compression effectively couples and mounts the body 22 to the base 18 in a reversible or removeable method. The user can remove the body 22 from the base 18 by rotating and untightening the fasteners 98, 104.

Referring to FIGS. 5 and 9-13C, in an embodiment, the firearm magazine loader 10 includes or is operable with a plurality of different types of magazine adapters that are operable with a plurality different types of ammunition magazines or firearm magazines. It should be appreciated that different types of firearm magazines are compatible with different types of firearms, guns or other weapons. It should also be appreciated that firearm magazines can vary by shape, size, geometry, form or style depending on the particular type of firearm with which the firearm magazine is compatible.

Figure 9A:
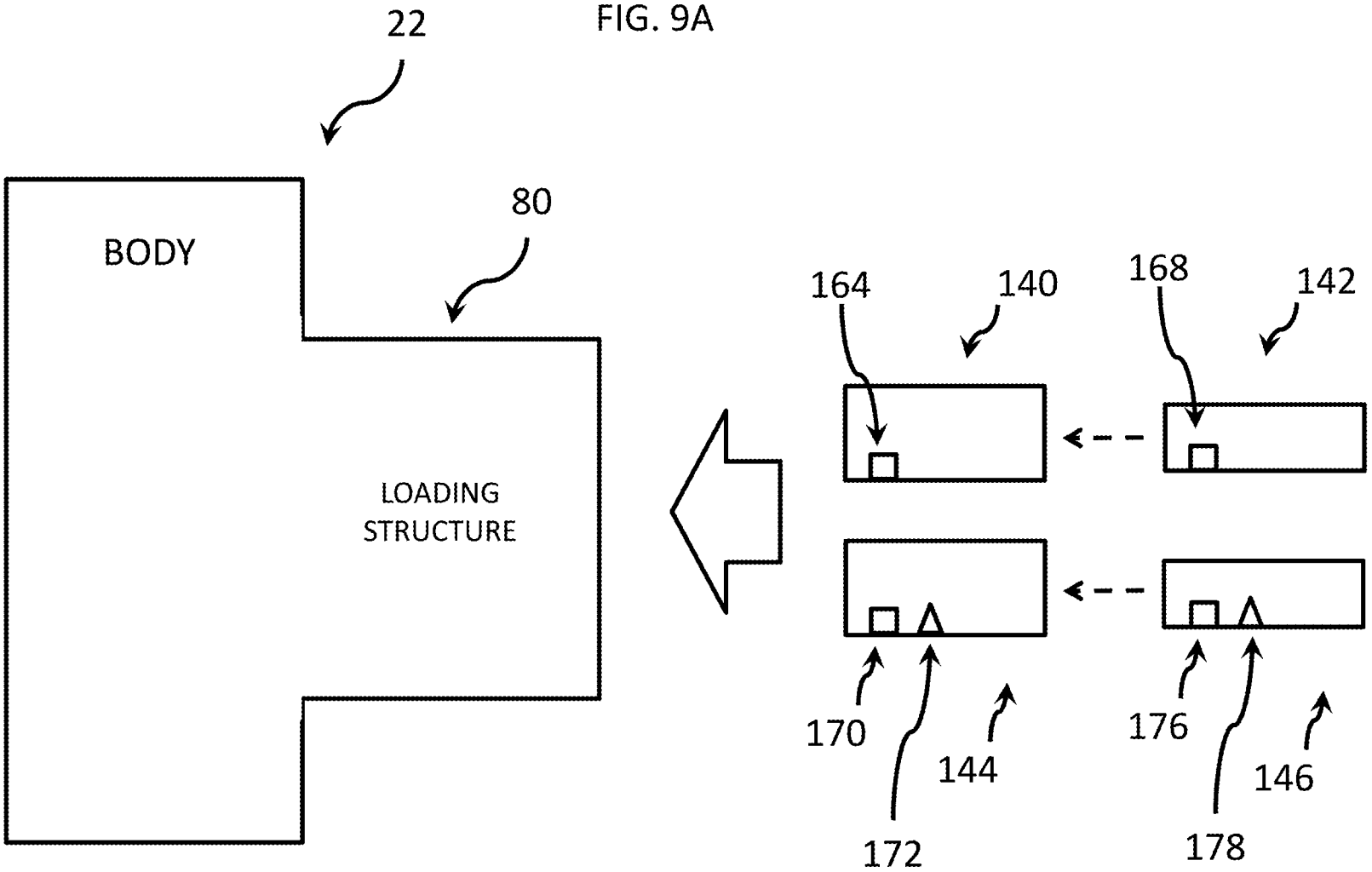
FIG. 9A is a schematic diagram illustrating an embodiment of a firearm magazine loader that is compatible with a plurality of different types of magazine adapters, each of which is compatible with a different type of firearm magazine.
Figure 9B:
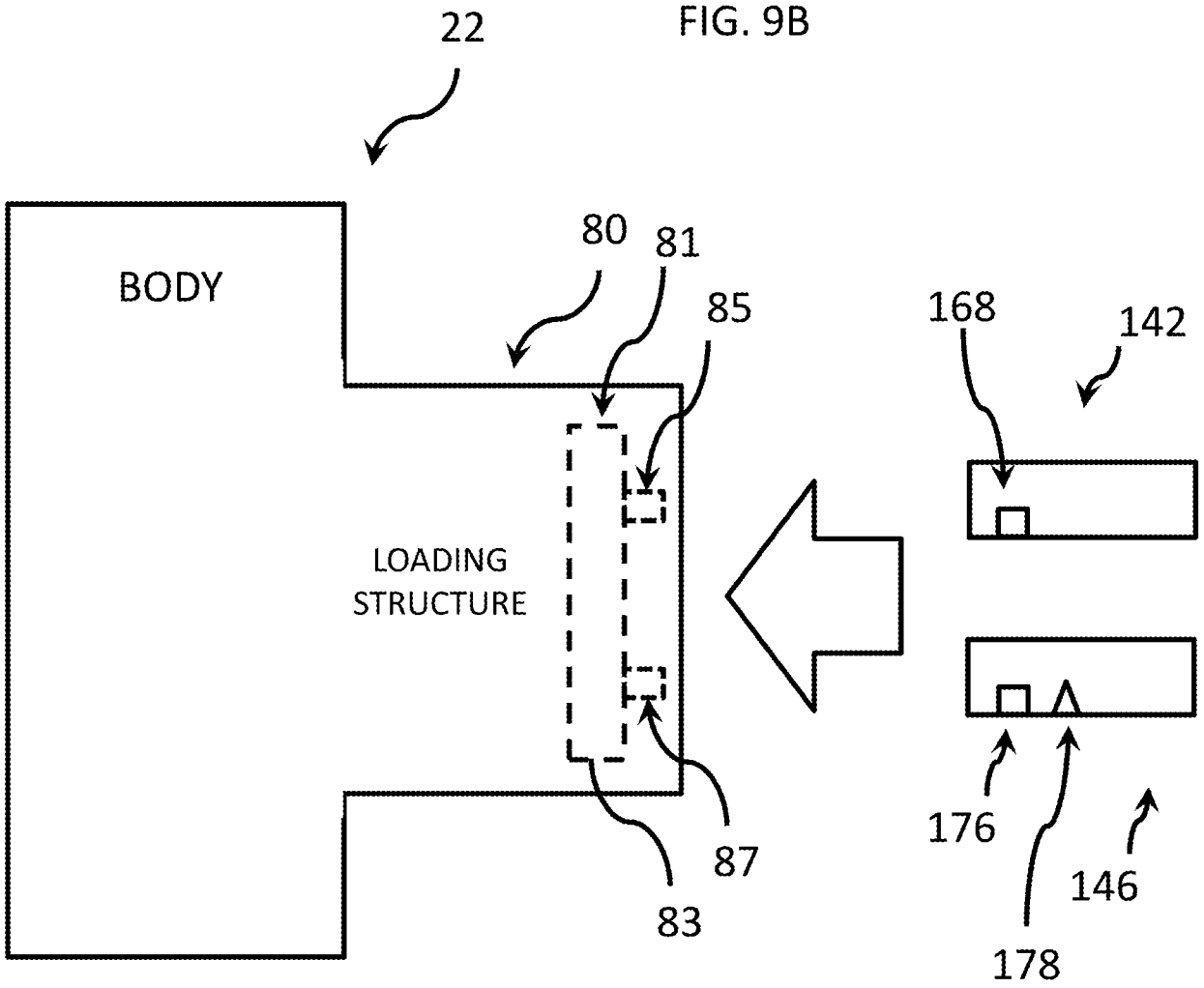
FIG. 9B is a schematic diagram illustrating an embodiment of a firearm magazine loader having an adaptive structure that is compatible with a plurality of different types of firearm magazines.

Referring to FIGS. 9A-9B, in embodiments having or involving a firearm magazine adapter 140 or 144, each firearm magazine adapter 140, 144 is operable with an associated firearm magazine 142, 146, respectively, that is co-operable with a particular type of firearm. For example: (a) an X magazine adapter 140 (FIG. 9A) is configured to partially receive and mate with an X magazine 142; and (b) a Y magazine adapter 144 (FIG. 9A) is configured to partially receive and mate with a Y magazine 146.

In the embodiment shown in FIG. 9A, the X magazine adapter 140 includes a catch mating element 164. The X magazine 142 has a retention structure or catch 168. When the user inserts the X magazine 142 into the X magazine adapter 140, the catch 168 receives, mates with and interlocks with the catch mating element 164. This reversibly secures the X magazine 166 to the X magazine adapter 142 despite the pull-away, loading forces described below.

With continued reference to FIG. 9A, in an embodiment, the Y magazine adapter 144 includes a plurality of catch mating elements 170, 172. The Y magazine 174 has a plurality of retention structures or catches 176, 178. When the user inserts the Y magazine 146 into the Y magazine adapter 144, the catch mating elements 170, 172 receive, mate with and interlock with the catches 176, 178, respectively. In this embodiment, the catch mating elements 170, 172 are male protrusions, and the catch mating elements are female cavities. This reversibly secures the Y magazine 174 to the Y magazine adapter 144 despite the pull-away, loading forces described below.

Figure 16:
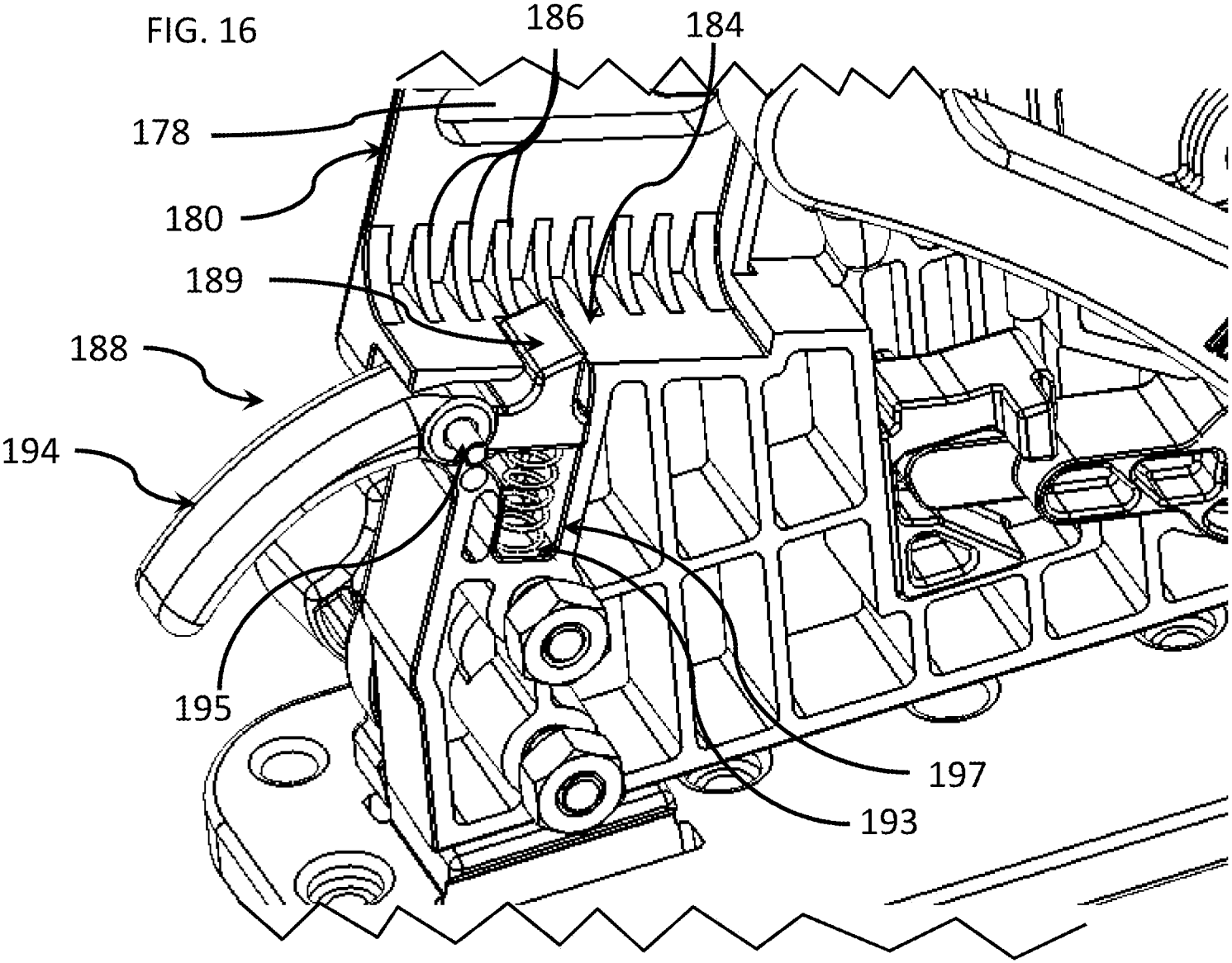
FIG. 16 is an enlarged, fragmentary, isometric interior view of the firearm magazine loader of FIG. 1A.

In the embodiment shown in FIG. 9B, the loading structure 80 defines, includes or incorporates an adaptive device or adaptive structure 81 having an adaptive body 83. In this embodiment, the adaptive structure 81 defines: (a) one or more cavities, channels, or grooves; (b) one or more catches, retention structures, or catch mating elements; (c) one or more adjustment elements 85, 87; or (d) any suitable combination of the foregoing. In an embodiment, each of the adjustment elements 85, 87 is moveably coupled to the adaptive body 83. For example, to receive, mate with and be compatible with the magazine 142, the user can slide, rotate or otherwise move one or all of the adjustable elements 85, 87 to a first position relative to the adaptive body 83. In this first position, the adaptive structure 81 is compatible with the magazine 142. In another example, to receive, mate with and be compatible with the magazine 146, the user can slide, rotate or otherwise move one or all of the adjustable elements 85, 87 to a second position relative to the adaptive body 83. In this second position, the adaptive structure 81 is compatible with the magazine 146. This functionality enables the loading structure 80 to be universally adjustable to accommodate a variety of different types of ammunition or firearm magazines 142, 146 without requiring the involvement of separate magazine adapters. In an embodiment, the adaptive structure 81 includes part or all of the structures, elements and functionality of the magazine adapters 134, 138, 140, 144. In an embodiment, the adjustable elements 85, 87 include one or more catches that are adjustable in a direction so as to achieve computability with a particular firearm magazine, such as a Sig Sauer™, Beretta™ or Glock™ magazine. For example, in this embodiment, a catch 154 (FIG. 11B) of the Glock™ magazine may mate and reversibly interlock with the adaptive structure 81. In other embodiments, the adaptive structure 81 may not include a catch, retention structure, or catching mating element, and the applicable firearm magazine may instead be retained within the adaptive structure 81 using a securement device 188 (FIG. 16).

Figure 10B:
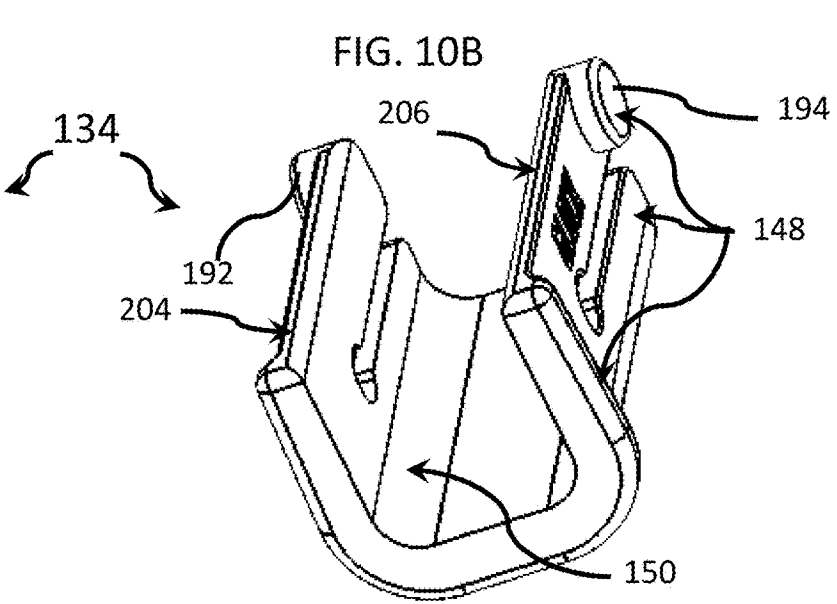
FIG. 10B is another isometric view of the magazine adapter of FIG. 10A.
Figure 10A:
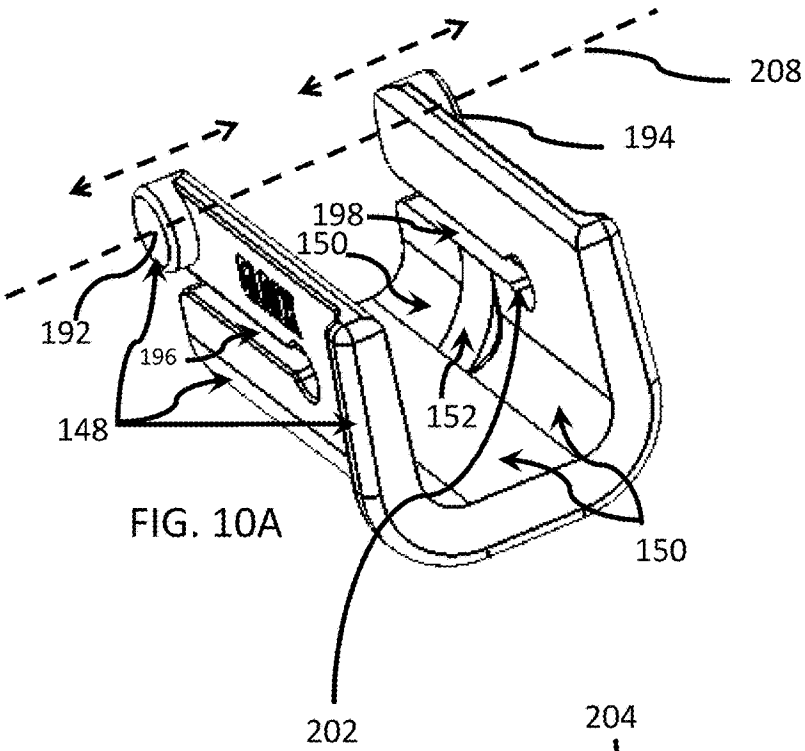
FIG. 10A is an isometric view of an embodiment of a magazine adapter.
Figure 10C:
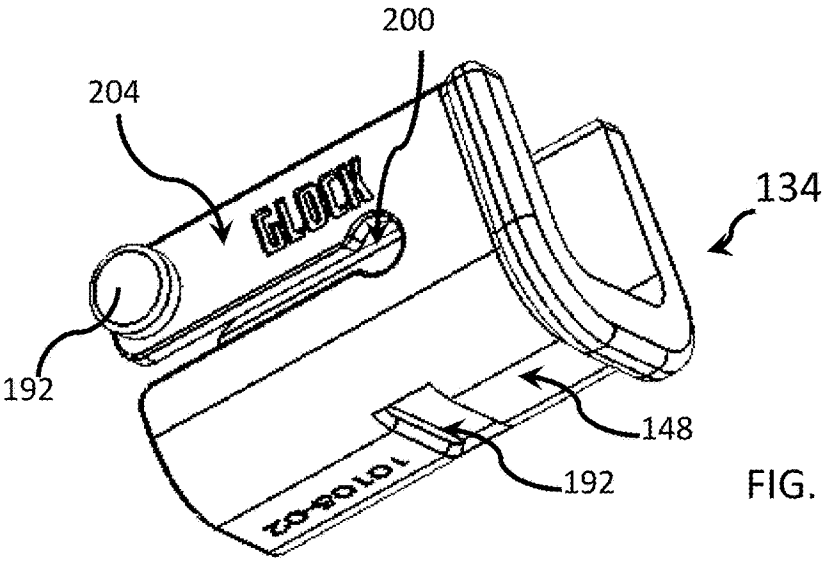
FIG. 10C is yet another isometric view of the magazine adapter of FIG. 10A.

In the example illustrated in FIGS. 10A-10C, a 9 mm Glock™ magazine adapter 134 is configured to partially receive and mate with a 9 mm Glock™ magazine 136. In the example illustrated in FIGS. 13A-13C, a Sig Sauer™ or Beretta™ magazine adapter 138 is configured to partially receive and mate with a Sig Sauer™ or Beretta™ magazine (not shown); In the examples described above, the magazine adapters 134, 138, 140 and 144 differ from one another in at least one physical or functional property or characteristic, so as to be co-operable or otherwise compatible with the different properties or characteristics of the associated firearm magazine. The compatibility advantage provides an important improvement, enabling users to use the firearm magazine loader 10 to load different types of firearm magazines.

Figure 3:
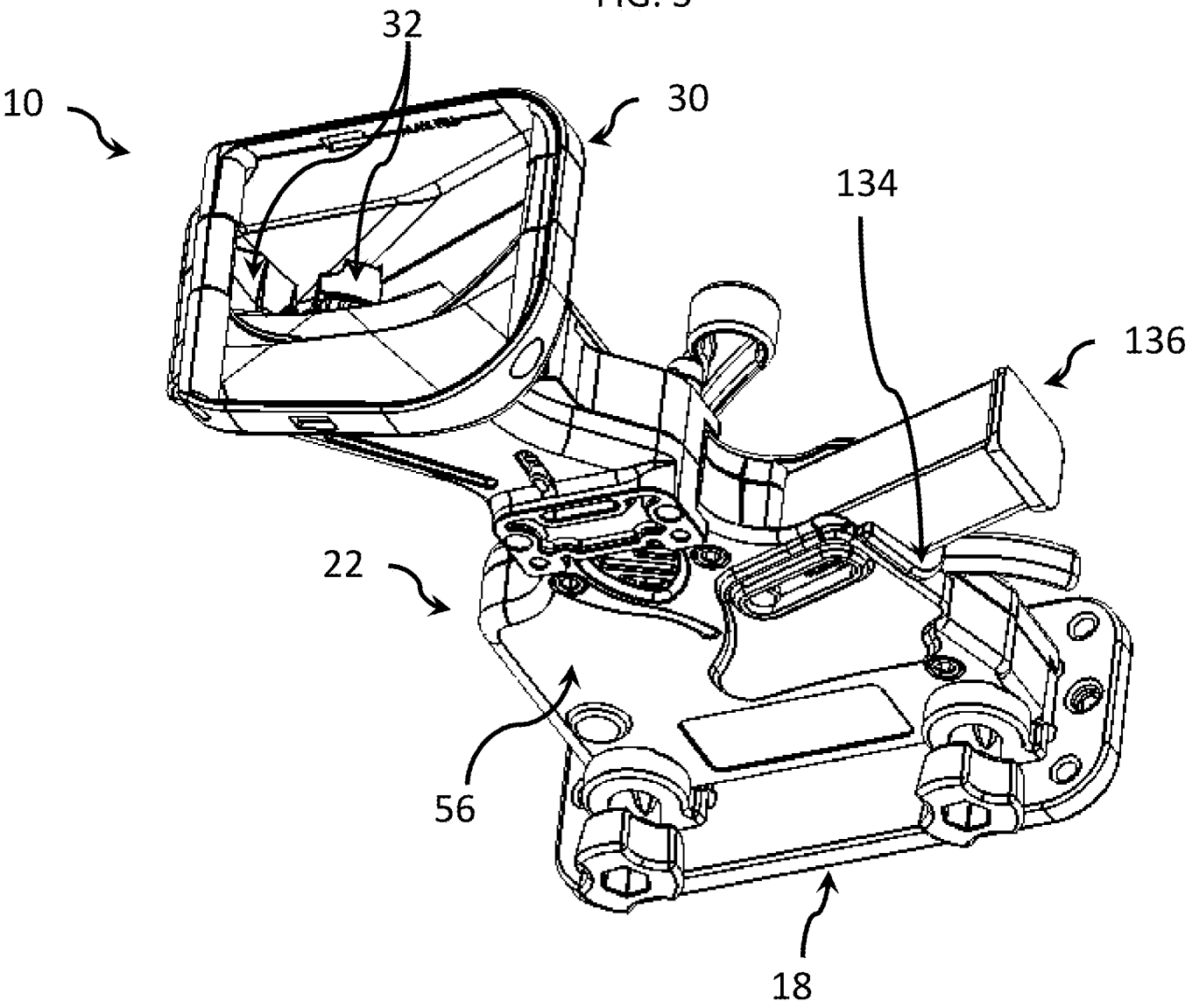
FIG. 3 is a top isometric view of the firearm magazine loader of FIG. 1A, illustrating an embodiment of a magazine installed.
Figure 4:
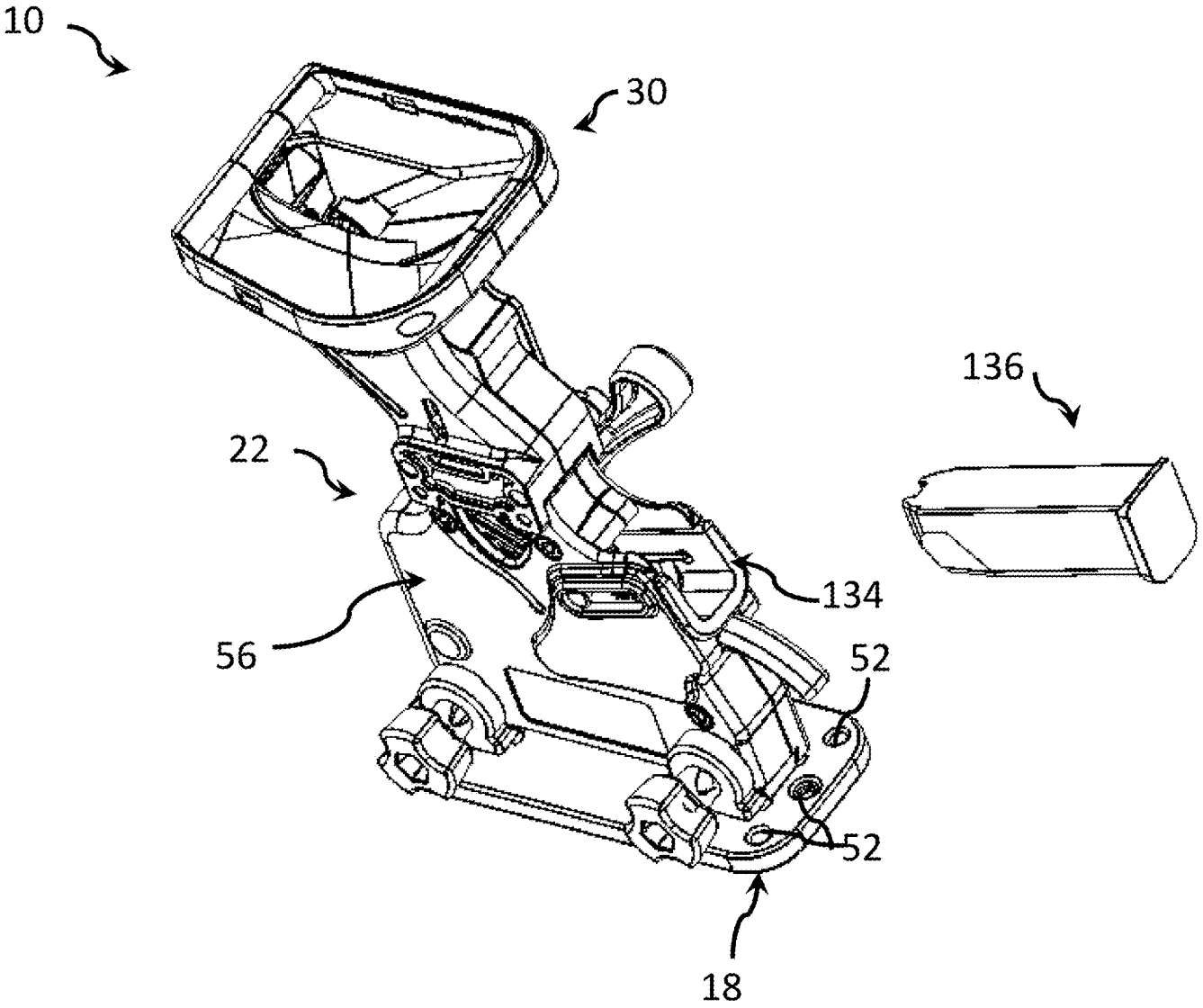
FIG. 4 is a top isometric view of the firearm magazine loader of FIG. 1A, illustrating an embodiment of a magazine uninstalled.
Figure 11B:
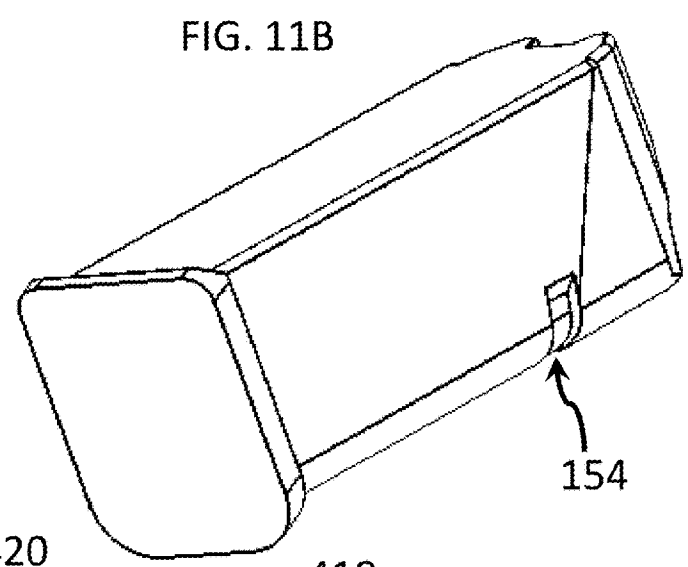
FIG. 11B is another isometric view of the firearm magazine of FIG. 11A.
Figure 11A:
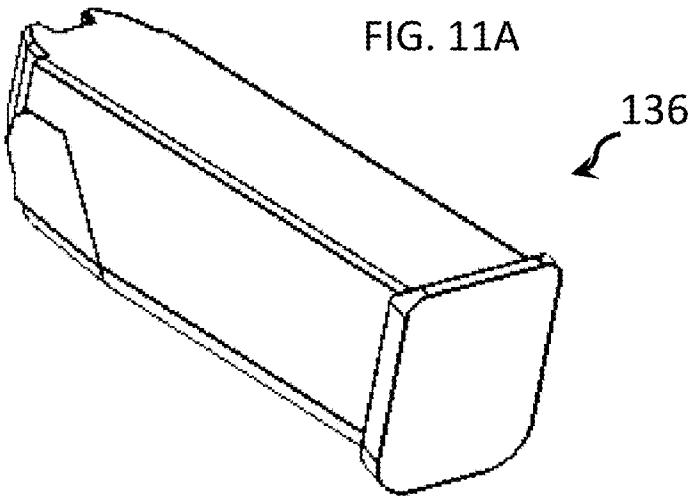
FIG. 11A is an isometric view of an embodiment of an ammunition magazine or firearm magazine.
Figure 11C:
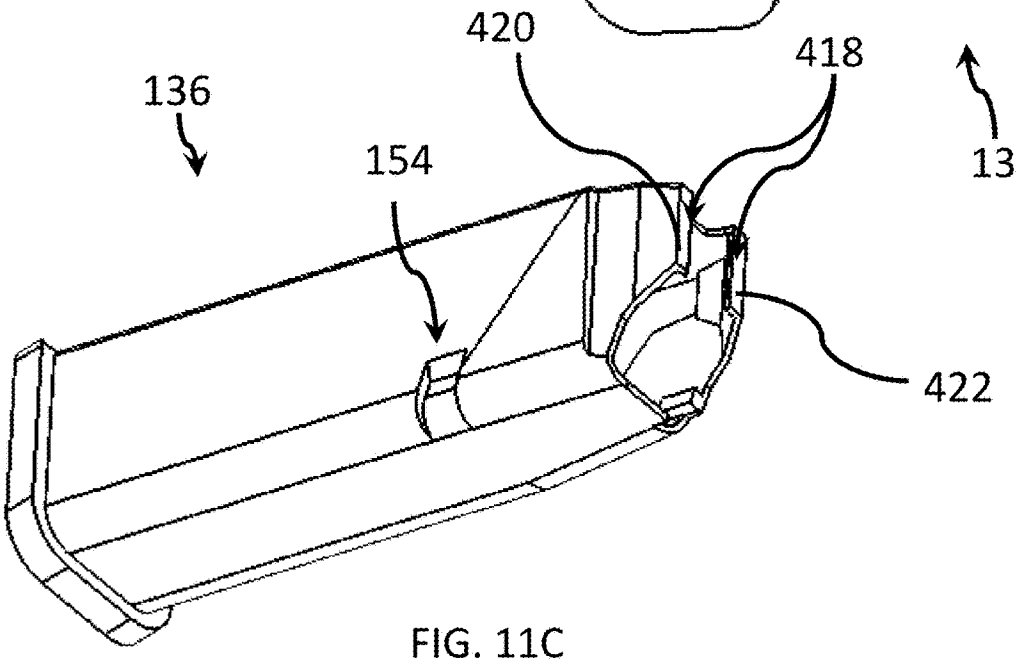
FIG. 11C is yet another isometric view of the firearm magazine of FIG. 11A.
Figures 12A, 12B, 12C:
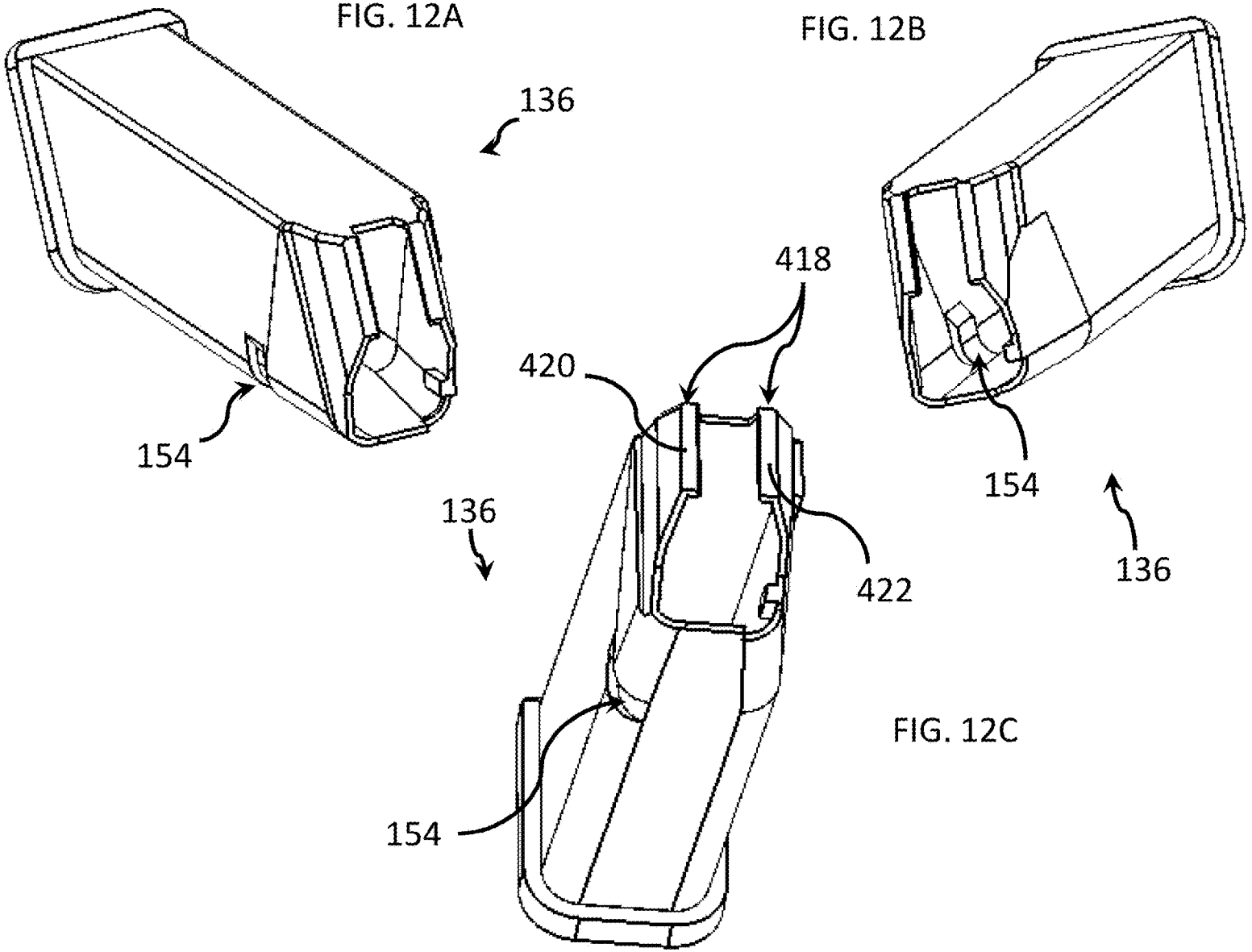
FIG. 12A is still another isometric view of the firearm magazine of FIG. 11A.
FIG. 12B is another isometric view of the firearm magazine of FIG. 11A.
FIG. 12C is yet another isometric view of the firearm magazine of FIG. 11A.

In an embodiment, the Glock™ magazine adapter 134 includes: (a) a body interface portion 148 configured to engage or otherwise interface with the body 22, as illustrated in FIGS. 10A-10C; and (b) a magazine interface portion 150 configured to engage or otherwise interface with the Glock™ magazine 136, as illustrated in FIGS. 10A-10C. The magazine interface portion 150 has a catch mating element 152, as illustrated in FIG. 10A. The Glock™ magazine 136 has a retention structure or catch 154, as illustrated in FIG. 11B. When the user inserts the Glock™ magazine 136 into the Glock™ magazine adapter 134, as shown in FIG. 3, the catch 154 receives, mates with and reversibly interlocks with the catch mating element 152. This secures the Glock™ magazine 136 to the Glock™ magazine adapter 134 despite the pull-away, loading forces described below.

Figure 13B:
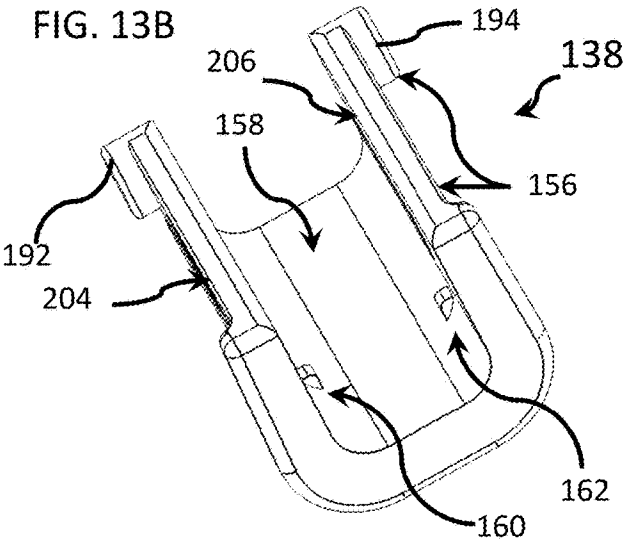
FIG. 13B is another isometric view of the magazine adapter of FIG. 13A.
Figure 13A:
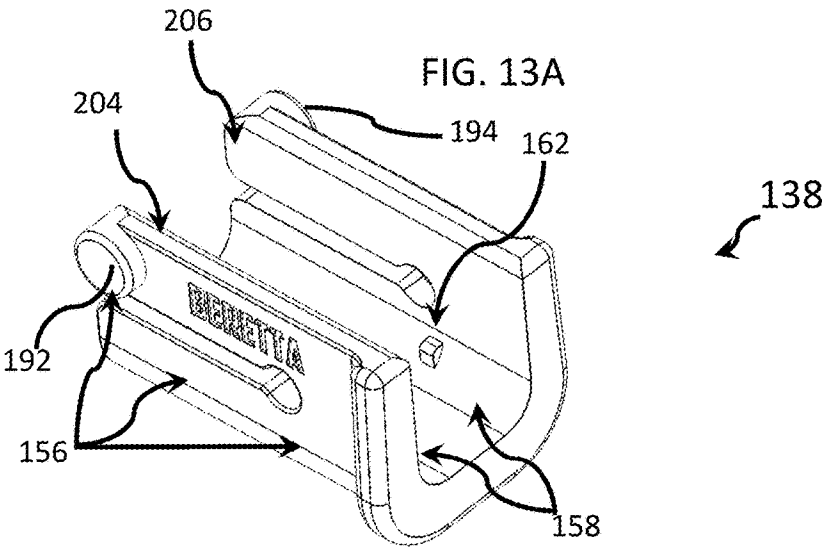
FIG. 13A is an isometric view of an embodiment of a magazine adapter.
Figure 13C:
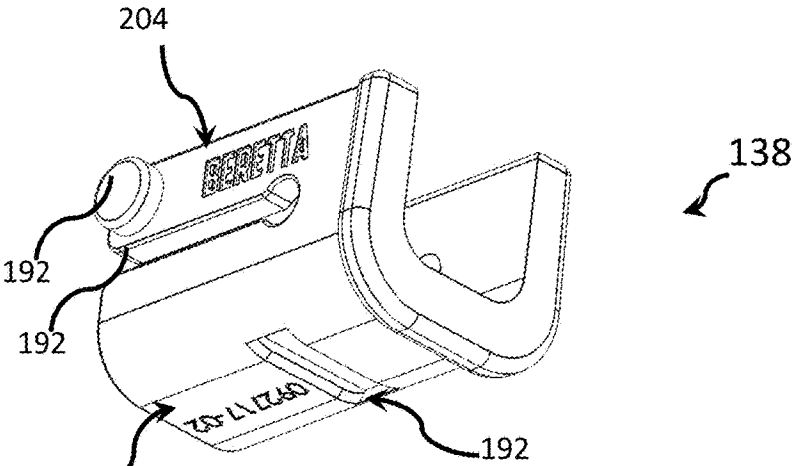
FIG. 13C is yet another isometric view of the magazine adapter of FIG. 13A.
Figure 14B:
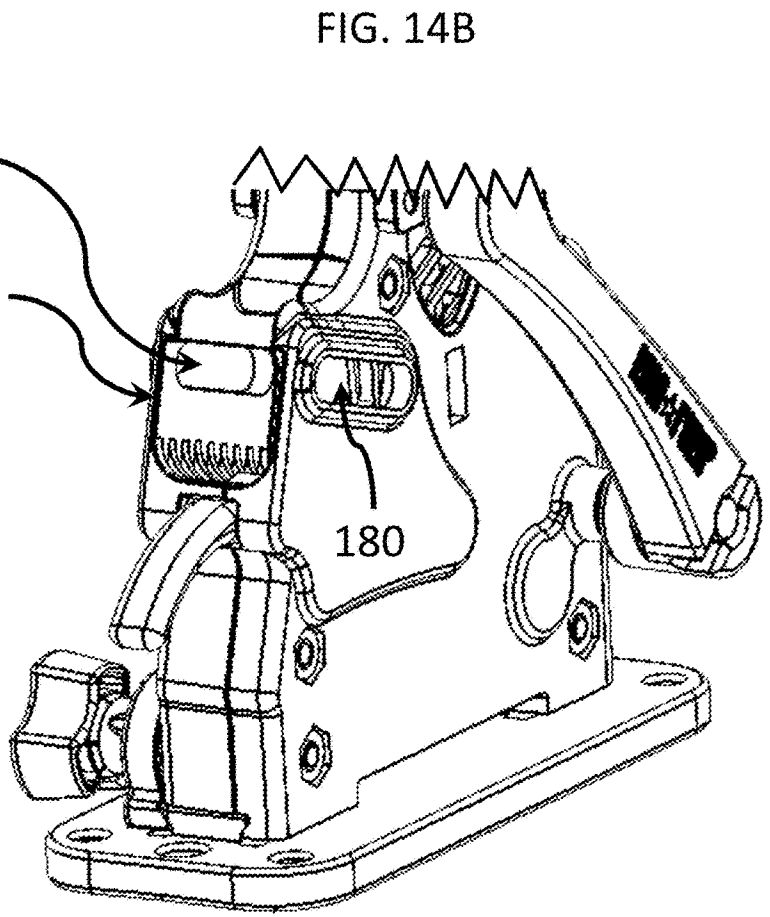
FIG. 14B is another fragmentary, isometric view of the firearm magazine loader of FIG. 1A, illustrated without a magazine adapter or firearm magazine.
Figure 14A:
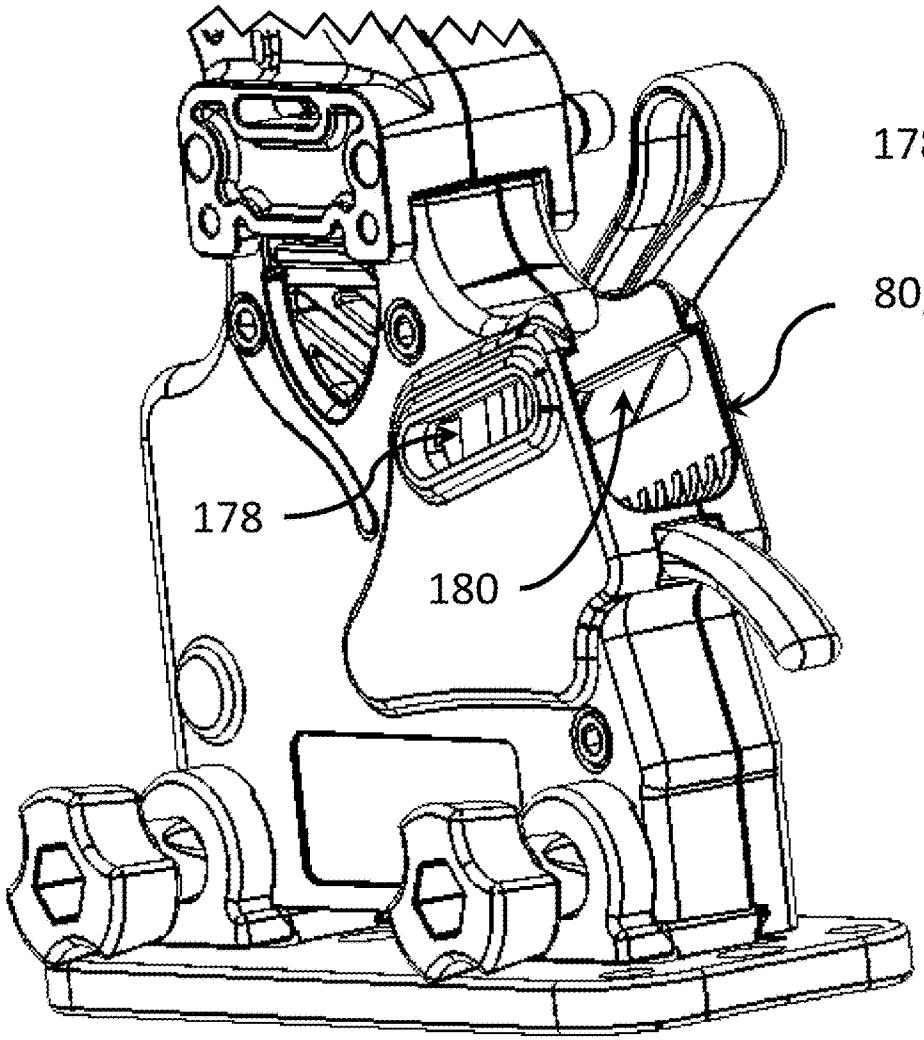
FIG. 14A is a fragmentary, isometric view of the firearm magazine loader of FIG. 1A, illustrated without a magazine adapter or firearm magazine.
Figure 15:
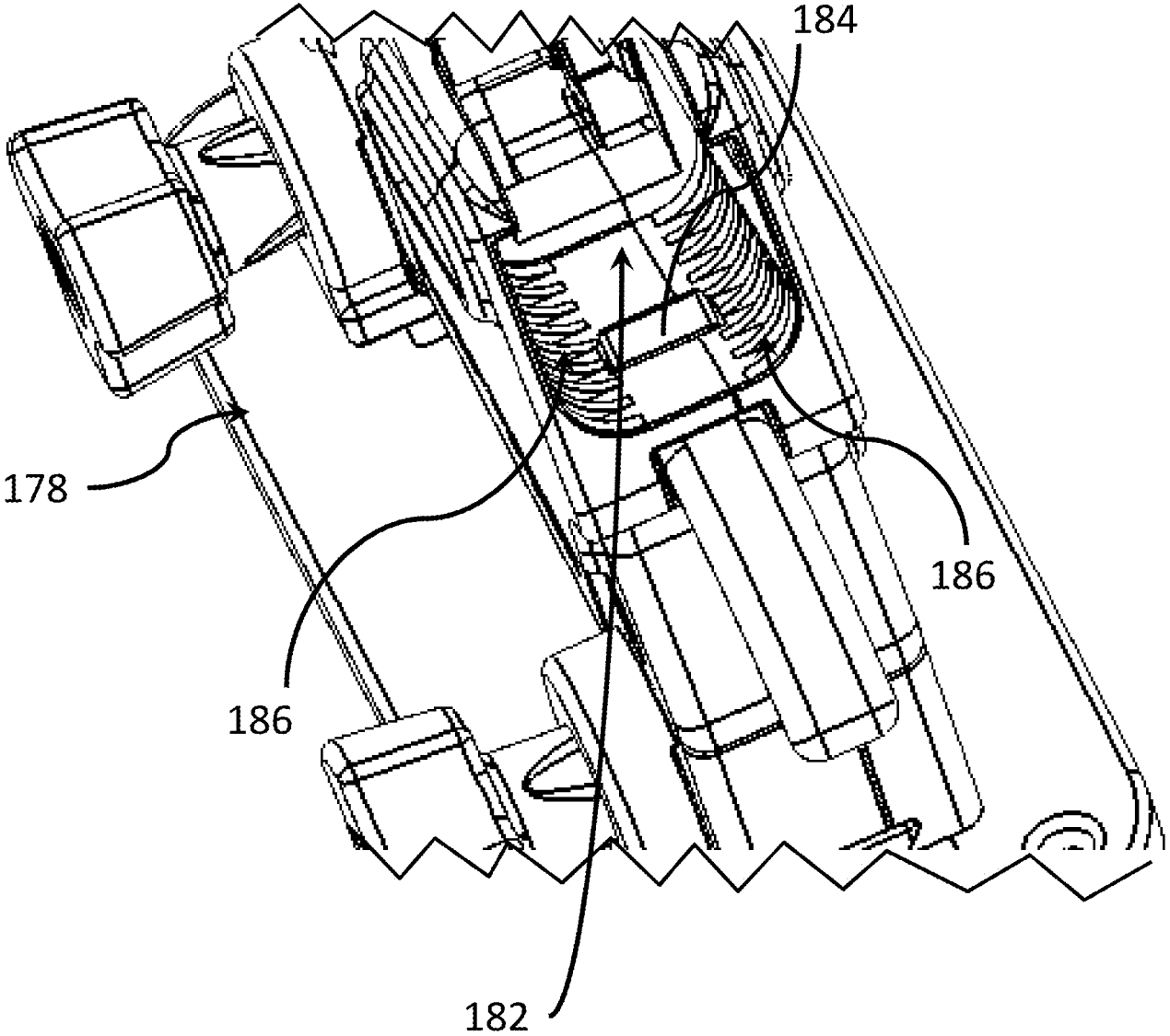
FIG. 15 is an enlarged, fragmentary, isometric view of the firearm magazine loader of FIG. 1A, illustrated without a magazine adapter or firearm magazine.

In an embodiment, the Sig Sauer™ or Beretta™ magazine adapter 138 includes: (a) a body interface portion 156 configured to engage or otherwise interface with the body 22, as illustrated in FIGS. 10A-10C; and (b) a magazine interface portion 158 configured to engage or otherwise interface with a 9 mm Sig Sauer™ or Beretta™ magazine (not shown). The magazine interface portion 156 has a plurality of catch mating elements 160, 162, as illustrated in FIG. 13B. The 9 mm Sig Sauer™ or Beretta™ magazine (not shown) has a plurality of retention structures or catches. When the user inserts the 9 mm Sig Sauer™ or Beretta™ magazine into the Sig Sauer™ or Beretta™ magazine adapter 138, the catches 160, 162 receive, mate with and interlock with the catch mating elements of the 9 mm Sig Sauer™ or Beretta™ magazine. This reversibly secures the 9 mm Sig Sauer™ or Beretta™ magazine to the Sig Sauer™ or Beretta™ magazine adapter 138 despite the pull-away, loading forces described below.

As described above, the set or kit of magazine adapters 134, 138, 140, 144 enable the firearm magazine loader 10 to be compatible with a plurality of different styles, types and shapes of firearm magazines. In an embodiment, the firearm magazine loader 10 includes, or packaged with, one or more of the magazine adapters 134, 138, 140, 144. In another embodiment, the firearm magazine loader 10 excludes, and is distributed apart from, the magazine adapters 134, 138, 140, 144. In such embodiment, users can procure a kit of magazine adapters 134, 138, 140, 144 for use with the firearm magazine loader 10.

Referring to FIGS. 4 and 14A-21, in an example, the first step to use the firearm magazine loader 10, involves coupling the magazine adapter 134 to the loading structure 80. The loading structure 80 defines a loading space 89 (FIGS. 14A-14B), a plurality of coupling slots 178, 180, a magazine receiving space 182, an adapter securement slot 184 and a plurality of equally spaced-apart friction enhancers 186.

In this embodiment, the firearm magazine loader 10 includes a securement device 188, as illustrated in FIG. 16. The securement device 188, which is coupled to the loading structure 80, includes: (a) a securement member 189 configured to protrude through the adapter securement slot 184 and interchangeably engage the adapter retainer 192 (FIGS. 10C and 13C) of the magazine adapter 134 or 138; (b) a biasing member 193 configured bias the securement member 189 into engagement with the adapter retainer 192; (c) a grasp 194 configured to be moved between a plurality of positions; and (d) a pivot member 195 that pivotally couples the securement member 189 to the loading structure 80. The loading structure 80 defines a channel 197 that holds and receives the biasing member 193. Depending upon the embodiment, the biasing member 193 can include a compression spring, coil spring, elastic member or any other suitable type of bias generator.

As illustrated in FIGS. 10A-10C and 13A-13C, the body interface portions 148, 156 of the magazine adapters 134, 138, respectively, have a plurality of notches, protrusions or retaining members 192, 194. In addition, each of the magazine adapters 134, 138 defines a plurality of flex slots 196, 198 having a plurality of enlarged flex spaces 200, 202, respectively. The flex slots 196, 198 define a plurality of flexible sections 204, 206, respectively. The flex slots 196, 198 facilitate the flexing of the flexible sessions 204, 206 along the flex axis 208.

Figure 17:
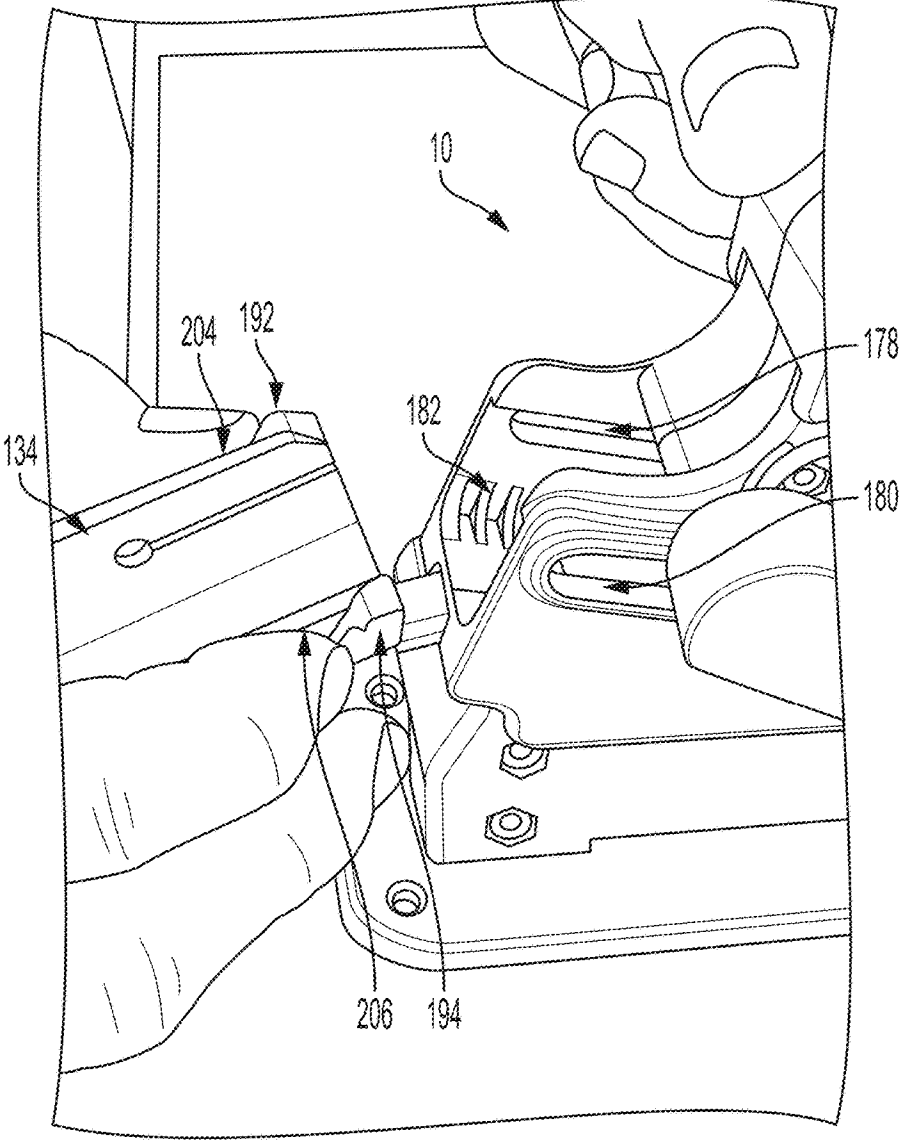
FIG. 17 is an enlarged, isometric view of a portion of the firearm magazine loader of FIG. 1A, illustrating a magazine adapter being inserted into the loading structure of the firearm magazine adapter.
Figure 18:
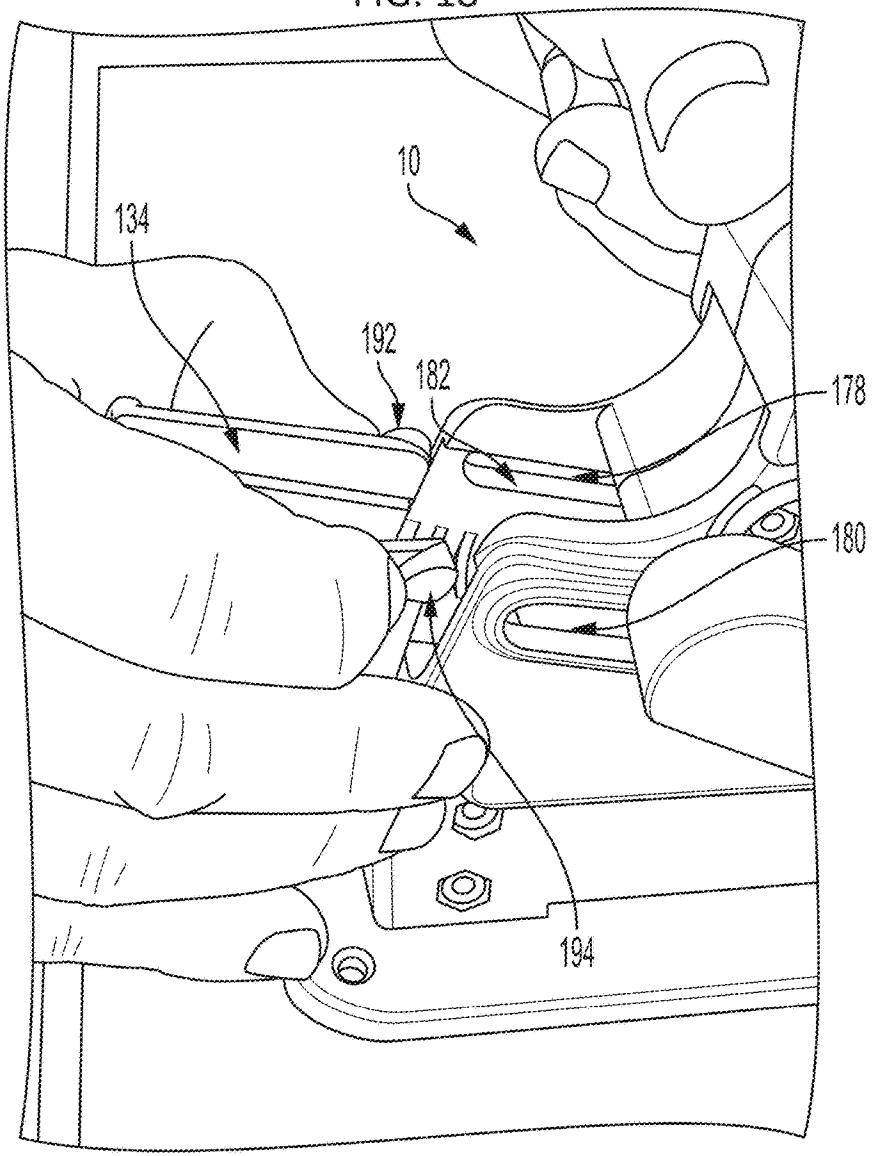
FIG. 18 is an enlarged, isometric view of a portion of the firearm magazine loader of FIG. 1A, illustrating a magazine adapter being squeezed and engaged with the loading structure of the firearm magazine adapter.
Figure 19:
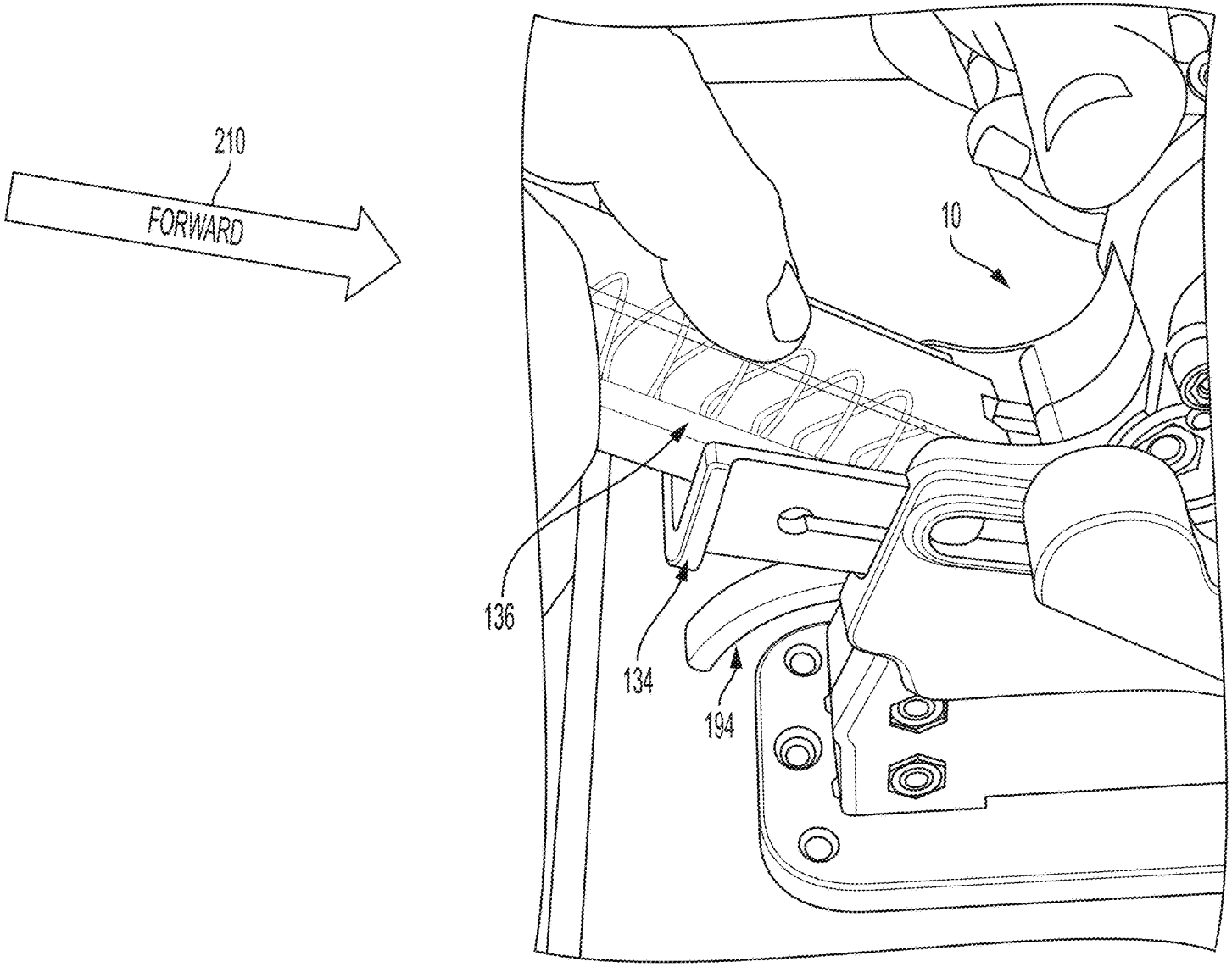
FIG. 19 is an enlarged, isometric view of a portion of the firearm magazine loader of FIG. 1A, illustrating a magazine being inserted into a magazine adapter that has been inserted into the loading structure of the firearm magazine adapter.

As illustrated in FIGS. 17-19, the user can squeeze the flexible sections 204, 206 together until the retaining members 192 fit within the magazine receiving space 182. Then, the user can align the retaining members 192, 194 with the coupling slots 178, 180, respectively. Next, the user can release the flexible sections 204, 206, at which point the flexible sections 204, 206 will elastically move away from each other until the retaining members 192, 194 move into the coupling slots 178, 180, respectively. In an embodiment, the flexible sections 204, 206 include a biasing characteristic, including, but not limited to, an elastic characteristic of the material used to construct the magazine adapter 134, such as a flexible or semi-rigid polymer.

Figure 20:
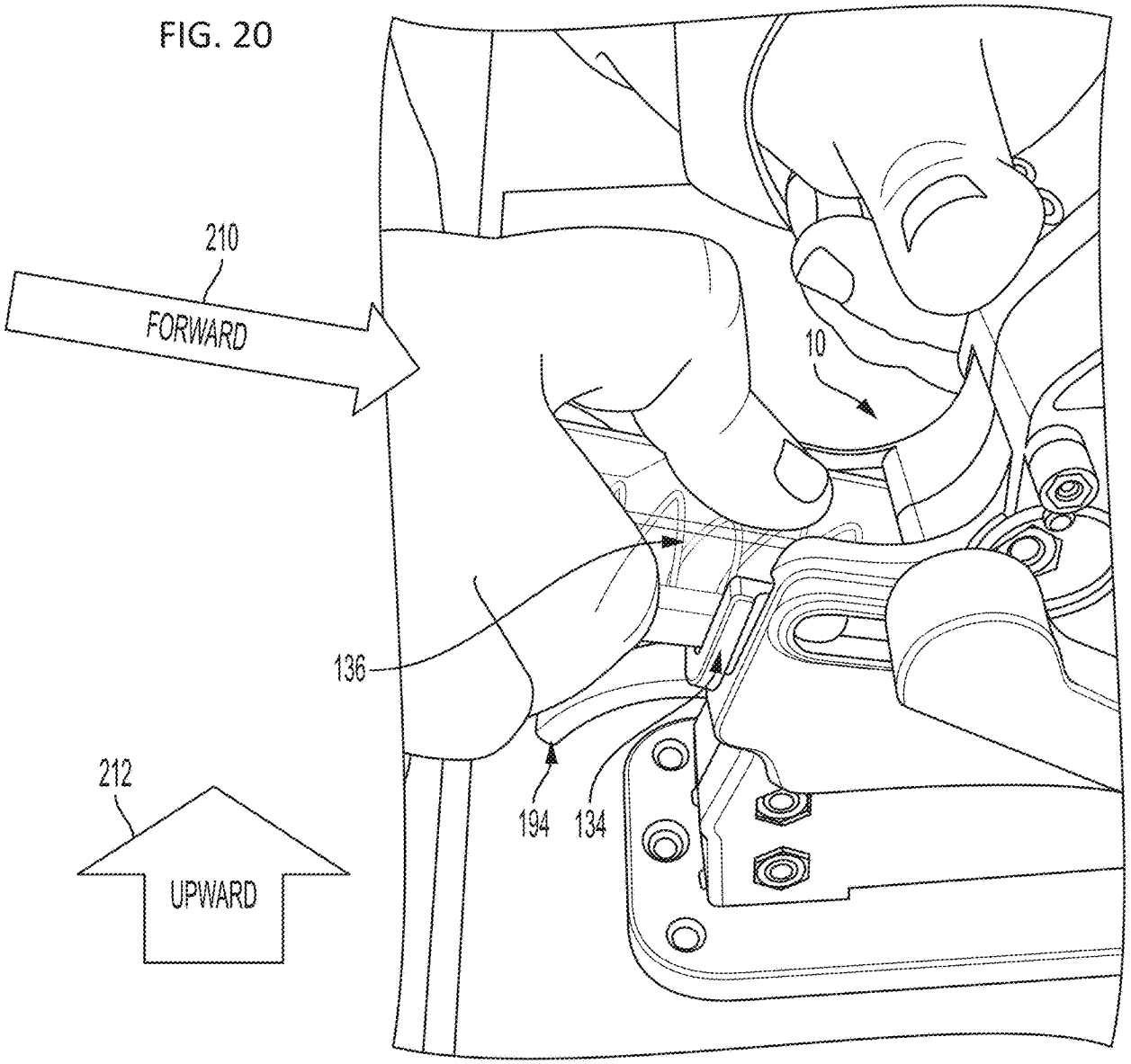
FIG. 20 is an enlarged, isometric view of a portion of the firearm magazine loader of FIG. 1A, illustrating a magazine installed in a magazine adapter which, in turn, is installed in the loading structure of the firearm magazine adapter, wherein the magazine adapter is secured so that the end of the magazine remains held within a loading space of the firearm magazine loader.

Next, as illustrated in FIGS. 19-20, the user can insert an empty magazine 136 into the magazine adapter 134. In doing so, the catch 154 (FIG. 11B) interlocks with the catch mating element 152 (FIG. 10A). As the user pushes in the forward direction 210, the magazine 136 drives the magazine adapter 134 forward until the adapter retainer 192 (FIG. 10C) reaches the securement member 189 (FIG. 16). At that point, the securement member 189, biased in a vertical or upward direction 212 due to the biasing member 193, moves into the adapter retainer 192, establishing a reversible interlock, as shown in FIG. 20.

Figure 21:
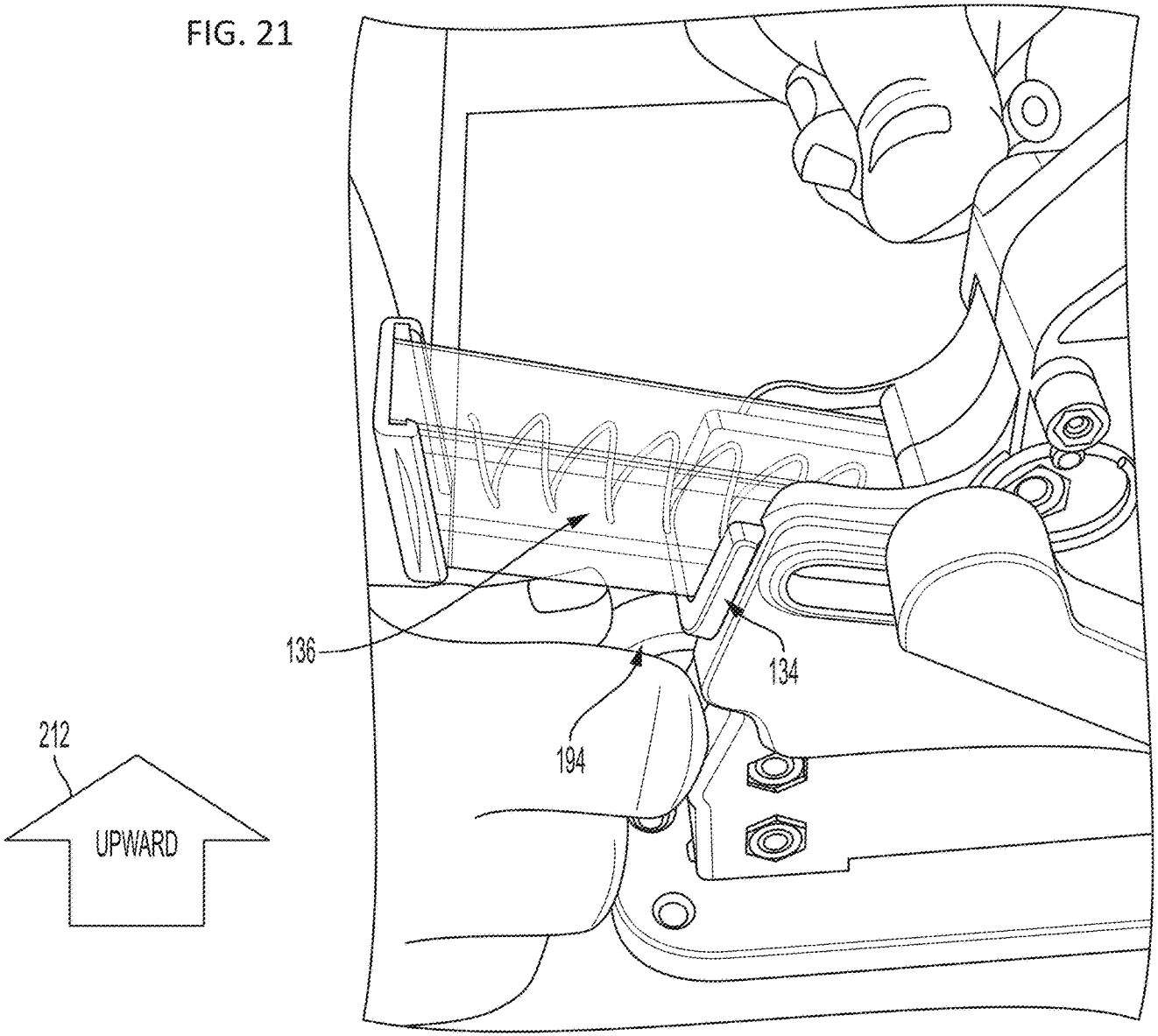
FIG. 21 is an enlarged, isometric view of a portion of the firearm magazine loader of FIG. 1A, illustrating a magazine installed in a magazine adapter which, in turn, is installed in the loading structure of the firearm magazine adapter and further illustrating a grasp that is operable to decouple the magazine adapter from the firearm magazine loader.
Figure 22:
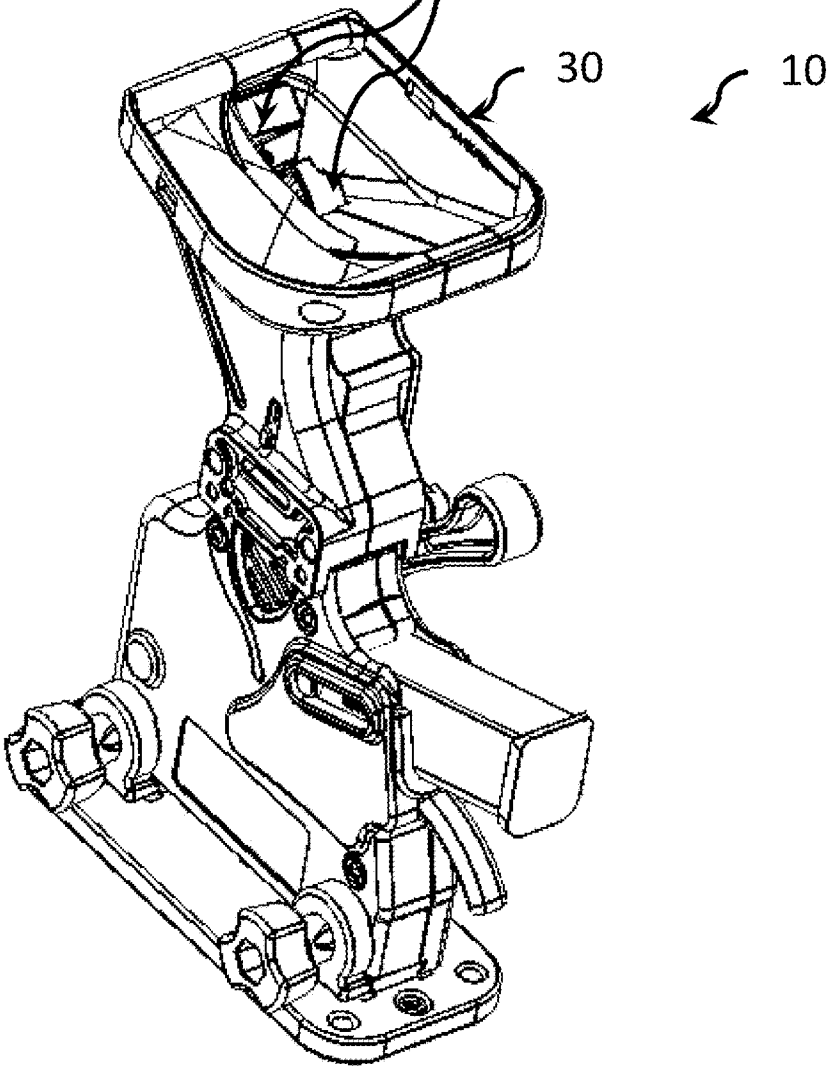
FIG. 22 is a top isometric view of an embodiment of the firearm magazine loader of FIG. 1A.
Figure 23B:
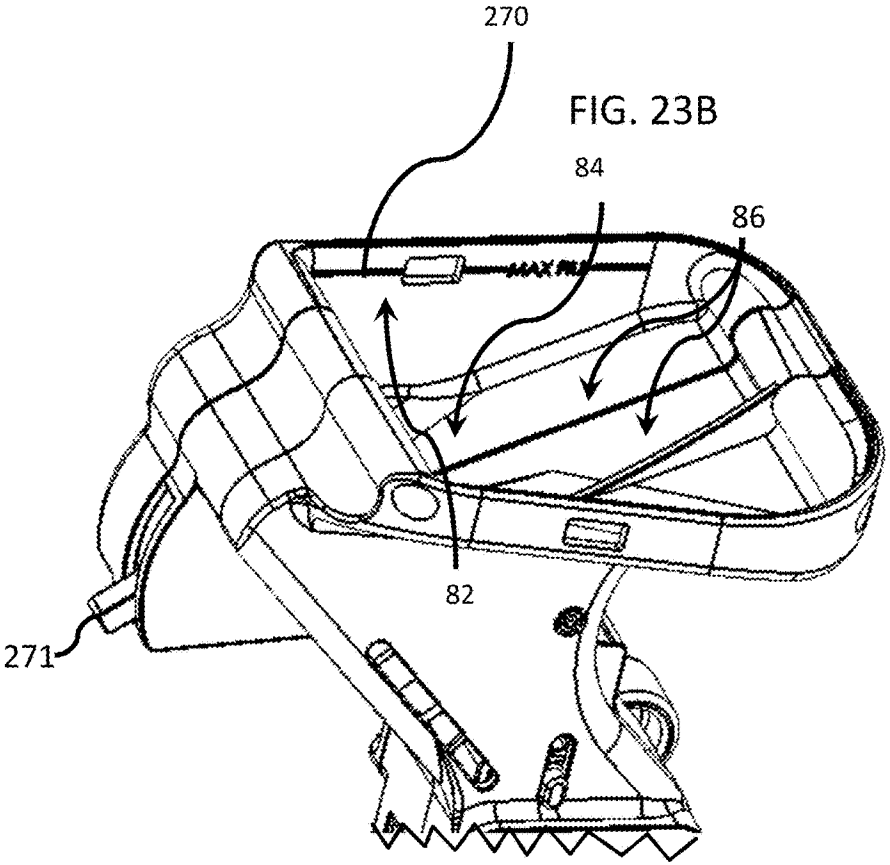
FIG. 23B is another enlarged, top isometric view of the firearm magazine loader of FIG. 1A, illustrating the receptacle.
Figure 23A:
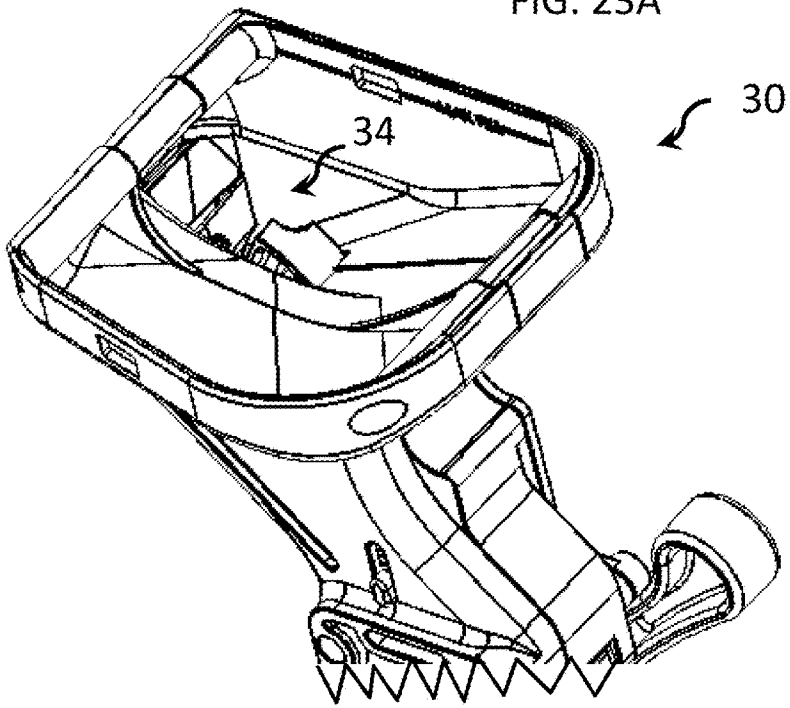
FIG. 23A is an enlarged, top isometric view of the firearm magazine loader of FIG. 1A, illustrating the receptacle.

As illustrated in FIG. 21, to remove a magazine adapter 134 (carrying a loaded magazine 136) the user can pull upward on the grasp 194. This upward force causes the securement member 189 (FIG. 16) to move downward and out of the adapter retainer 192 (FIG. 10C). This frees the magazine adapter 134 for removal from the firearm magazine loader 10.

Figure 24:
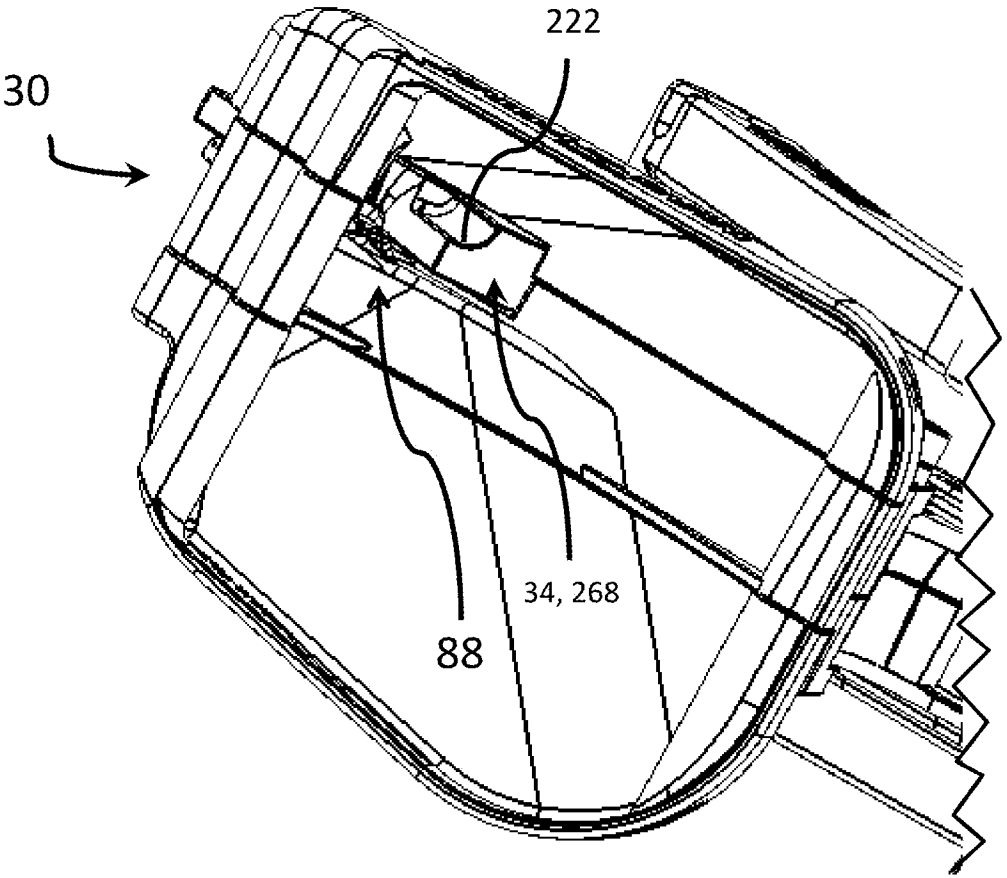
FIG. 24 is an enlarged, top isometric view of an embodiment of the receptacle of the firearm magazine loader of FIG. 1A.
Figure 25:
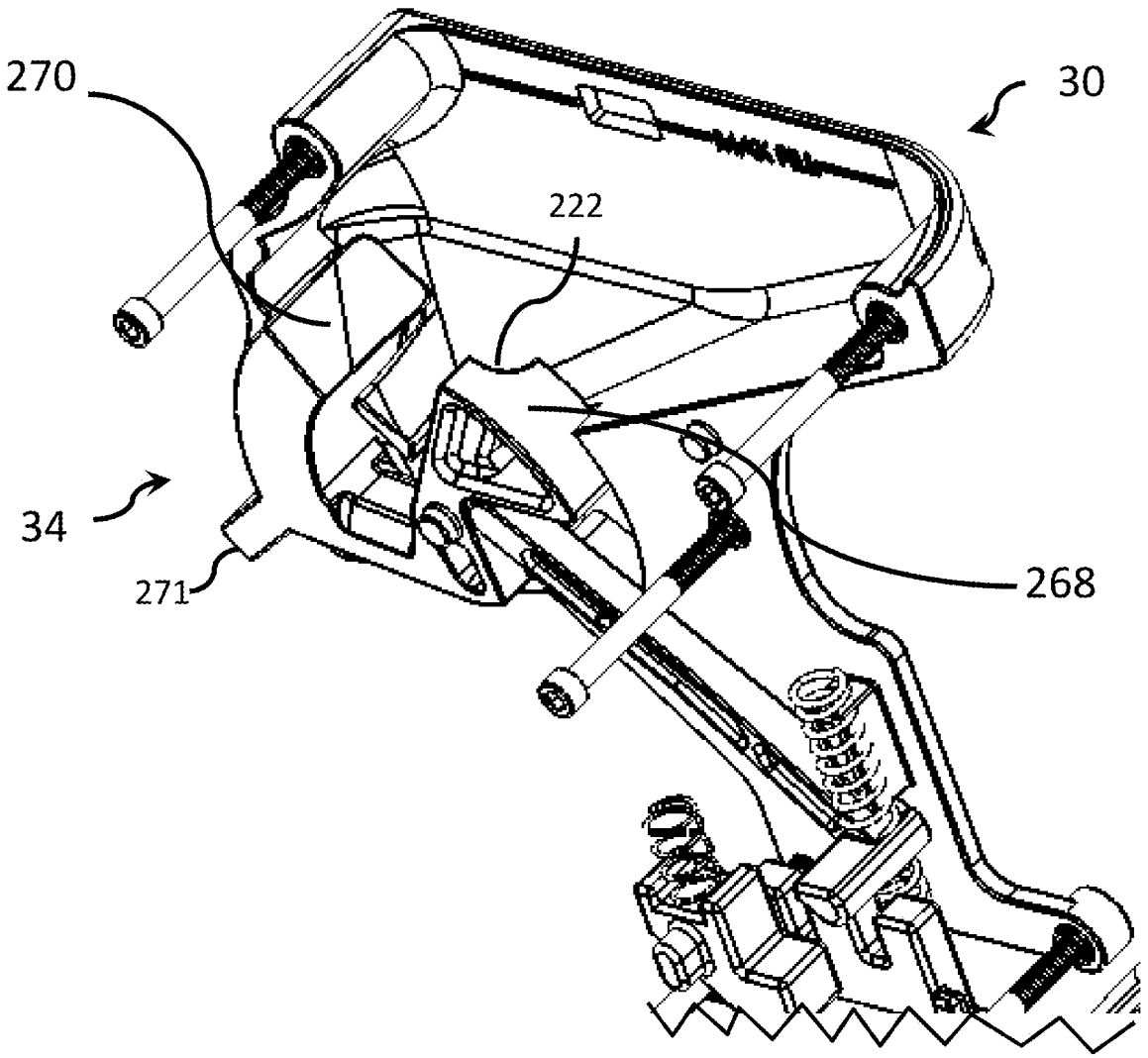
FIG. 25 is an isometric view of the firearm magazine loader of FIG. 1A with a panel and intermediate portion removed.
Figure 26:
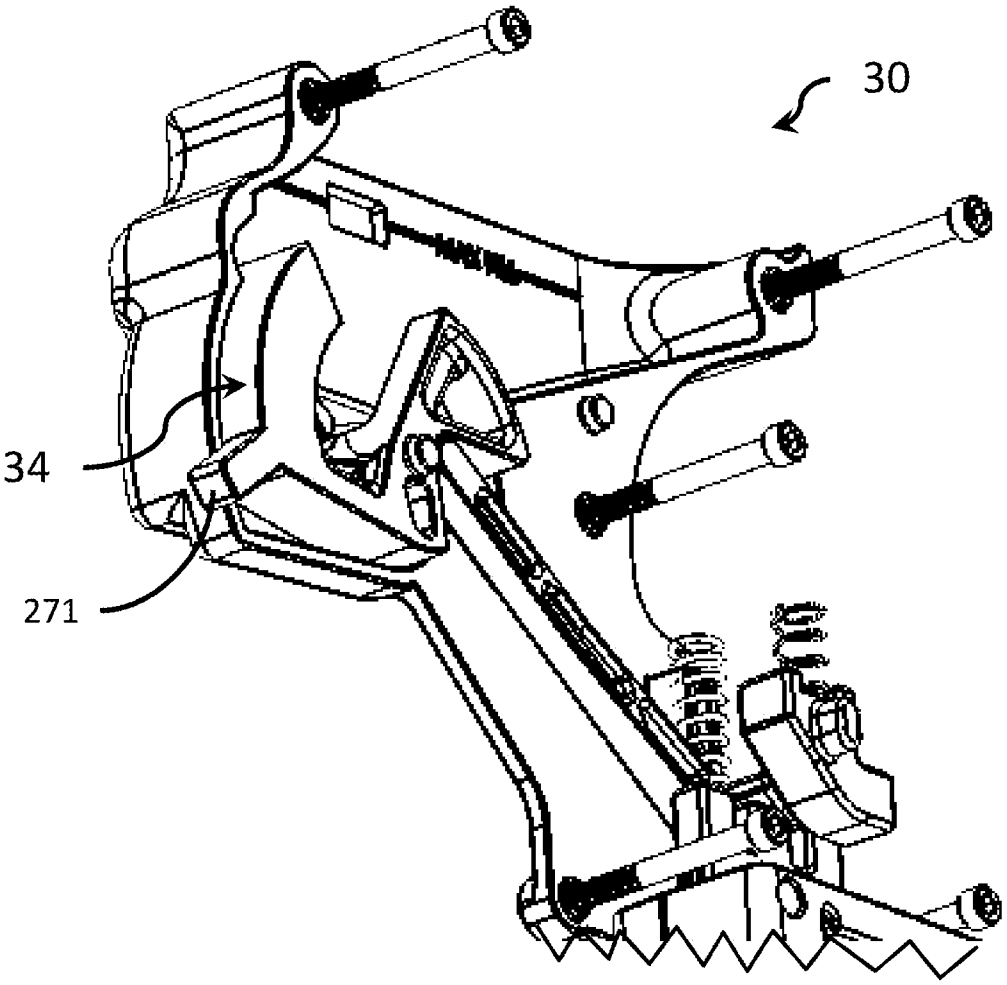
FIG. 26 is another isometric view of the firearm magazine loader of FIG. 1A with a panel and intermediate portion removed.
Figure 31:
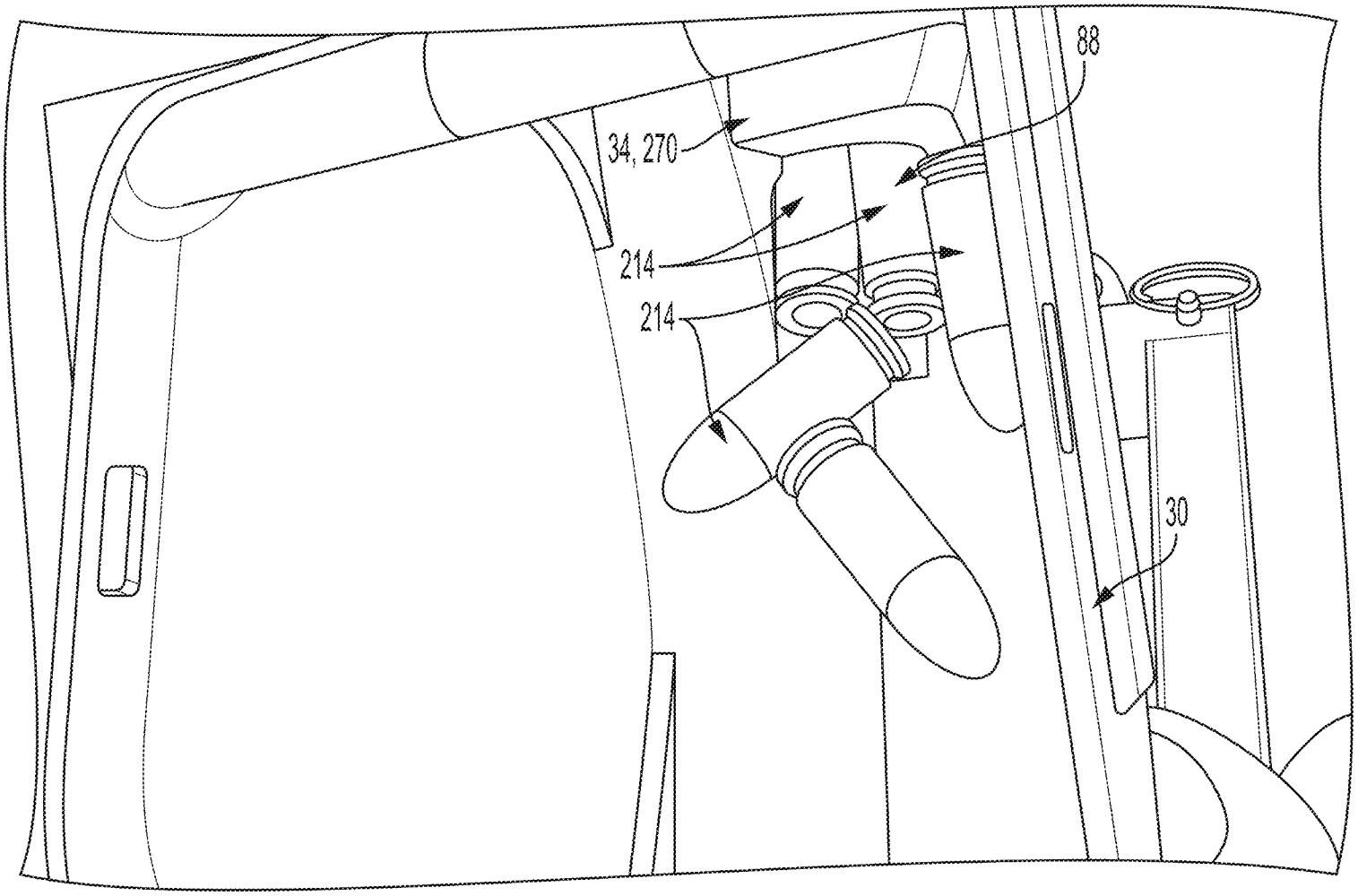
FIG. 31 is a top isometric view of the firearm magazine loader of FIG. 1A, illustrating a plurality of ammunition units simultaneously sliding downward through the cavity or passage defined by the agitator.
Figure 32:
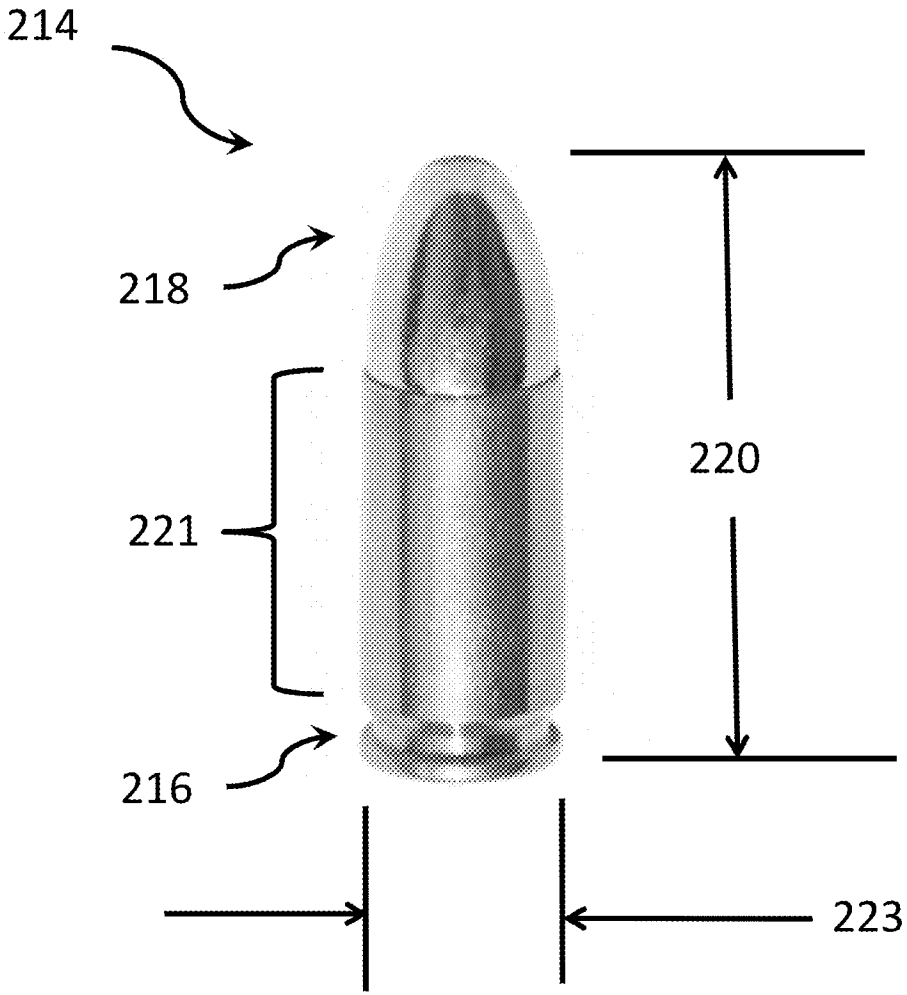
FIG. 32 is an isometric view of an embodiment of an ammunition cartridge unit.

For loading purposes, however, the user will keep the magazine adapter 134 (carrying an empty Magazine 136) installed in the firearm magazine loader 10. Next, referring to FIGS. 22-32, the user can dump or pour a box or handful of ammunition cartridge units 214 into the receptacle 30. In an embodiment illustrated in FIG. 32, each ammunition cartridge unit 214 includes a rim end 216 defining an annular recess, a bullet end 218 and a tubular case 221 extending between the rim end 216 and the bullet end 218. The ammunition cartridge unit 214 has a length dimension 220. In an embodiment, the case 221 has a diameter 223, and the bullet end 218 is heavier than the rim end 216. For example, the bullet end 218 can have a higher density that the rim end 216. The bullet end 218 can be constructed of a solid lead core or a hollowed tip constructed of lead. As shown in FIG. 31, the ammunition cartridge units 214 can be oriented so that: (a) multiple ammunition cartridge units 214 simultaneously pass through the receptacle opening 88, which is partially defined by the agitator concave surface 222, as shown in FIG. 24; (b) the rim end 216 of any of the ammunition cartridge units 214 is oriented below or downward from the bullet end 218, wherein the ammunition cartridge unit 214 travels downward with the rim end 216 first; or (c) the bullet end 218 of any of the ammunition cartridge units 214 is oriented below or downward from the rim end 216, wherein the ammunition cartridge unit 214 travels downward with the bullet end 218 first.

Figure 33:
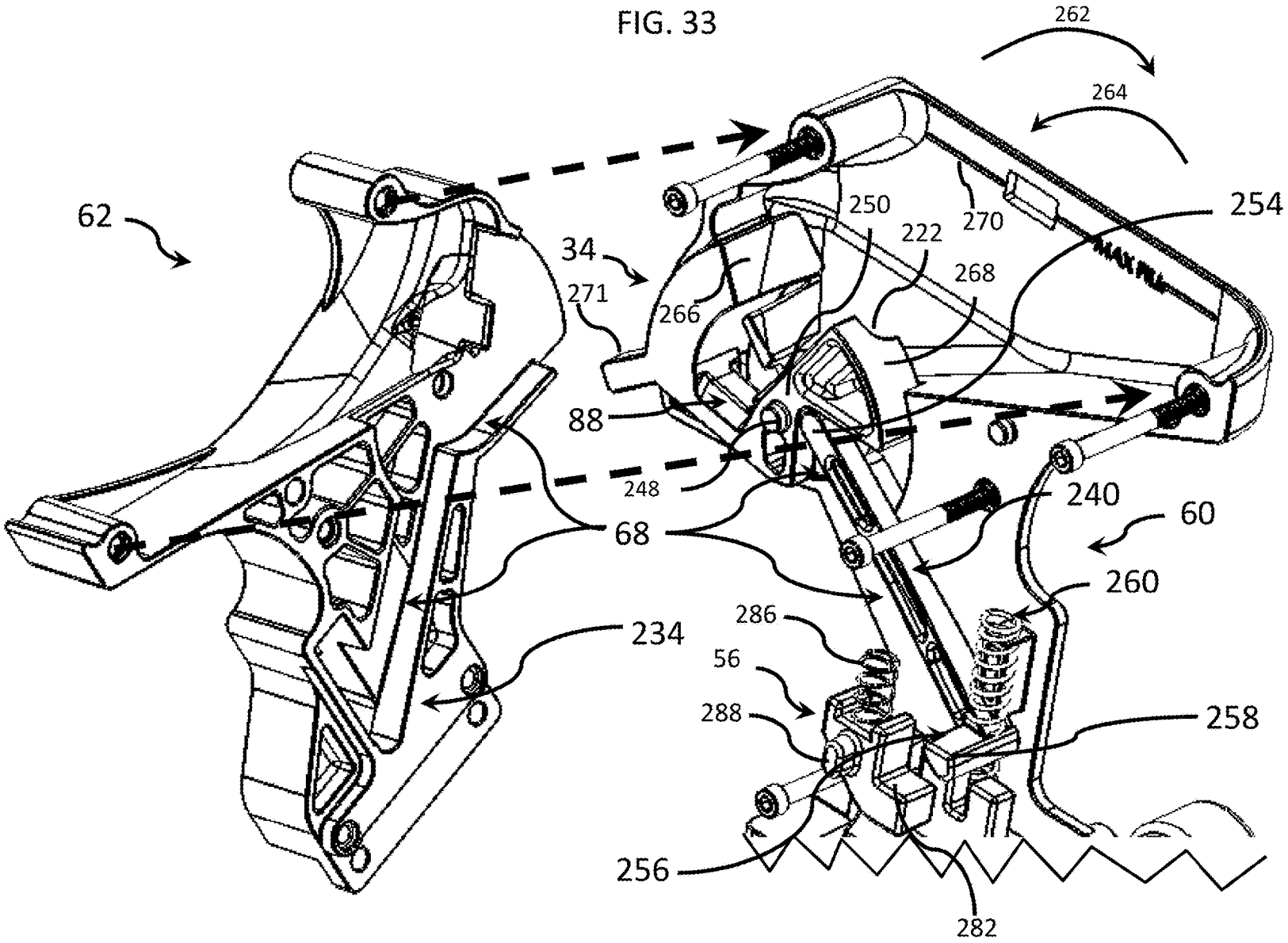
FIG. 33 is an exploded view of the firearm magazine loader of FIG. 1A, illustrating a separation of a panel from an intermediate portion.
Figure 34:
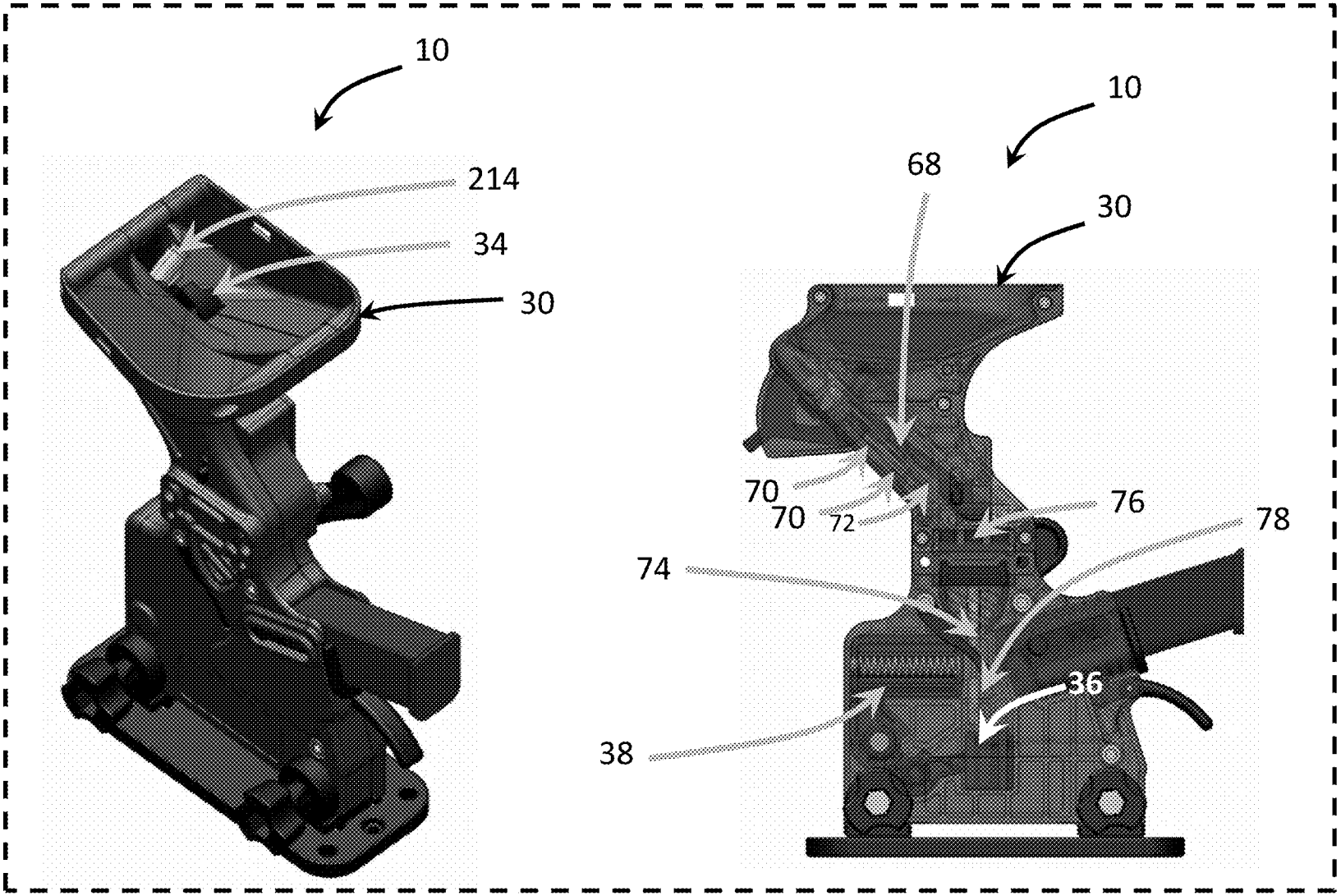
FIG. 34 is an isometric view of an embodiment of the firearm magazine loader of FIG. 1A, illustrating the traveling of an ammunition cartridge unit downward through the firearm magazine loader.

Referring to FIGS. 33-34, due to gravity, the ammunition cartridge units 214 travel or move downward through the receptacle opening 88, into the primary input 70 and through the primary passage 68. As shown, the primary passage 68 is defined by the union or assembly of the intermediate body portion 62 with the upper panel 60.

Figure 35:
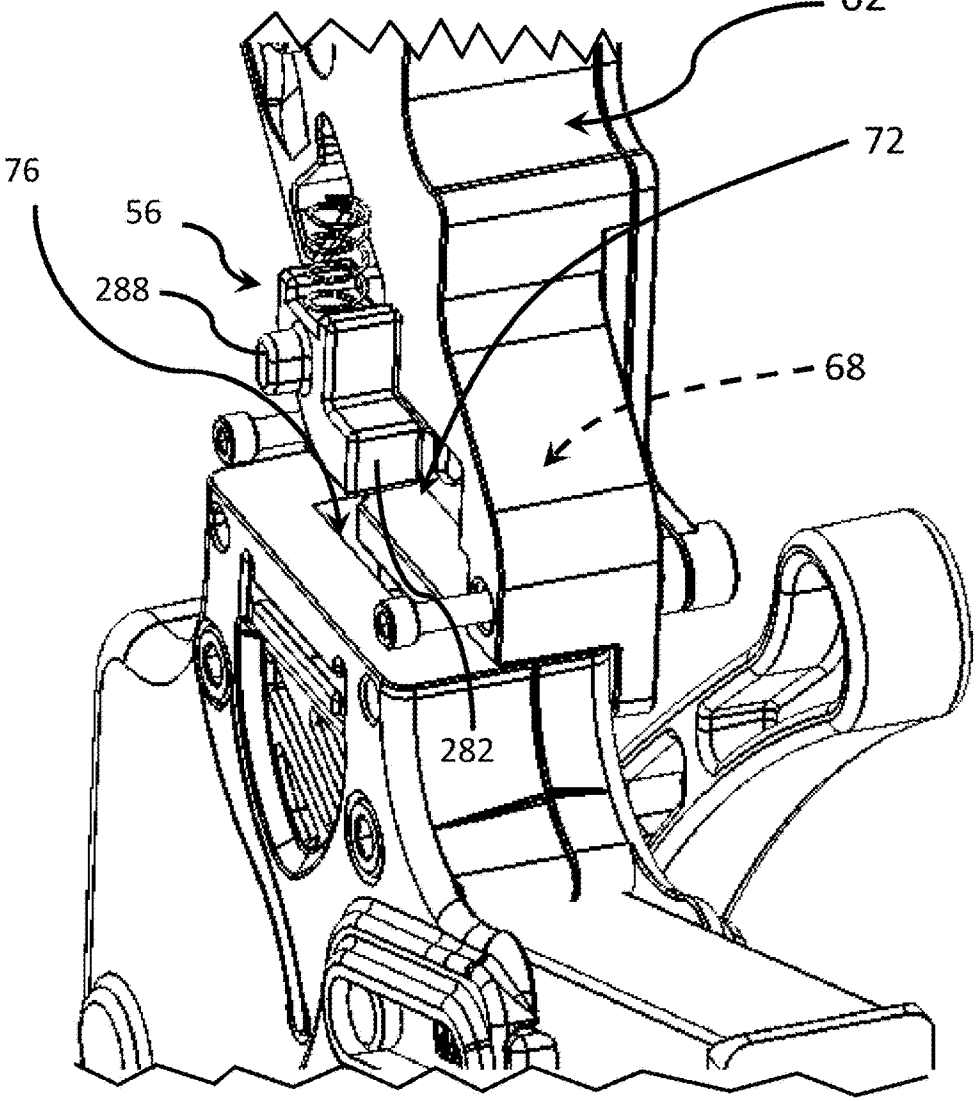
FIG. 35 is a fragmentary, isometric view of the firearm magazine loader of FIG. 1A.
Figure 40:
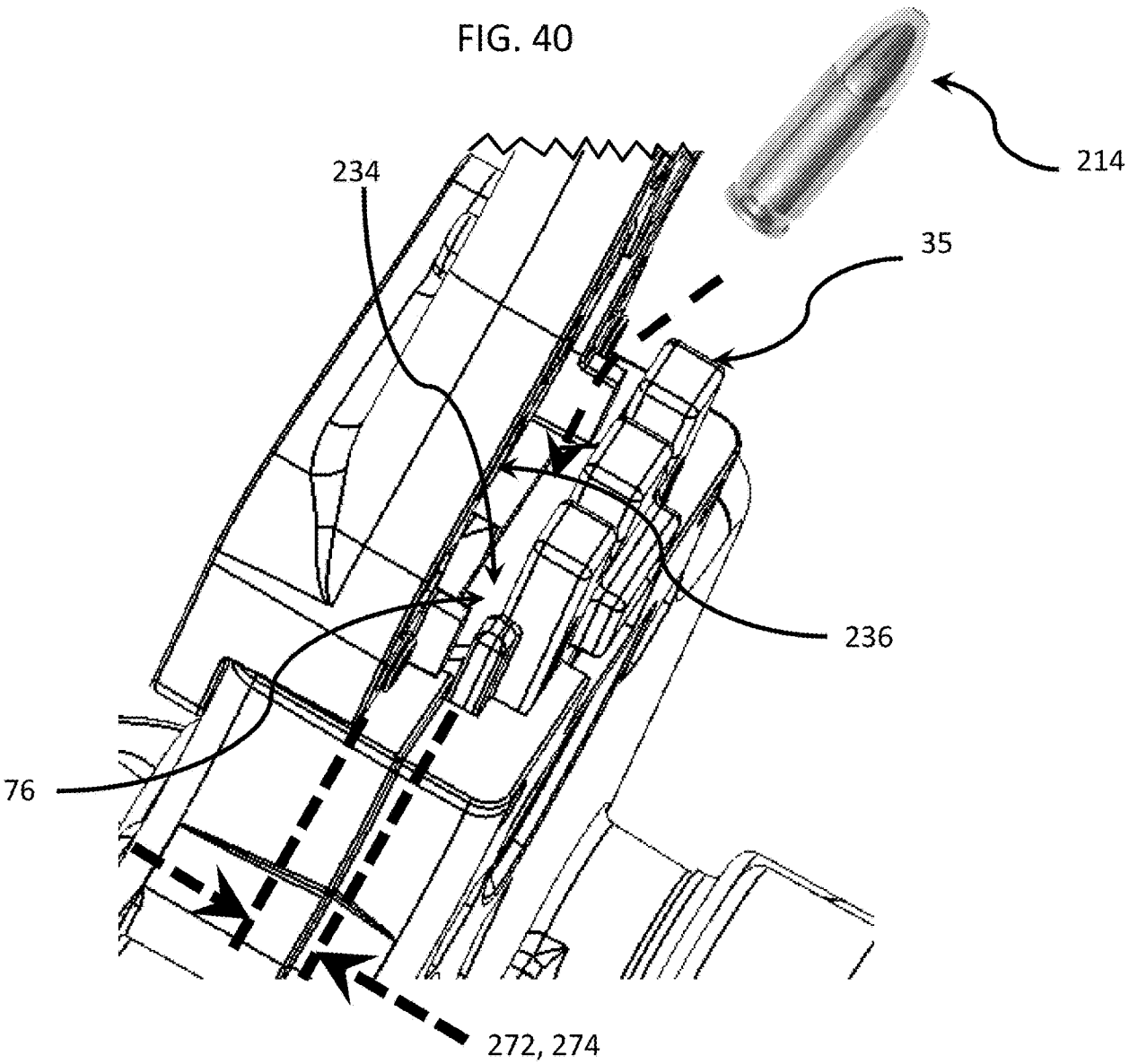
FIG. 40 is a top isometric view of the firearm magazine loader of FIG. 1A, illustrating a path of an ammunition cartridge unit toward a cartridge positioner.

Referring to FIGS. 35-43, the ammunition cartridge units 214 exit the primary passage 68 at the primary output 72. The cartridge positioner 35 is located at or below the primary output 72. As illustrated in FIGS. 41B-42B, in an embodiment, the cartridge positioner 35 includes: (a) a plurality of fingers 224, 226, 228 spaced apart by a plurality of gaps 230, 232; and (b) a ramp or downwardly sloped surface 234. When assembled, the intermediate guide surface 236 (FIGS. 33 and 40) of the intermediate body portion 62 and the positioner edge 238 of the sloped surface 234 define the secondary input 76, as illustrated in FIGS. 35 and 40.

Figure 36:
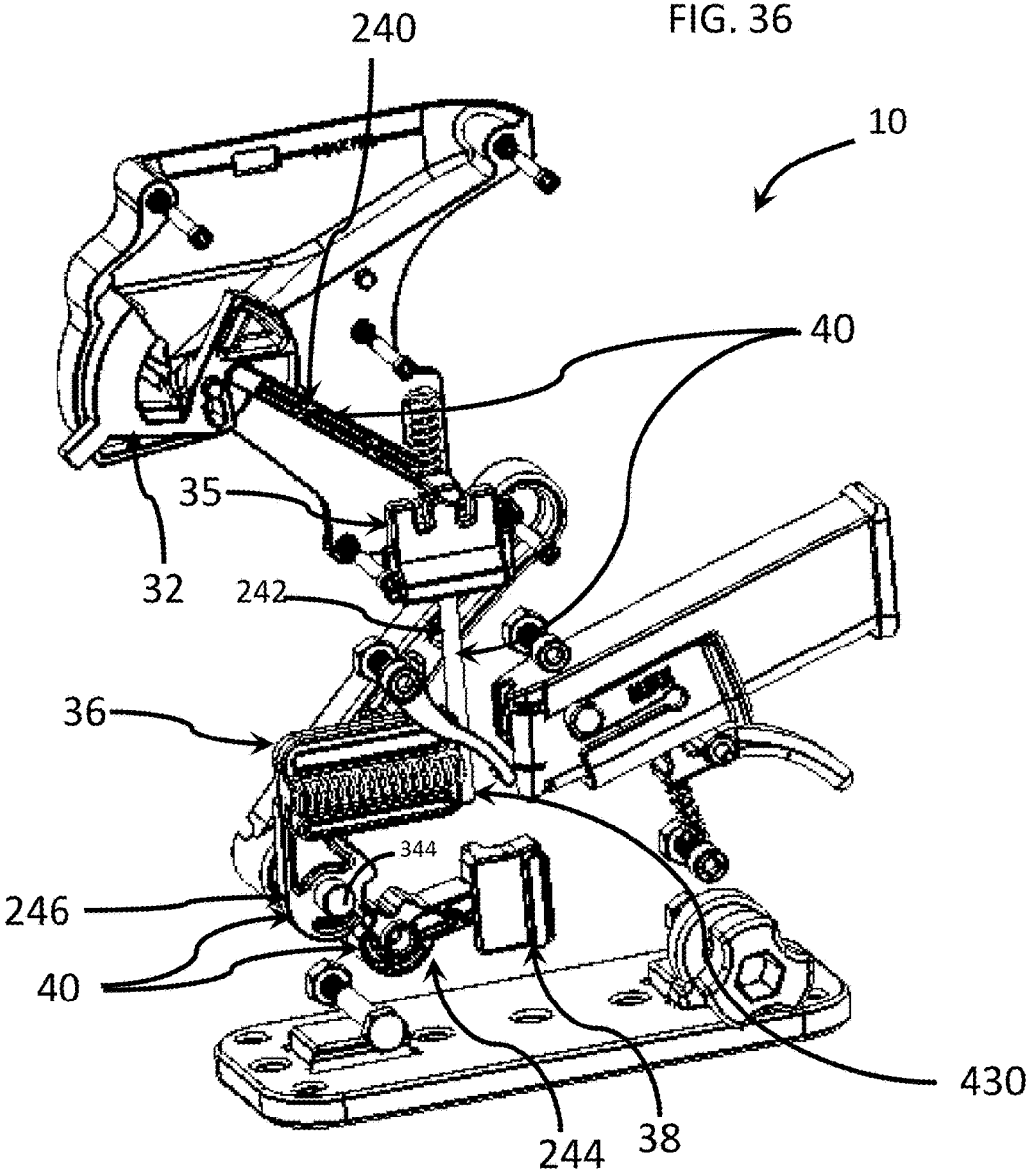
FIG. 36 is an isometric view of the firearm magazine loader of FIG. 1A, illustrating the interior elements exposed by the removal of a panel and intermediate portion.
Figure 37:
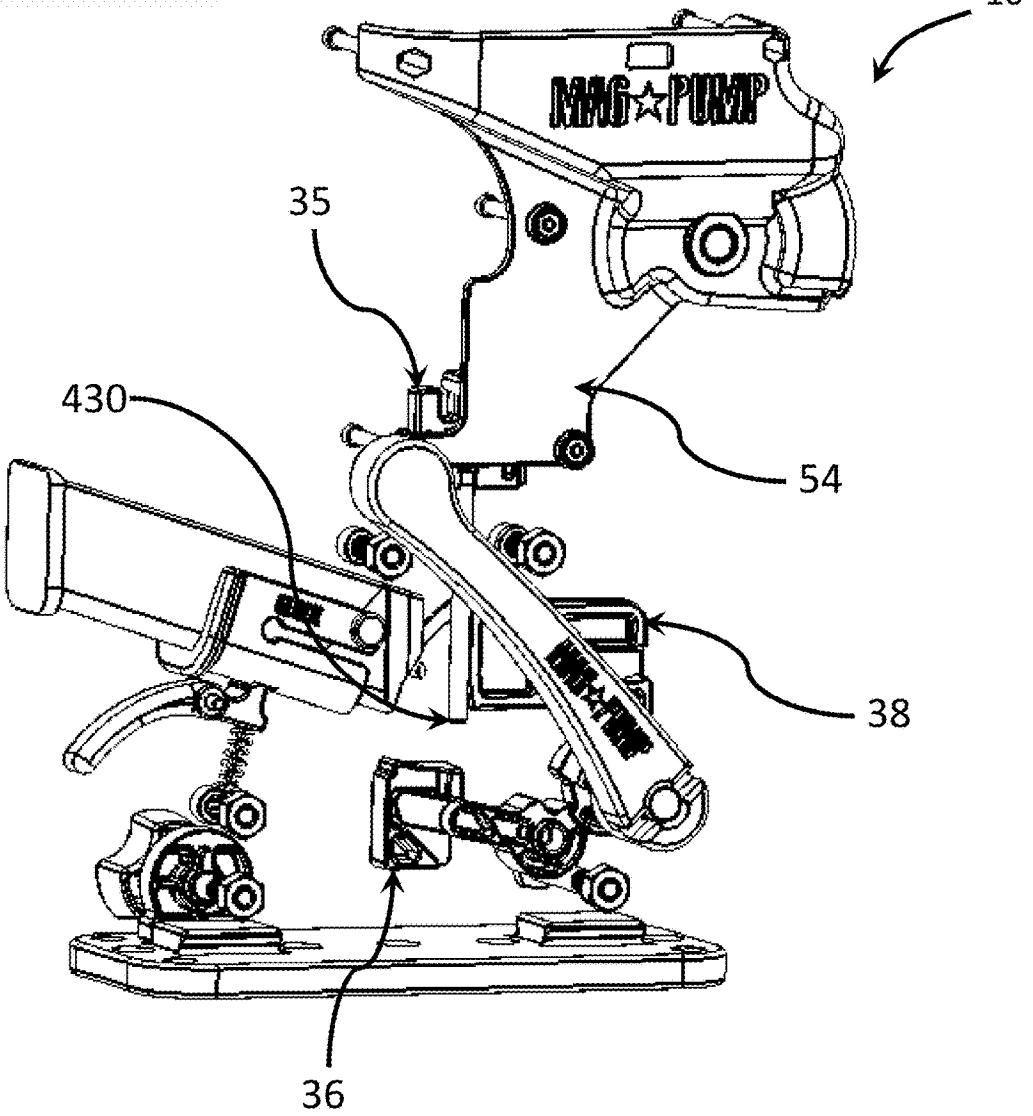
FIG. 37 is an isometric view of the firearm magazine loader of FIG. 1A, illustrating an upper panel and elements exposed by the removal of the opposite panel and intermediate portion.

In the embodiment shown in FIG. 36, the drive assembly 40 of the firearm magazine loader 10 includes an agitation driver 240 engaged with the agitator 34, the cartridge positioner 35, a lifting rod or lifter 242 coupled to the cartridge positioner 35, a primary arm or primary link 244, a secondary arm or secondary link 246, and a drive shaft 344, each of which is described below.

Figure 47:
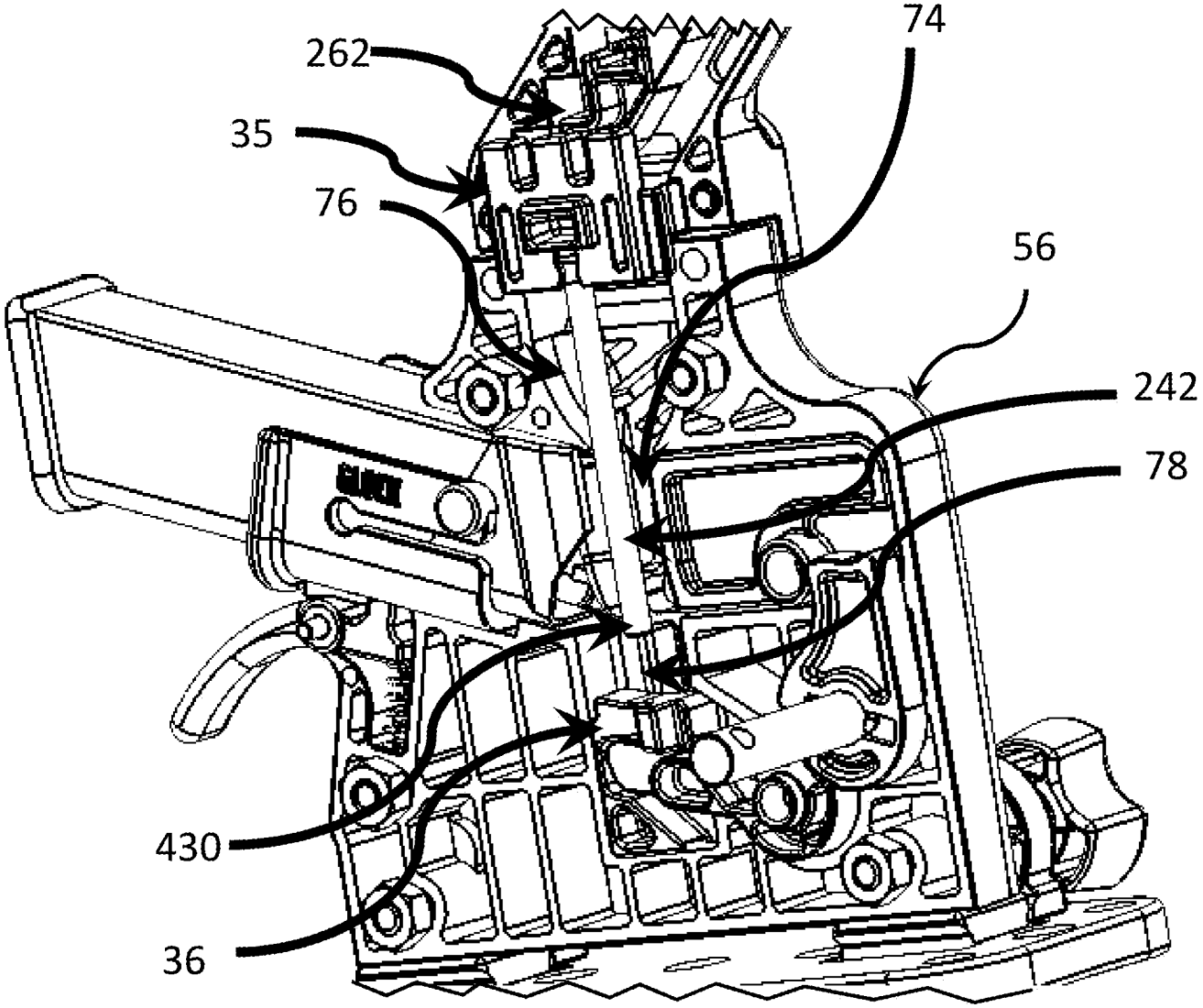
FIG. 47 is an enlarged, fragmentary, isometric view of the body of the firearm magazine loader of FIG. 1A, illustrating the lifter.
Figure 48:
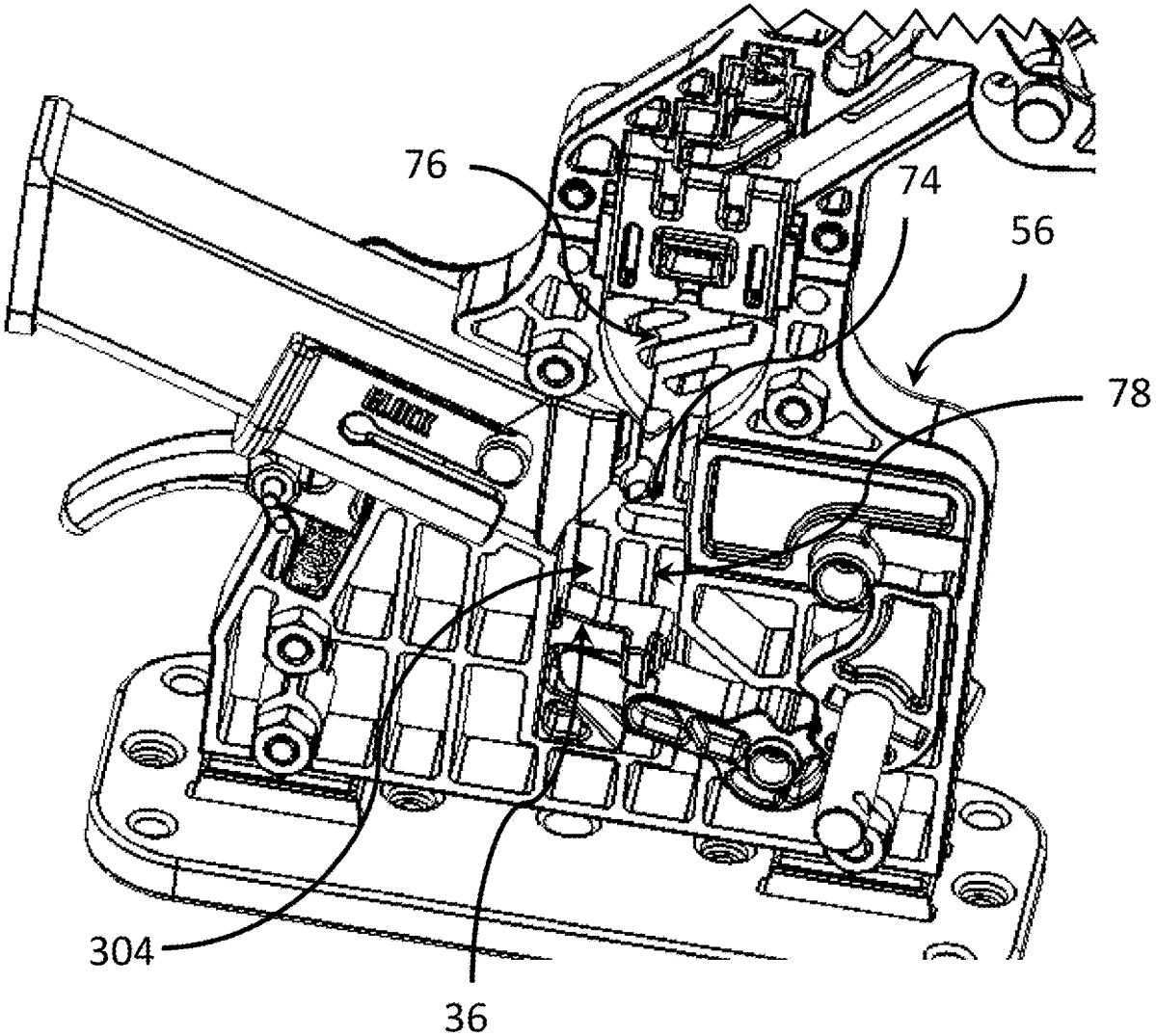
FIG. 48 is an enlarged, fragmentary, isometric view of the body of the firearm magazine loader of FIG. 1A, illustrating the primary driver.
Figure 49:
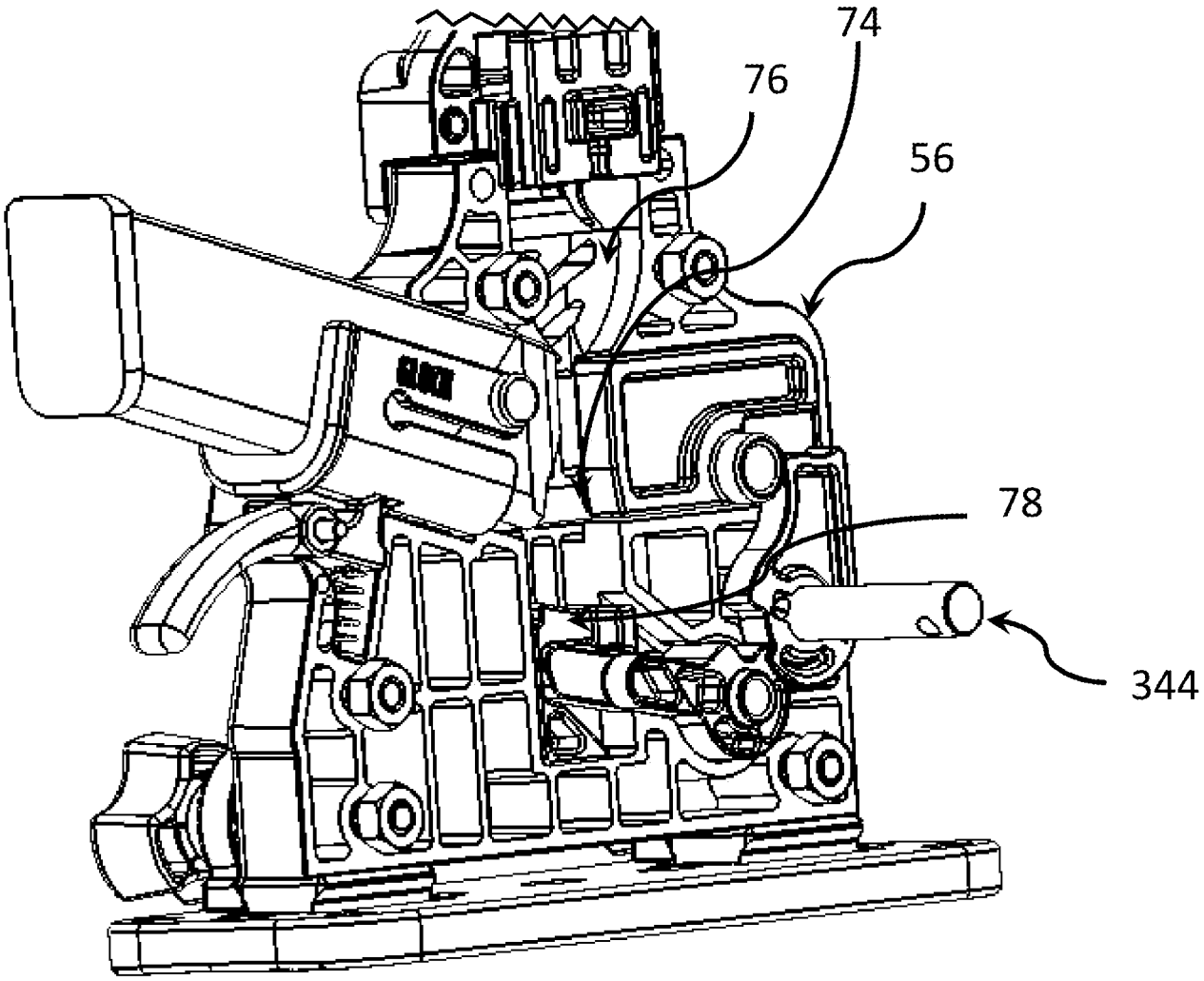
FIG. 49 is an enlarged, fragmentary, isometric view of the body of the firearm magazine loader of FIG. 1A, illustrating the drive shaft.
Figure 50B:
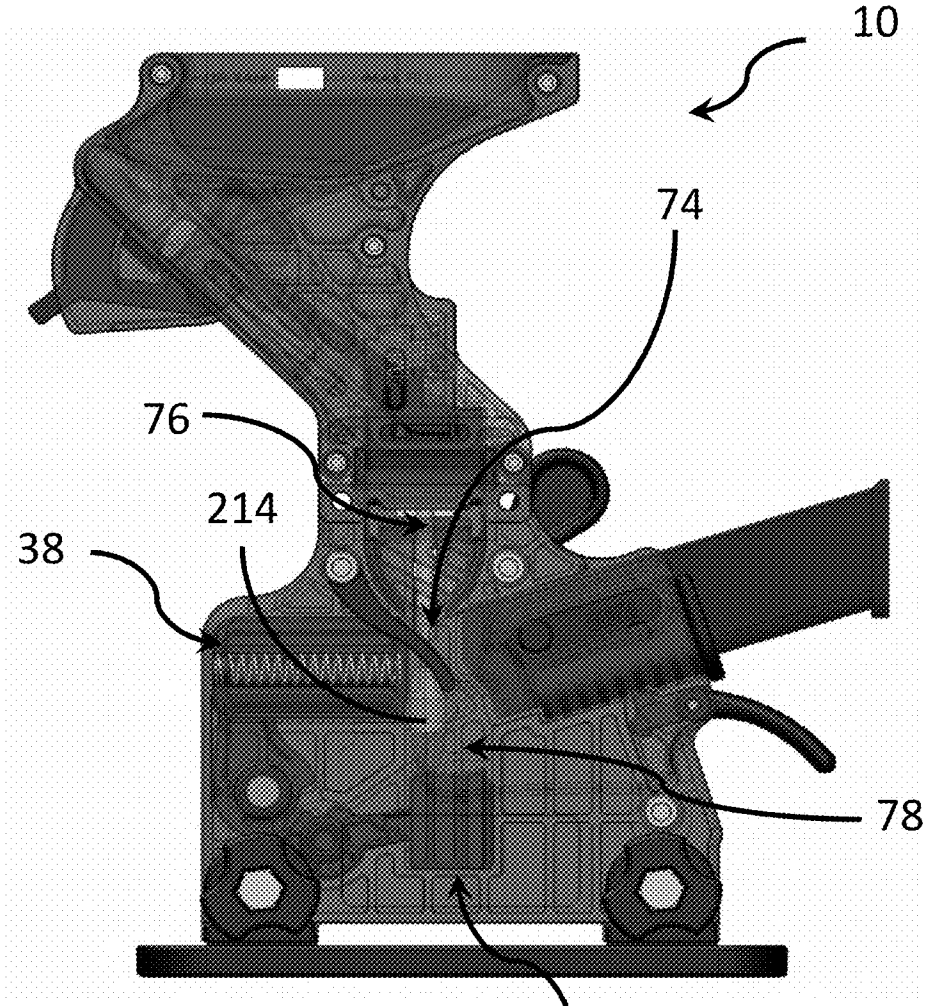
FIG. 50B is a side view of the body of the firearm magazine loader of FIG. 1A, illustrating an ammunition cartridge unit making contact with the primary driver.
Figure 50A:
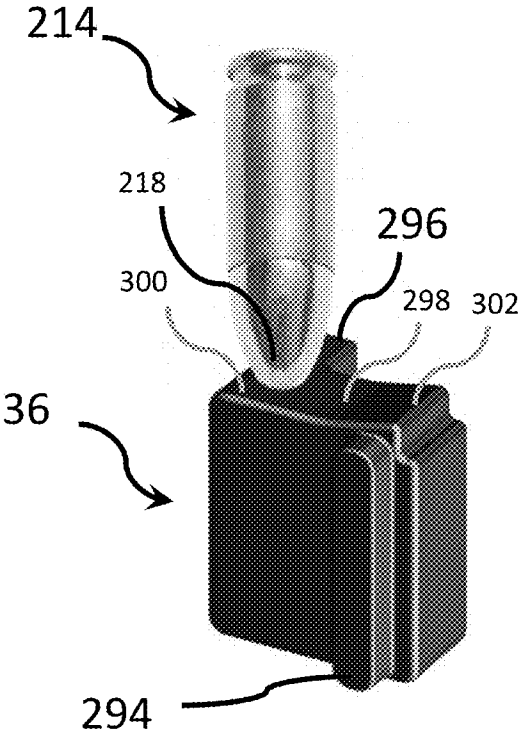
FIG. 50A is an isometric view of the primary driver of the firearm magazine loader of FIG. 1A.

Referring back to FIG. 33, the agitator 34 is pivotally coupled to the receptacle 30 through a pivot member 248. The agitator 34 has a C-shape that partially defines the receptacle opening 88. Also, the agitator 34 has a V-shaped portion 250 defining a recess configured to receive an upper end 254 of the agitation driver 240. The upper end 254 engages the V-shaped portion 250 at a point that is offset from the pivot member 248. The lower end 256 of the agitation driver 240 has an L-shape defining a branch 258. A biasing member 260 (e.g., compression spring), when positioned within a cavity 262 (FIG. 47), applies a downward biasing force to the branch 258. As a result of such biasing force, the agitation driver 240 is predisposed to be positioned in a downward position, enabling the agitator 34 to pivot clockwise 262 (FIG. 33) under gravity or the weight of the pile of ammunition cartridge units 214. When the branch 256 is moved upward, as described below, the agitator 34 pivots counterclockwise 264, as illustrated in FIG. 33. During the agitation action, the agitator 34 frequently pivots in alternating clockwise and counterclockwise directions 262 and 264, respectively. If the receptacle 30 is filled enough with ammunition cartridge units 214, such as filled to the maximum fill line 270, the agitator head 266 and the agitator foot 268 will disturb, mix and apply forces to the ammunition cartridge units 214. In an embodiment, the agitator 34 includes an agitator grasp 271. The agitator grasp 271 extends from the agitator head 266. If the ammunition cartridge units 214 become jammed or obstructed within the receptacle 30, the user can grasp and move the agitator grasp 271 upward and downward to clear the obstruction.

As a result of the agitation action, one or more of the ammunition cartridge units 214 falls through the receptacle opening 88, as described above. Eventually, the one or more ammunition cartridge units 214 reach a screening or staging gap 272, as illustrated in FIG. 40. In an embodiment, the staging gap 272 has a staging dimension 274 that is: (a) greater than the diameter 223 of any single one of the ammunition cartridge units 214; and (b) less than double the diameter 223. Consequently, the staging dimension 274 only enables the ammunition cartridge units 214 to sequentially travel to the sloped surface 234. In other words, the staging dimension 274 ensures that the ammunition cartridge units 214 travel, one by one, to the sloped surface 234.

Figure 41B:
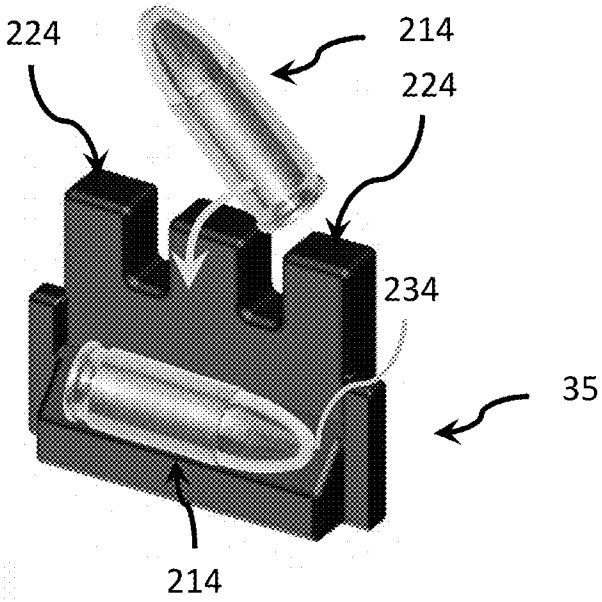
FIG. 41B is an isometric view of an embodiment of the firearm magazine loader of FIG. 1A, illustrating an ammunition cartridge unit moving from a non-horizontal position above the cartridge positioner to a horizontal position on the cartridge positioner.
Figure 41A:
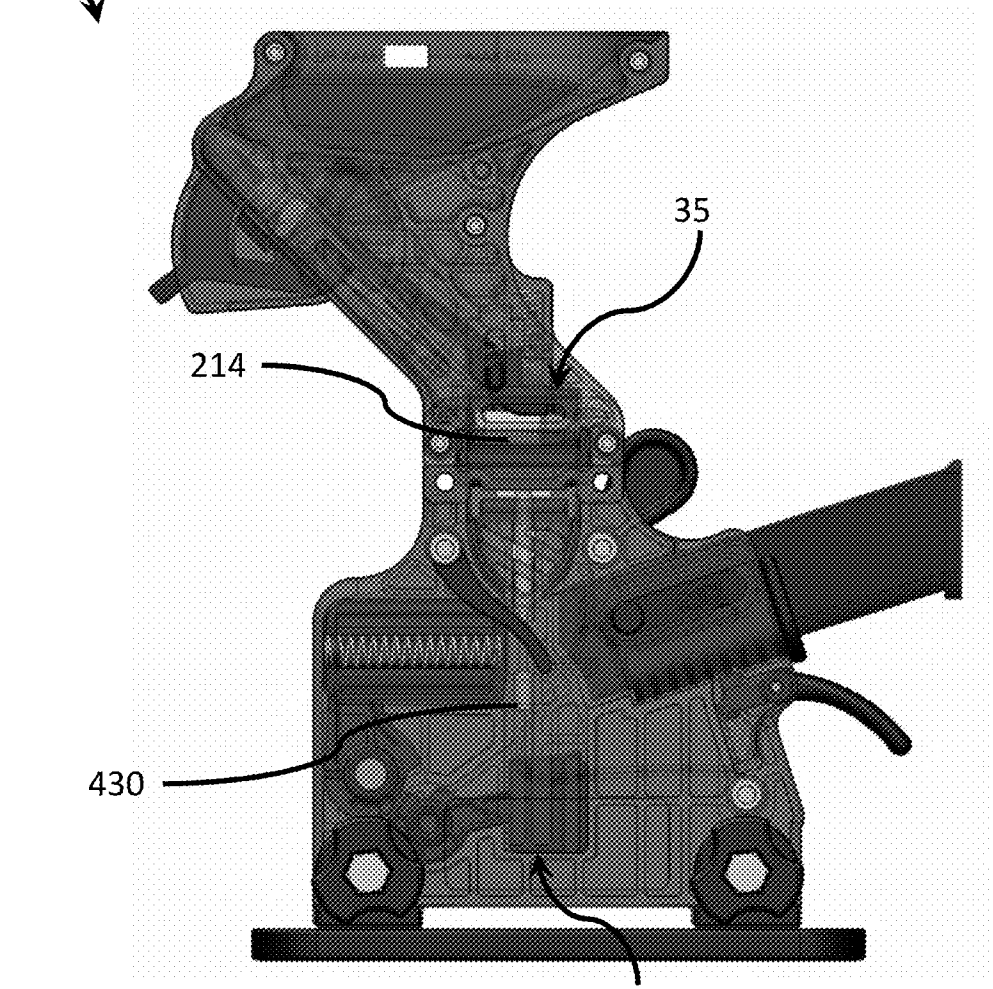
FIG. 41A is a side view of an embodiment of the firearm magazine loader of FIG. 1A, illustrating the cartridge positioner holding an ammunition cartridge unit in a horizontal position.
Figure 42B:
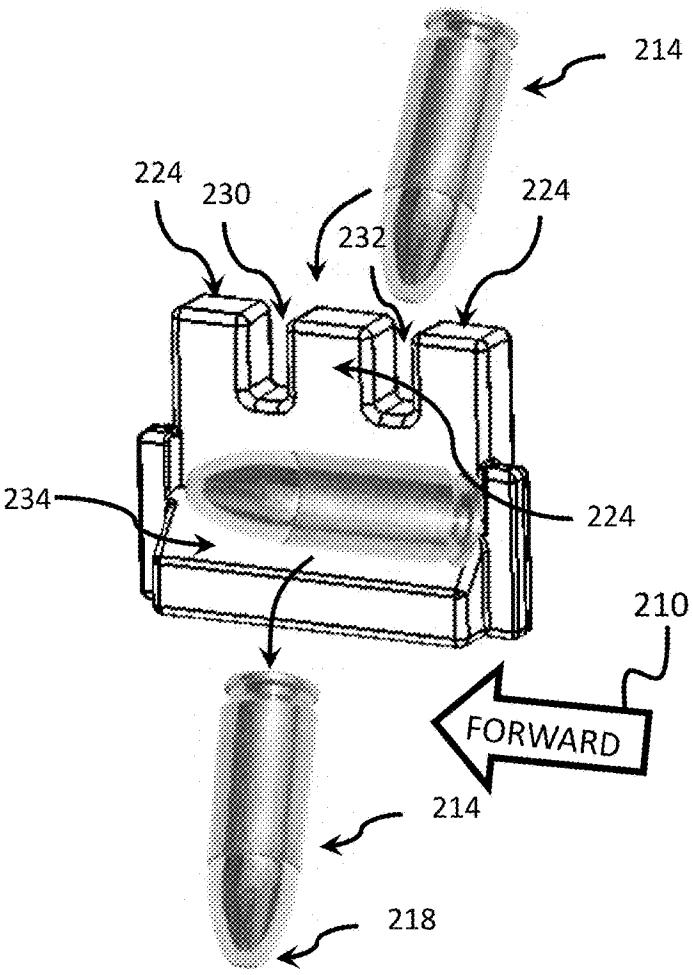
FIG. 42B is an isometric view of an embodiment of the firearm magazine loader of FIG. 1A, illustrating an ammunition cartridge unit moving from a non-horizontal position above the cartridge positioner to a forward-pointing, horizontal position on the cartridge positioner.
Figure 42A:
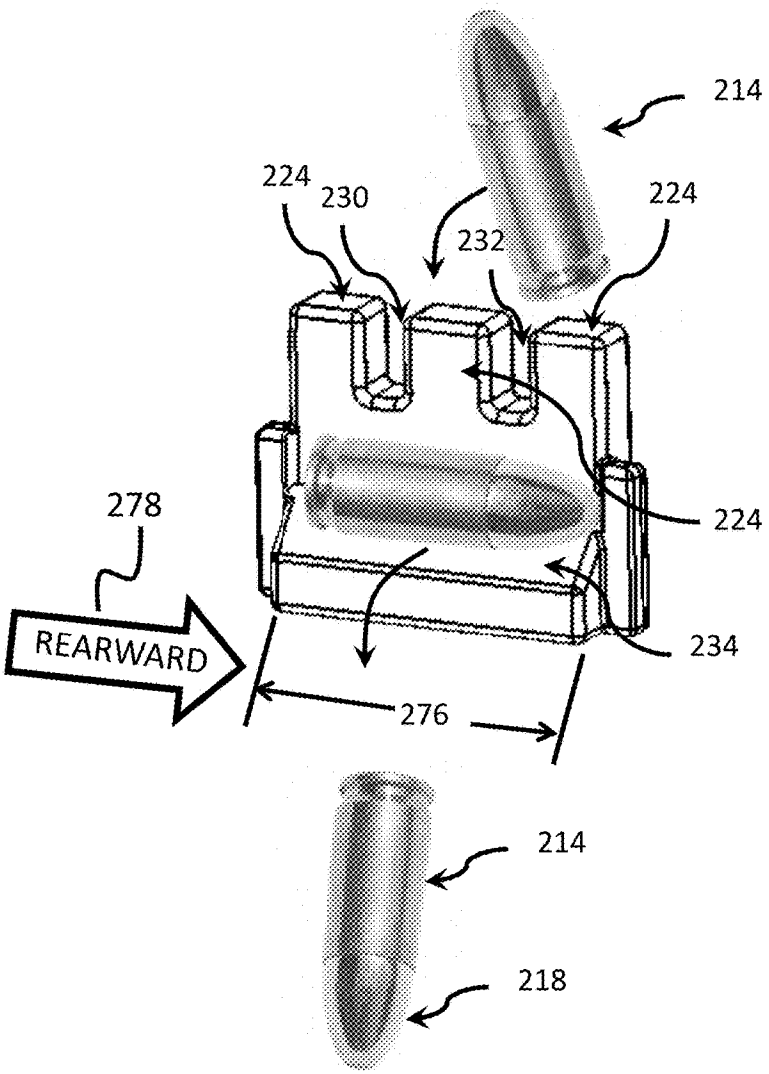
FIG. 42A is an isometric view of an embodiment of the firearm magazine loader of FIG. 1A, illustrating an ammunition cartridge unit moving from a non-horizontal position above the cartridge positioner to a rearward-pointing, horizontal position on the cartridge positioner.

As illustrated in FIGS. 41A and 41B, when one of the ammunition cartridge units 214 reaches the sloped surface 234, the ammunition cartridge unit 234 is positioned, momentarily, in a horizontal position on the sloped surface 234. As illustrated in FIGS. 42A and 42B, the sloped surface 234 has a surface length 276 that is: (a) greater than the length dimension 220 (FIG. 32) of the ammunition cartridge unit 234; and (b) less than double the length dimension 220. The ammunition cartridge unit 234 can reach the cartridge positioner 35 with the bullet end 218 above the rim end 216 (FIG. 42A) or with the rim end 216 above the bullet end 218 (FIG. 42B). Depending upon the angle of entry, the ammunition cartridge unit 234 will land, momentarily, with the bullet end 218 facing in the rearward direction 278 (FIG. 42A) or with the bullet end 218 facing in the forward direction 210 (FIG. 42B). From there, the ammunition cartridge unit 234 will roll and pivot, under its own weight, so that the ammunition cartridge unit 234 slides off of the sloped surface 234 with the bullet end 218 positioned below the rim end 216, as shown in FIGS. 42A and 42B. This is because the bullet end 218 weighs more than the rim end 216. This ensures that all of the ammunition cartridge units 234 sequentially slide downward, leaving the cartridge positioner 35 with their bullet ends 218 oriented downward.

Figure 43:
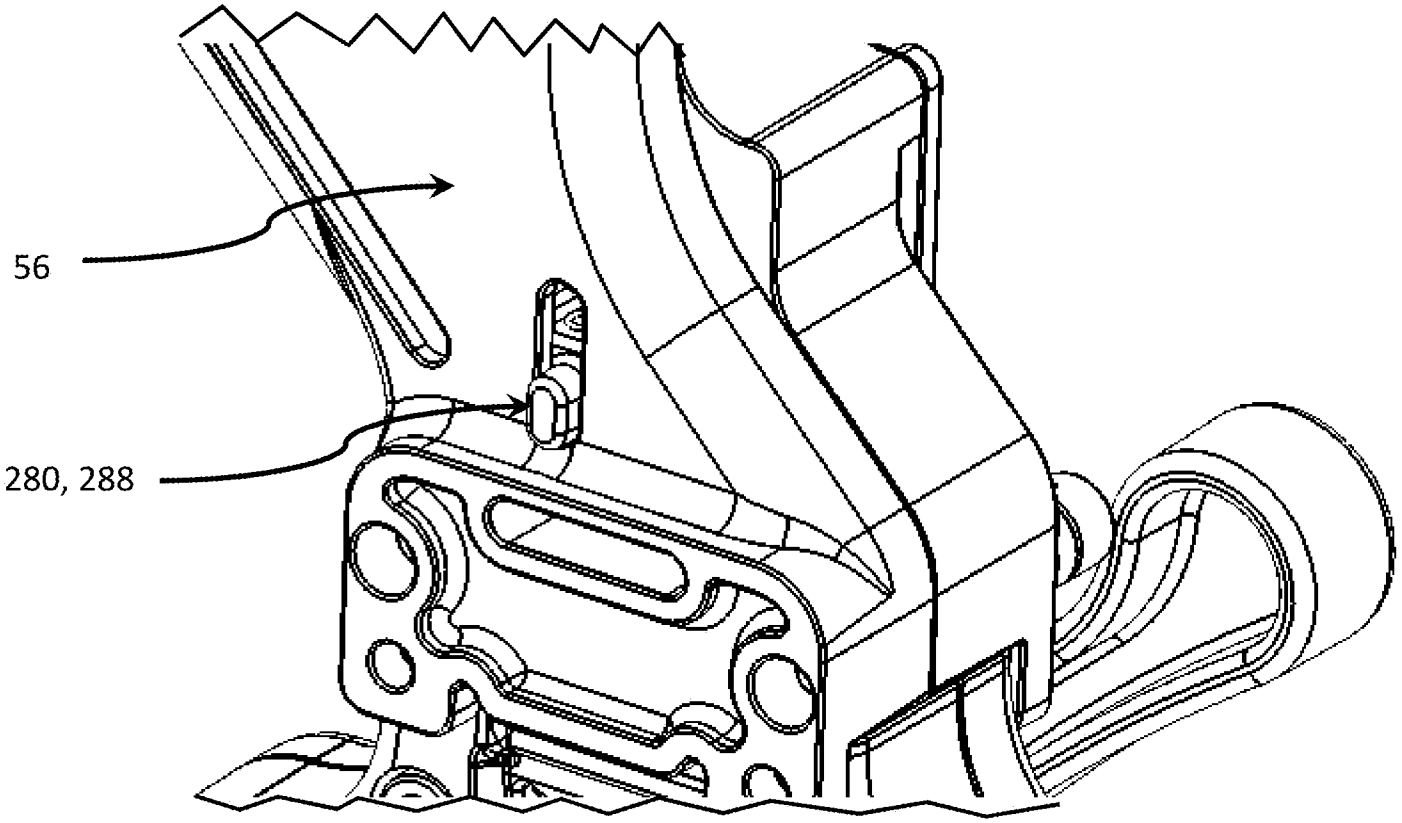
FIG. 43 is an enlarged, fragmentary, isometric view of the body of the firearm magazine loader of FIG. 1A.

In an embodiment illustrated in FIGS. 33, 35 and 43, the firearm magazine loader 10 includes a unjamming device 280. The unjamming device 280 includes: (a) an L-shaped disturber 282 slideably coupled to the lower panel 54; and (b) a biasing member 286 (e.g., compression spring) coupled to the lower panel 54 that applies a downward biasing force to the disturber 282. The coupler 284 has a head or grasp 288. If the ammunition cartridge units 234 become jammed or obstructed within the primary passage 68, the user can move the grasp 288 upward and downward to disturb and reposition the ammunition cartridge units 234 to clear the jam.

Figure 44:
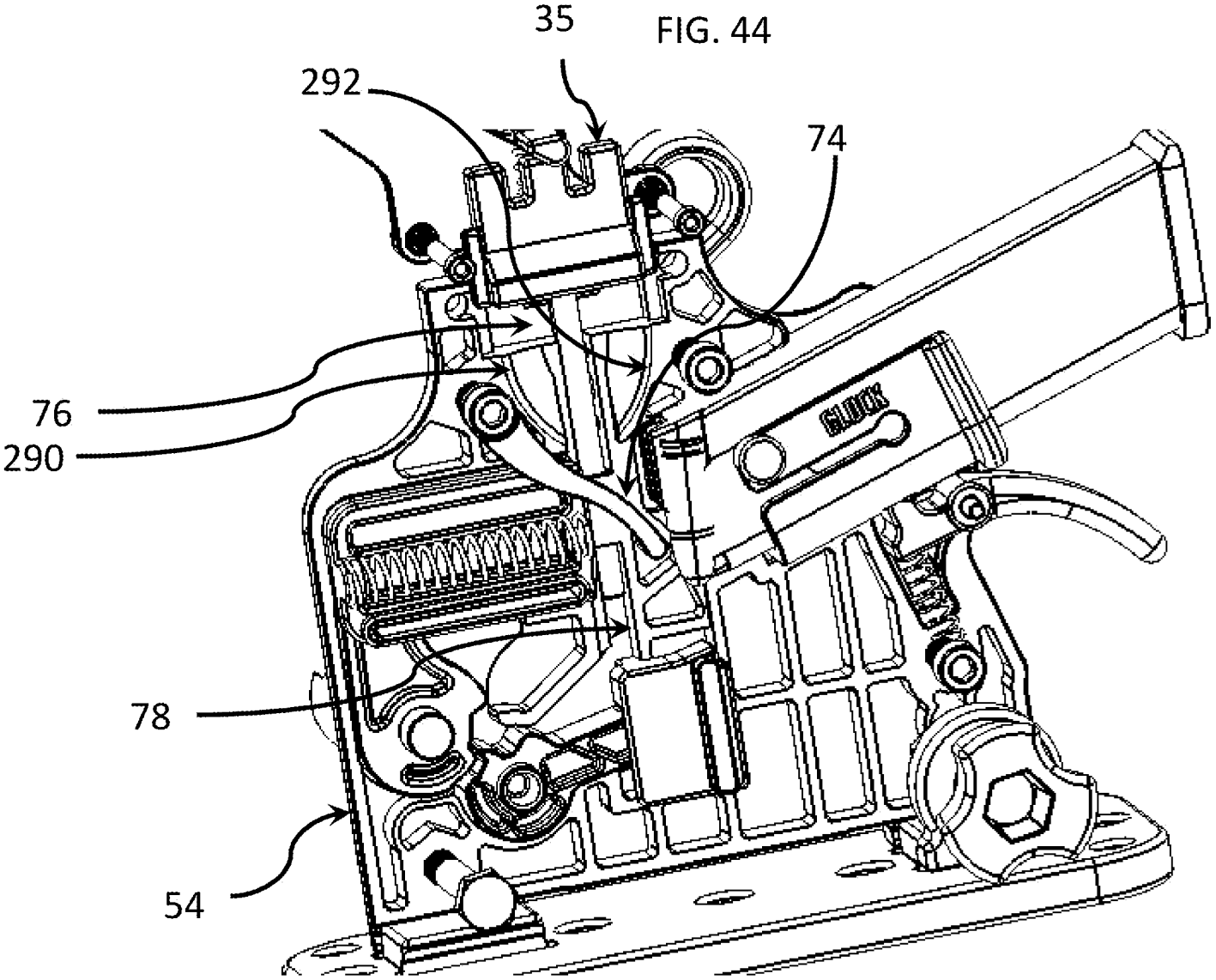
FIG. 44 is an enlarged, fragmentary, isometric view of the body of the firearm magazine loader of FIG. 1A, illustrating the secondary output.
Figure 45:
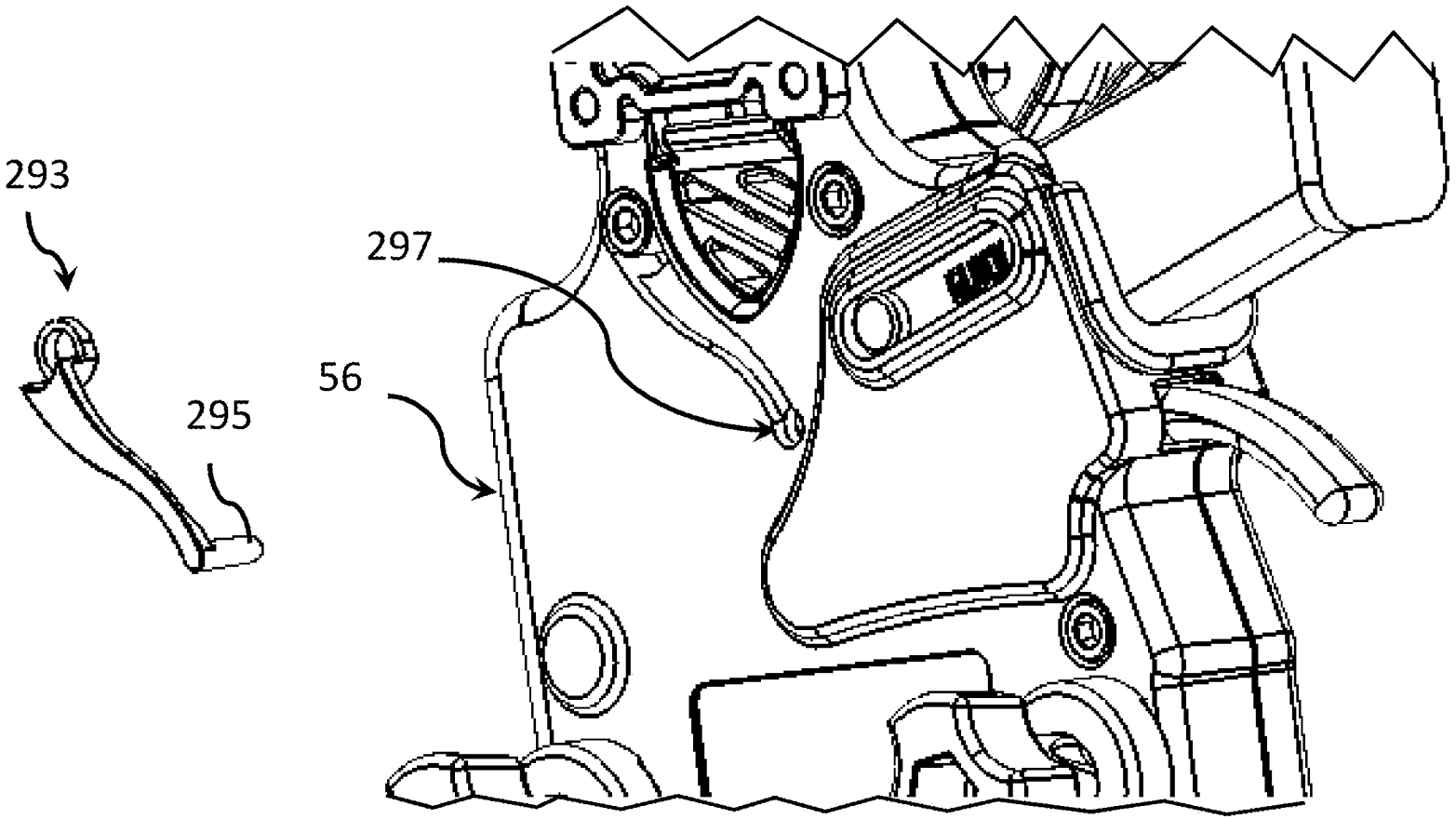
FIG. 45 is an enlarged, fragmentary, isometric view of the body of the firearm magazine loader of FIG. 1A.
Figure 46:
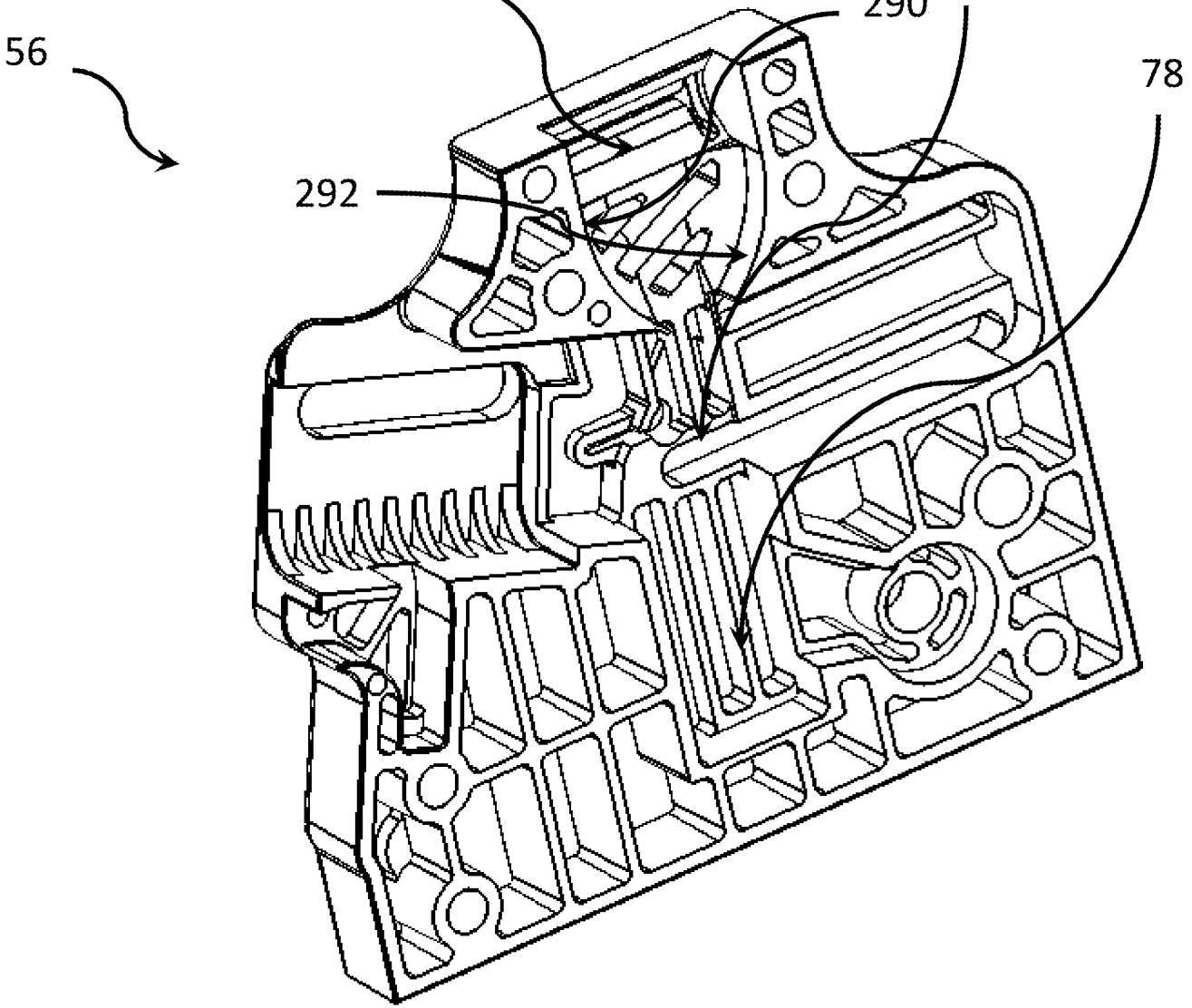
FIG. 46 is an enlarged, isometric view of a lower panel of the firearm magazine loader of FIG. 1A.

As illustrated in FIGS. 44-49, when one of the ammunition cartridge units 234 leaves the cartridge positioner 35, the ammunition cartridge unit 234 enters the secondary input 76, which provides access to the secondary passage 74 which, in turn, leads to the secondary output 78. The secondary input 76, secondary passage 74 and secondary output 78 are defined by the union or assembly of the lower panels 54, 56. As shown in FIG. 46, the secondary input 76 has a funnel shape with a decreasing width. The tapered side surfaces 290 (FIG. 44) and 292 (FIG. 46) collectively direct the ammunition cartridge unit 234 to achieve a substantially vertical position while dropping downward until entering the secondary passage 74. Due to gravity, the ammunition cartridge unit 234 then falls downward through the secondary passage 74.

In the embodiment shown in FIGS. 44-45, the firearm magazine loader 10 has a director 293. The end or finger 295 of the director 293 is inserted through a slot 297 within the lower panel 56. If the ammunition cartridge unit 234 is not positioned vertically while dropping, the finger 295 of the director 293 engages the ammunition cartridge unit 234 to orient the ammunition cartridge unit 234 to have a vertical or substantially vertical position. Eventually, the ammunition cartridge unit 234 reaches the secondary output 78 (FIG. 46) and contacts the primary driver 36.

Figure 56:
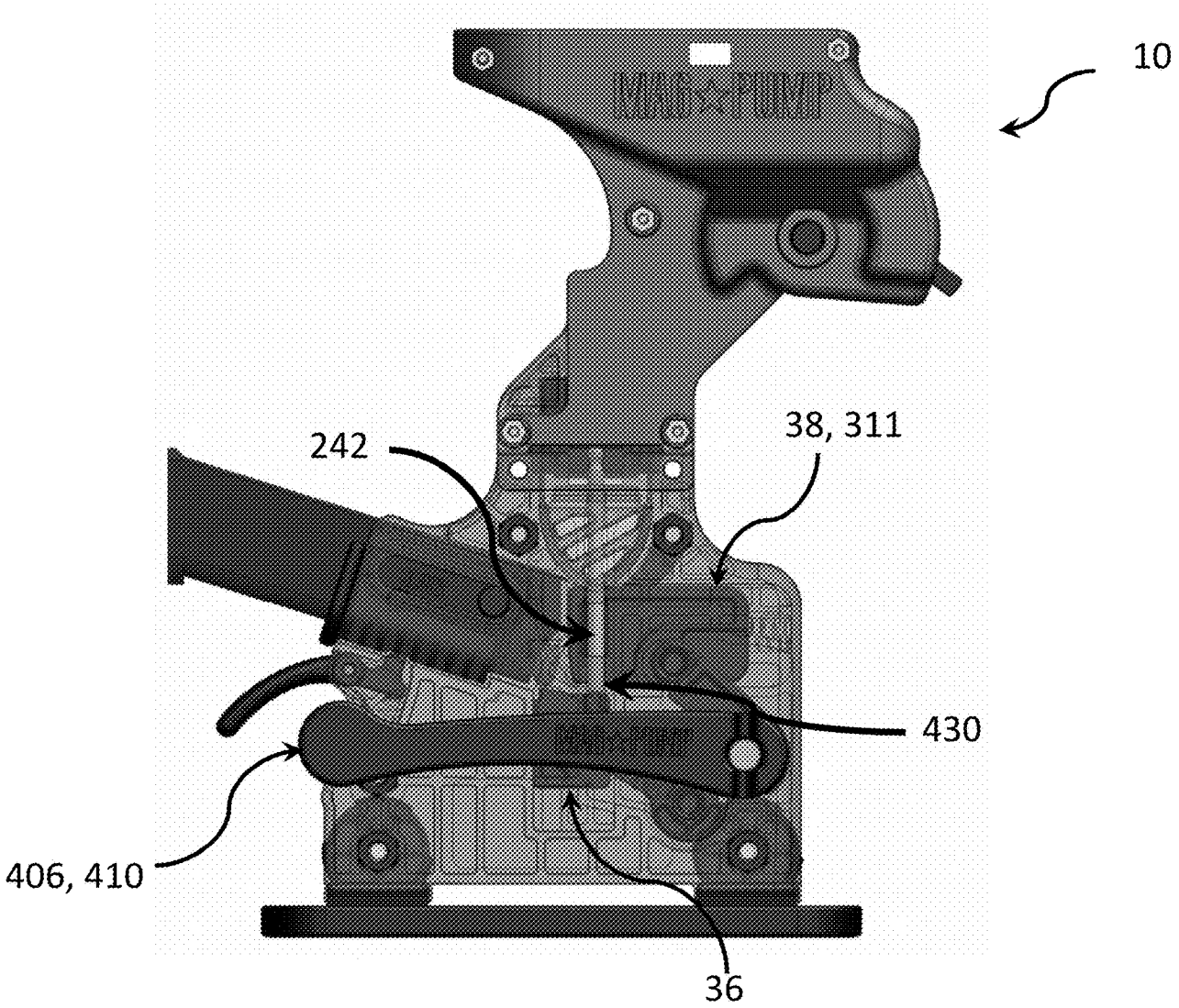
FIG. 56 is a side view of the firearm magazine loader of FIG. 1A, illustrating the primary driver applying having partially inserted an ammunition cartridge unit into a firearm magazine.

As illustrated in FIGS. 50A-53, the primary driver 36 includes: (a) a plurality of vertical guides 294, 296; and (b) a cartridge engagement surface 298 configured to abut and make physical contact with the bullet end 218 of the ammunition cartridge unit 234. The cartridge engagement surface 298 has a landing portion 300 and a ramp portion 302. As described below, the ramp portion 302 is configured to gradually increase the upward travel of the ammunition cartridge unit 234 as the bullet end 218 is laterally slid from the landing portion 300 to the ramp portion 302. The vertical guides 294, 296 are configured to fit into, and mate with, a plurality of vertical slots (e.g., vertical slot 304 shown in FIG. 48) defined by the lower panels 54, 56. Accordingly, the primary driver 36 is configured to slide upward and downward within the body 22 between a ready position 299 (FIG. 47) and a loading position 311 (FIG. 56).

Figure 51:
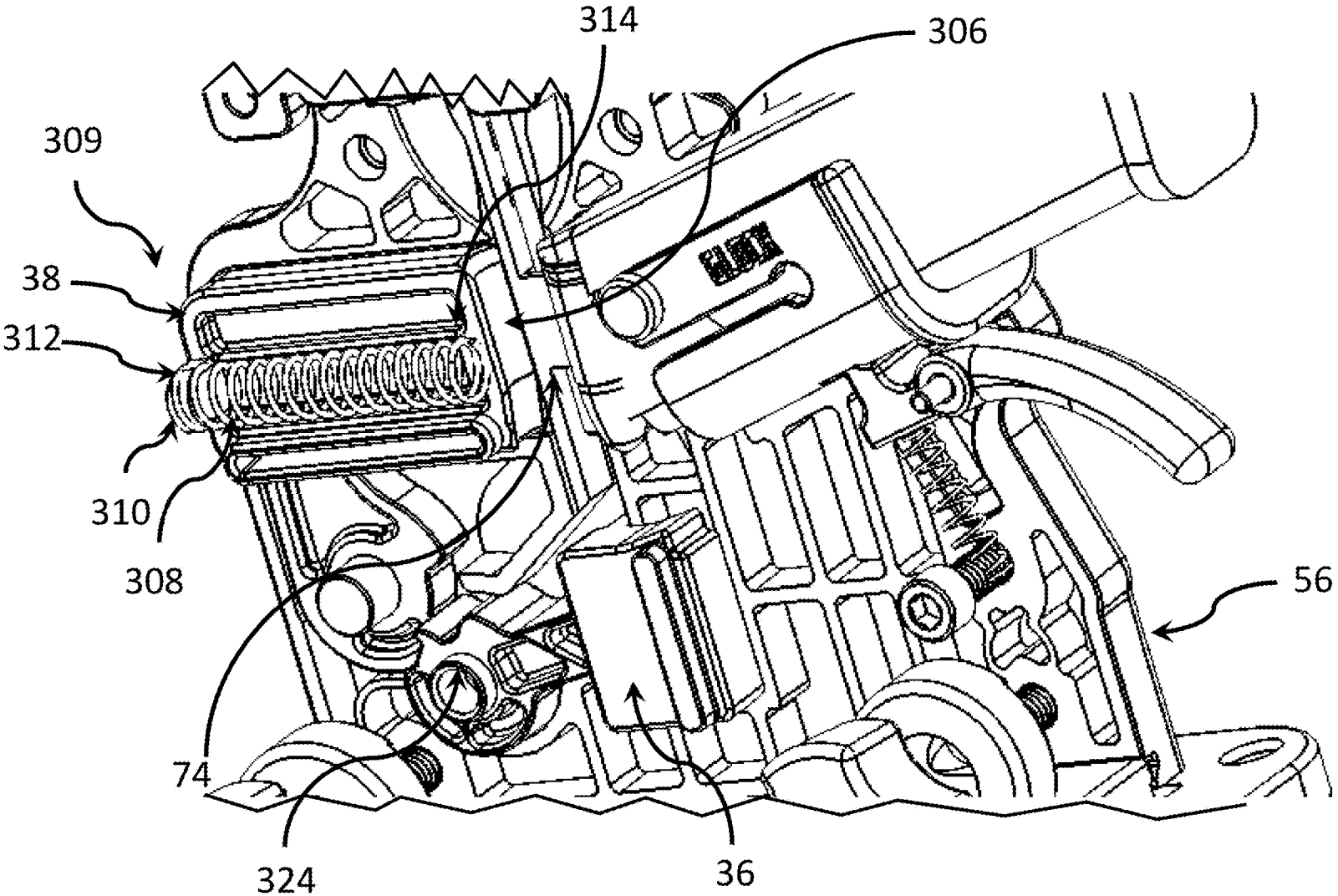
FIG. 51 is an isometric view of the firearm magazine loader of FIG. 1A, illustrating the secondary driver.

With continued reference to FIGS. 50A-53, the secondary driver 38 has an elongated box shape including a cartridge engagement surface 306, a holder 310, and a biasing member 308 (e.g., compression spring) supported by the holder 310. A first end 312 of the biasing member 308 is coupled to the holder 310, and a second end 314 of the biasing member 308 is coupled to the lower panel 56 (FIG. 51). In operation, the biasing member 308 applies a biasing or spring force to the secondary driver 38. This spring force urges the secondary driver 38 toward a ready position 309 wherein the secondary driver 38 is cleared outside of the secondary passage 74, enabling an ammunition cartridge unit 234 to fall through the secondary passage 74. The cartridge engagement surface 306 has a concave shape to correspond to the tubular shape of the ammunition cartridge unit 234.

Figure 52:
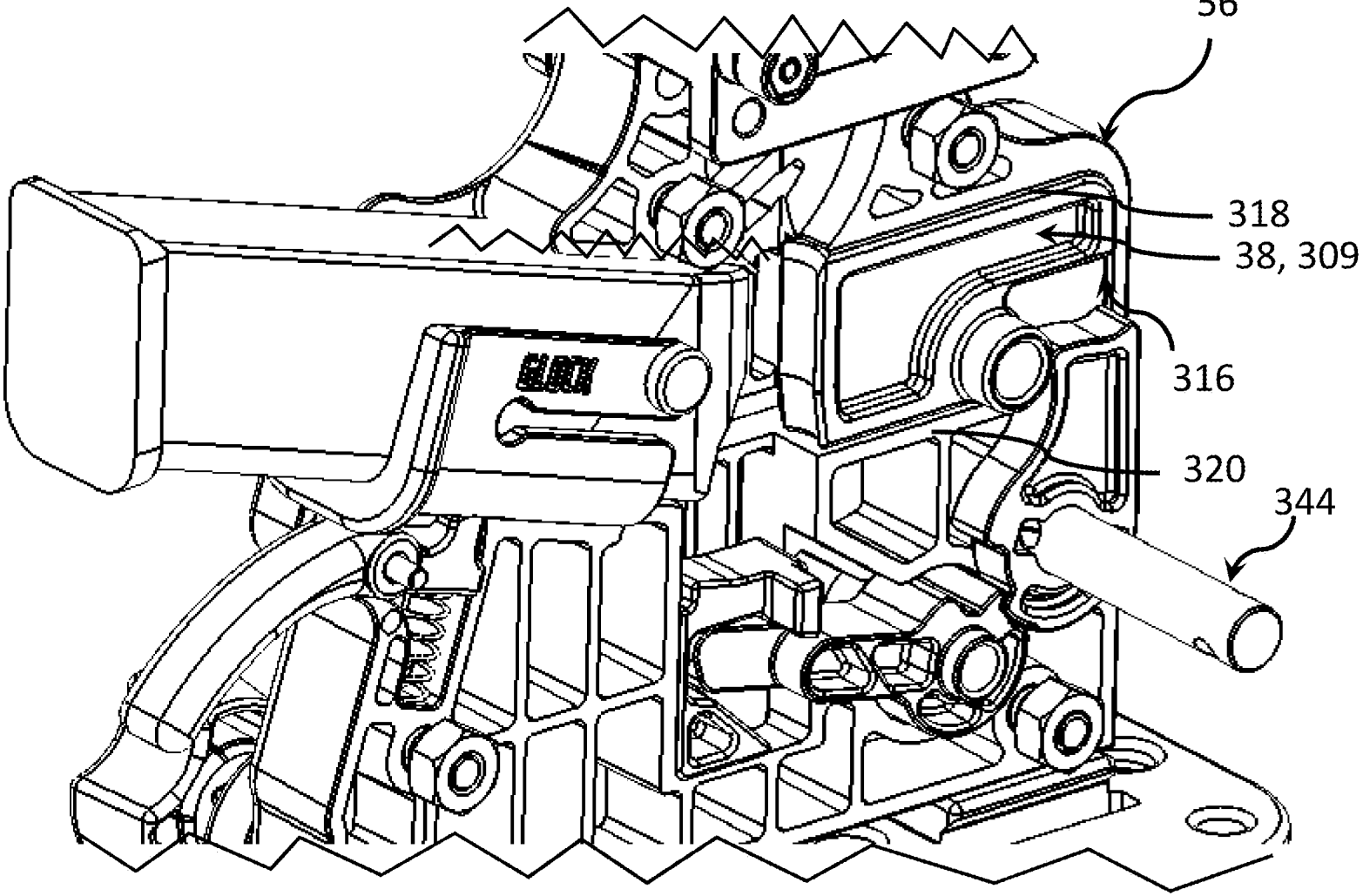
FIG. 52 is an isometric view of the firearm magazine loader of FIG. 1A, illustrating a plurality of horizontal guide surfaces.

As shown in FIG. 52, the lower panel 56 defines a horizontal cavity or horizontal slot 316 configured to receive the secondary driver 38. The slot has a plurality of horizontal guide surfaces 318, 320 configured to slideably engage the secondary driver 38. Accordingly, the secondary driver 36 is configured to slide laterally within the body 22 between the ready position 309 (FIG. 52) and a loading position 311 (FIG. 56).

Figure 53:
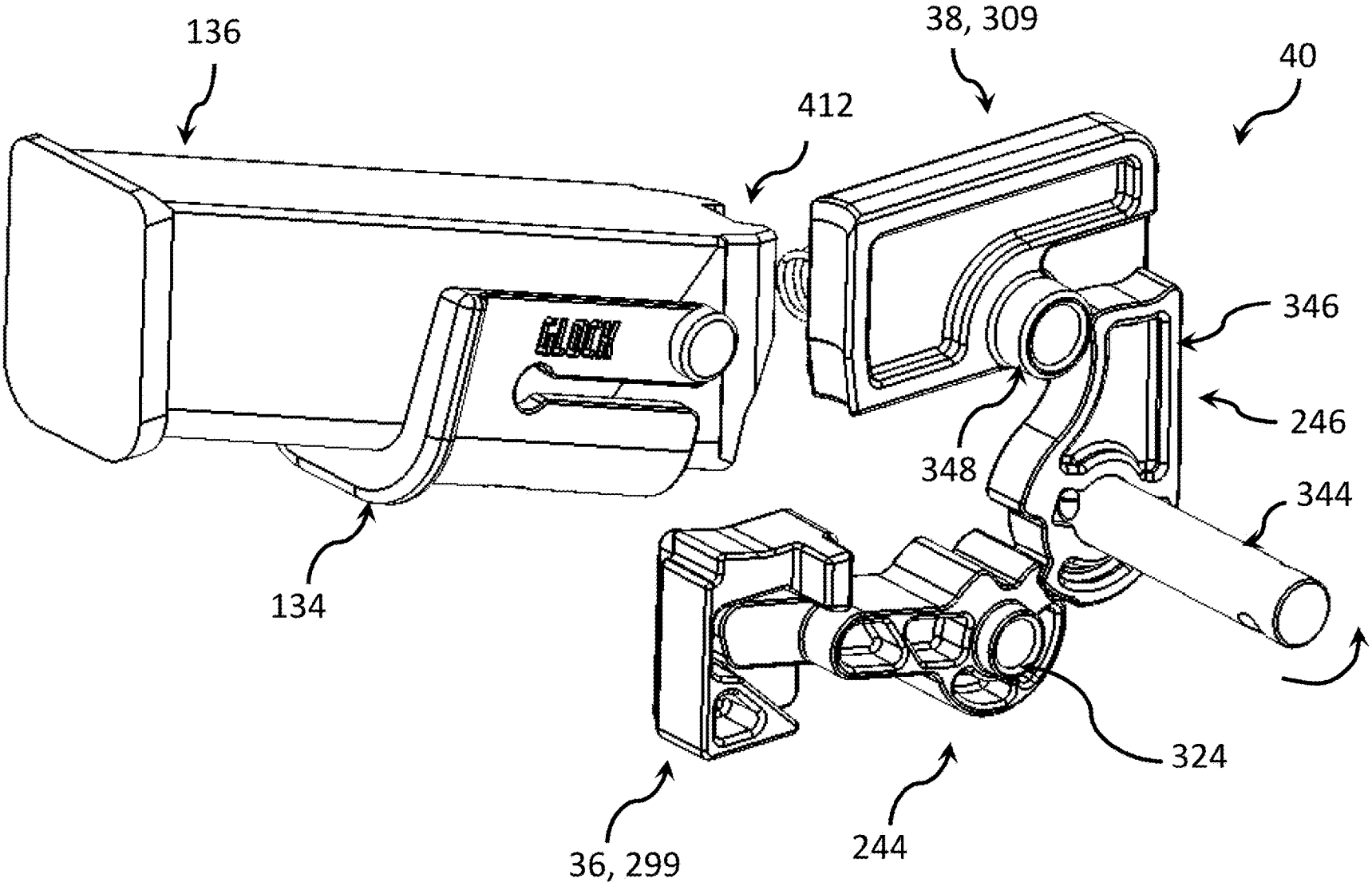
FIG. 53 is an isometric view of the firearm magazine loader of FIG. 1A, illustrating the drive assembly.
Figure 54:
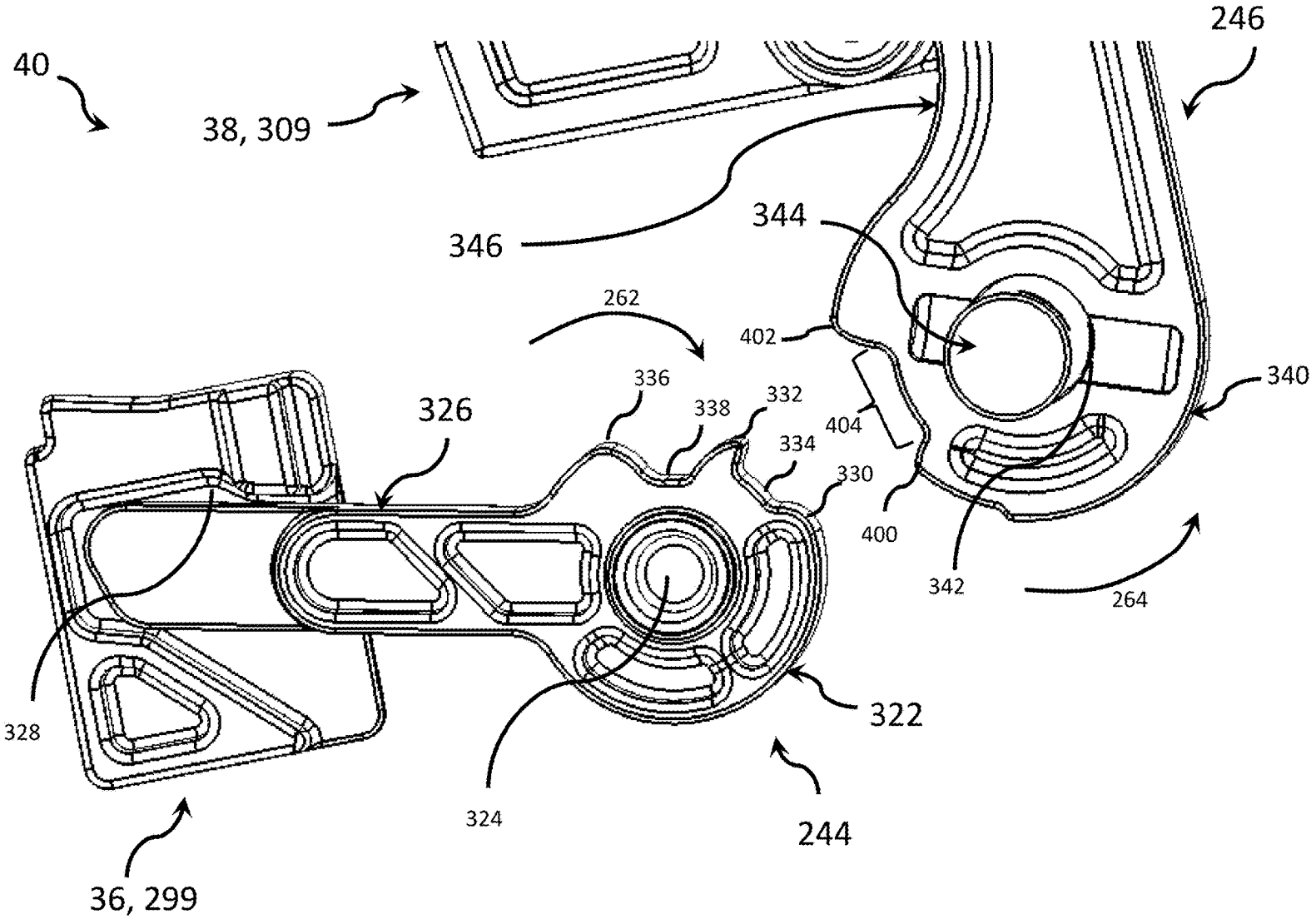
FIG. 54 is an enlarged, isometric view of the firearm magazine loader of FIG. 1A, illustrating the drive assembly.
Figure 55B:
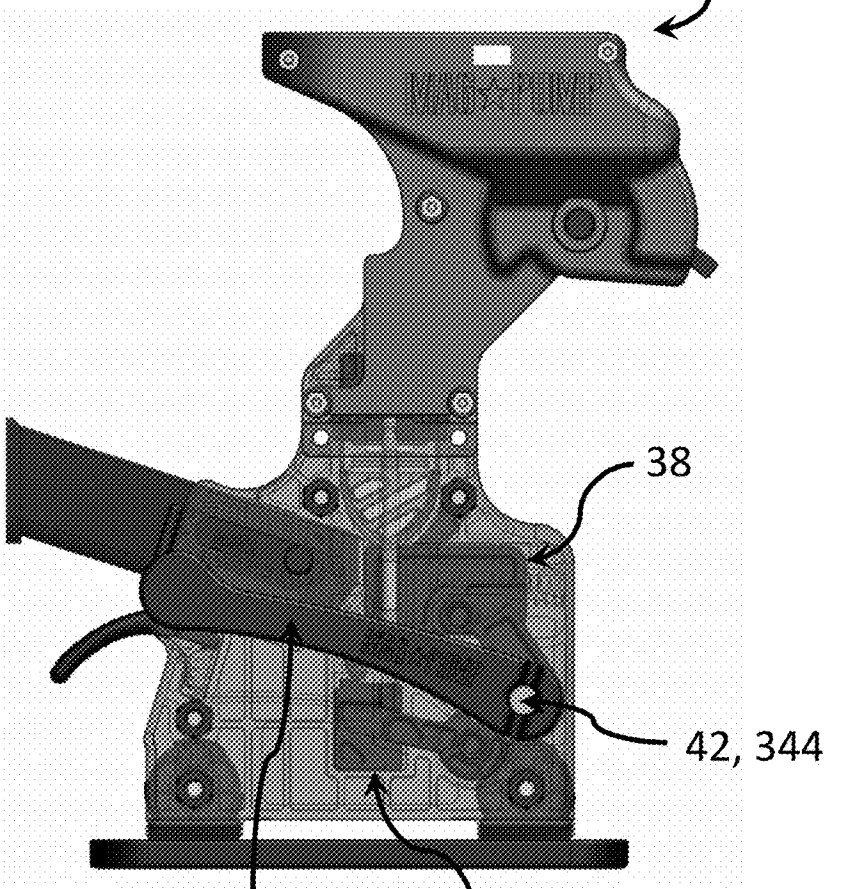
FIG. 55B is a side view of the firearm magazine loader of FIG. 1A, illustrating the primary driver applying an upward force to the head of an ammunition cartridge unit.
Figure 55A:
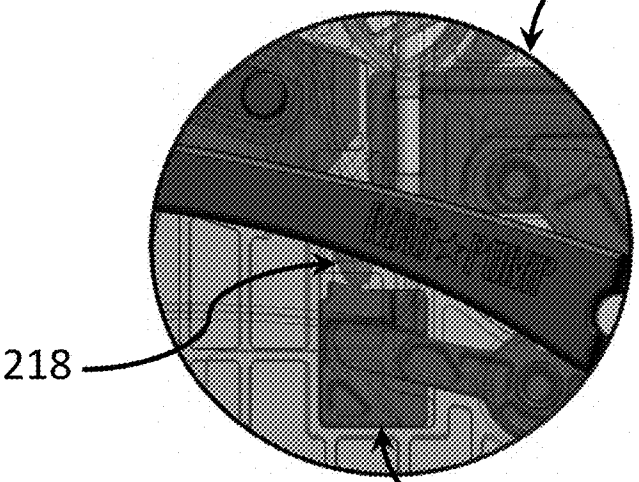
FIG. 55A is an enlarged, side view of the firearm magazine loader of FIG. 1A, illustrating the primary driver applying an upward force to the head of an ammunition cartridge unit.

Referring to FIGS. 53-54, the primary link 244 includes: (a) a wheel or primary gear 322 having a primary pivot member 324 pivotally coupled to the lower panel 54 (FIG. 44) for support purposes; and (b) a primary extension 326 extending from the primary gear 322. The primary extension 326 is configured to fit into the primary driver recess 328 defined by the primary driver 36. Depending upon the embodiment, the primary extension 326 can be pivotally coupled to the primary driver 36. The primary gear 322 has: (a) a primary driver peak 330 and a primary driver tooth 332 separated by a primary valley 334; and (b) a primary stoppage peak 336 separated from the primary driver tooth 332 by a primary valley 338.

With continued reference to FIGS. 53-54, the secondary link 246 includes: (a) a wheel or secondary gear 340 defining an opening 342 configured to be receive and be fixedly coupled to the drive shaft 344; and (b) a secondary extension 346 extending from the secondary gear 340 and configured to engage a secondary driver member 348 (FIG. 53) of the secondary driver 38. The secondary gear 340 has a secondary driver peak 400 and a secondary driver tooth 402 separate by a delay valley 404.

Referring to FIGS. 53-57C, in an embodiment, the actuator 42 includes a handle 406 fixedly connected to the drive shaft 344. Initially, the handle 406 is in the up or first handle position 408 as shown in FIG. 1B. The user can push the handle 406 downward in the counterclockwise direction 264 to achieve the second handle position 410 as shown in FIG. 55B. In the process of transitioning from the first handle position 408 to the second handle position 410, the secondary gear 340 is initially activated and rotated to in the counterclockwise direction 264. Referring to FIGS. 54 and 57A, in the first phase of the rotation, the secondary driver peak 400 engages the primary driver peak 330. As the rotation occurs, the secondary driver peak 400 applies a force to the primary driver peak 330 which causes the primary link 244 to rotate in the clockwise direction 262 which, in turn, causes the primary driver 36 to move upward, as shown in FIG. 57A. During this first phase, as illustrated in FIG. 57A, the secondary driver 38 remains in its original or substantially original position during the upward movement of the primary driver 36. This is due to the delay valley 404. The delay valley 404 has an arc length that stalls the engagement of the secondary driver tooth 402 with the primary driver tooth 332.

In transitioning from the first phase (FIG. 57A) to the second phase (FIG. 57B), the secondary driver tooth 402 slides along the delay valley 404 encountering no interference, which avoids generating a lateral force on the secondary driver 38. This results in an important time delay between the driving action of the primary driver 36 and the driving action of the secondary driver 38. Because of this time delay, a single actuation of the actuator 42 can result in the following: (a) an upward force (operable to move the ammunition cartridge unit 234 upward next to the magazine mouth or magazine opening 412); and (b) a horizontal or lateral force (operable to move the ammunition cartridge unit 234 laterally through the magazine opening 412) that occurs a period of time after the upward force.

Figures 57A, 57B, 57C:
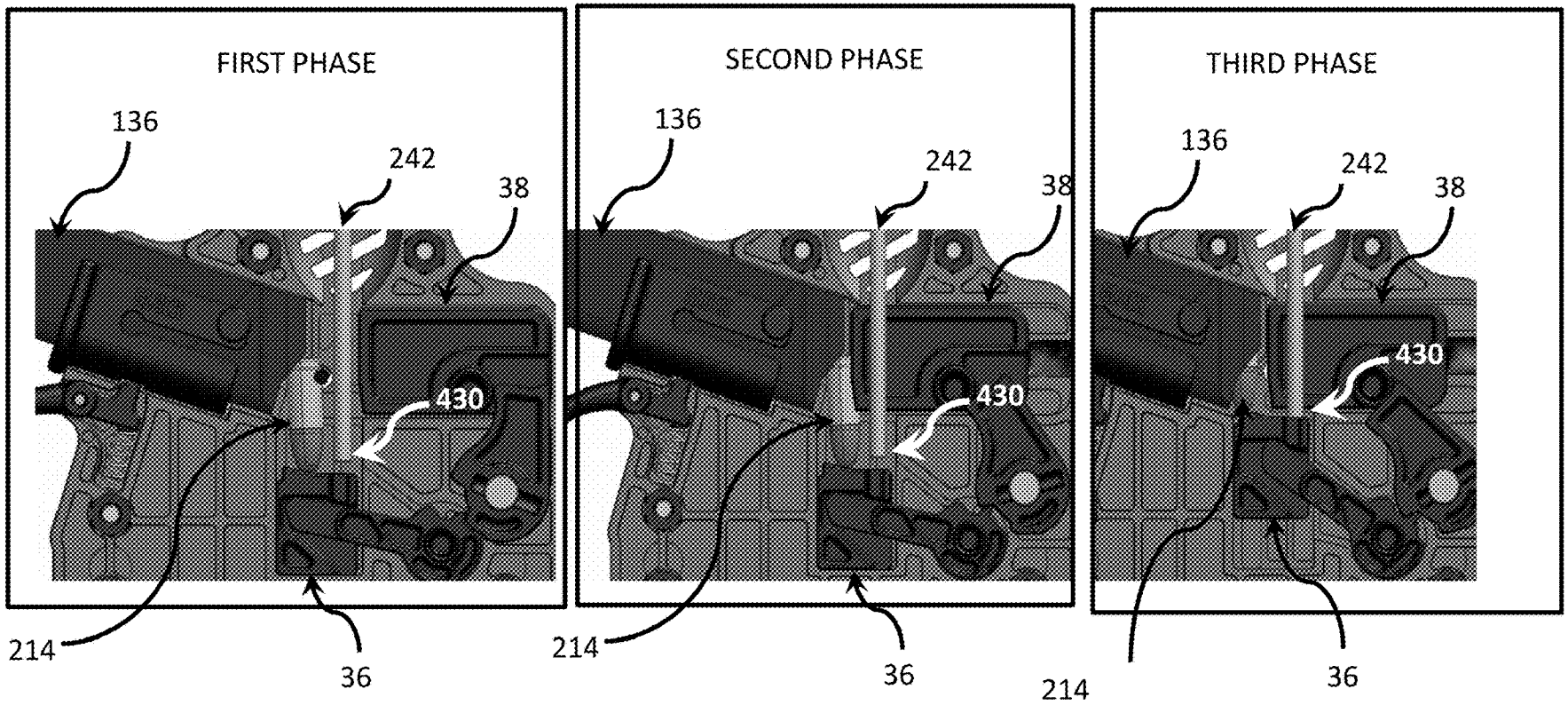
FIG. 57A is a side view of the firearm magazine loader of FIG. 1A, illustrating the first phase of a primary driver engaging an ammunition cartridge unit.
FIG. 57B is a side view of the firearm magazine loader of FIG. 1A, illustrating the second phase of a primary driver engaging an ammunition cartridge unit.
FIG. 57C is a side view of the firearm magazine loader of FIG. 1A, illustrating the third phase of a primary driver engaging an ammunition cartridge unit.
Figure 58:
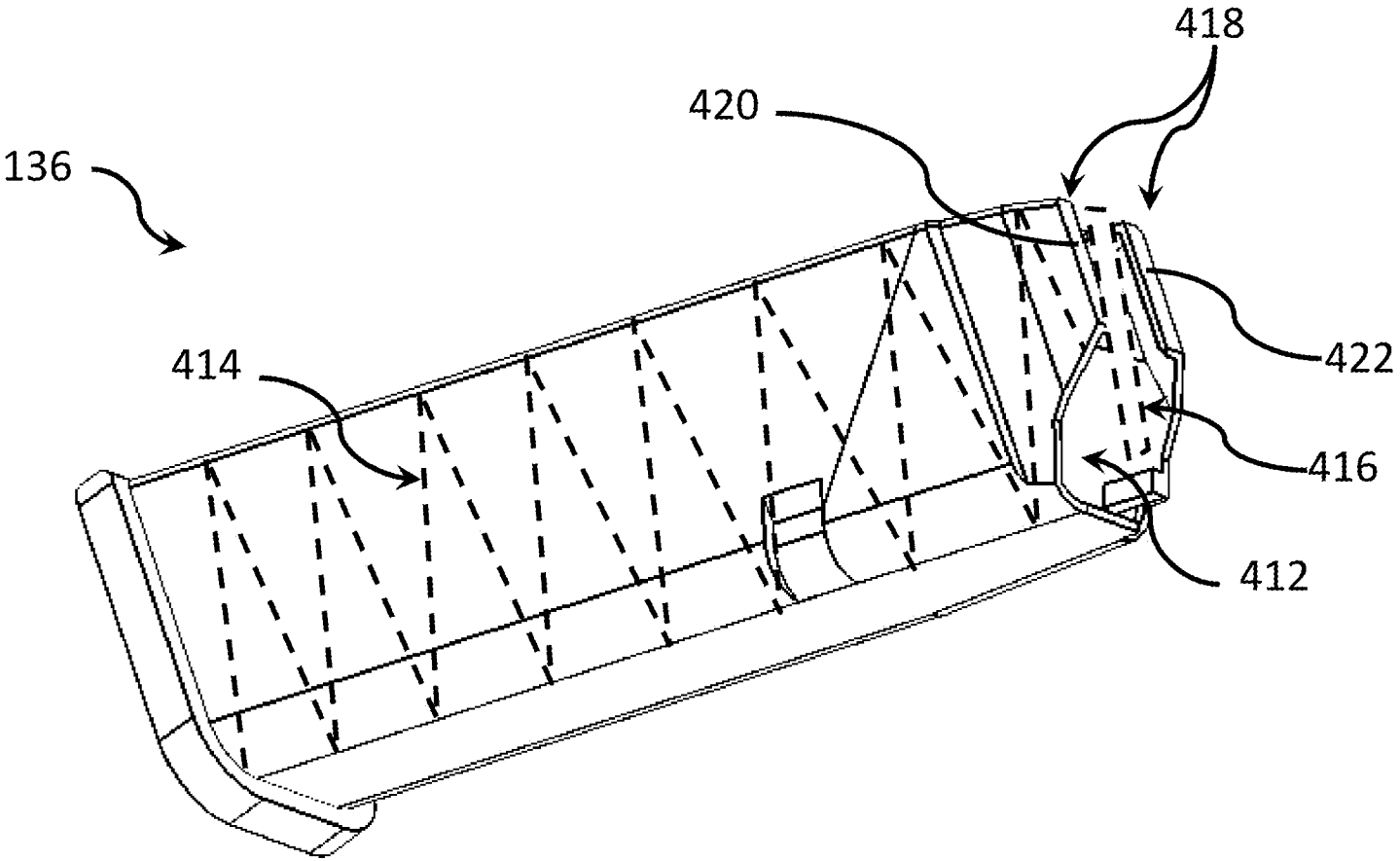
FIG. 58 is an isometric view of an embodiment of a firearm magazine, illustrating the magazine opening and follower.

During the second phase, as shown in FIGS. 54 and 57B, the secondary driver tooth 402 applies a force to the primary driver tooth 332. The counteractive force of the primary driver tooth 332 causes the secondary link 246 to rotate in the clockwise direction 262, which, in turn, causes the secondary driver 38 to move laterally toward the magazine opening 412. In this position, both the primary driver 36 and the secondary driver 38 are engaged with, and applying forces, to the ammunition cartridge unit 234.

During the third phase, as shown in FIGS. 54 and 57C, the secondary driver tooth 402 continues to rotate and apply a force to the primary driver tooth 332. The continued counteractive force of the primary driver tooth 332 causes the secondary link 246 to further rotate in the clockwise direction 262, which, in turn, causes the secondary driver 38 to further move laterally toward the magazine opening 412. In this position, both the primary driver 36 and the secondary driver 38 are engaged with, and simultaneously apply forces, to the ammunition cartridge unit 234. As shown, the primary stoppage peak 336 applies a stopping force to the secondary link 246 while the secondary driver tooth 402 continues to rotate and apply a final force to the primary driver tooth 332. This final force causes the ammunition cartridge unit 234 to move entirely within the magazine 136. In an embodiment, during the conveyance of this final force, the primary driver 36 is in upward motion while the secondary driver 38 is stationary.

The dimensions and geometry of the delay valley 404 are set and configured to synchronize the movements of the primary driver 36 and the secondary driver 38. Based on such synchronization, when the ammunition cartridge unit 234 reaches the position near the magazine opening 412, the primary driver 36 and the secondary driver 38 are configured to simultaneously apply upward and horizontal forces to the ammunition cartridge unit 234 to effectively load the ammunition cartridge unit 214 into the magazine 136.

Figure 59:
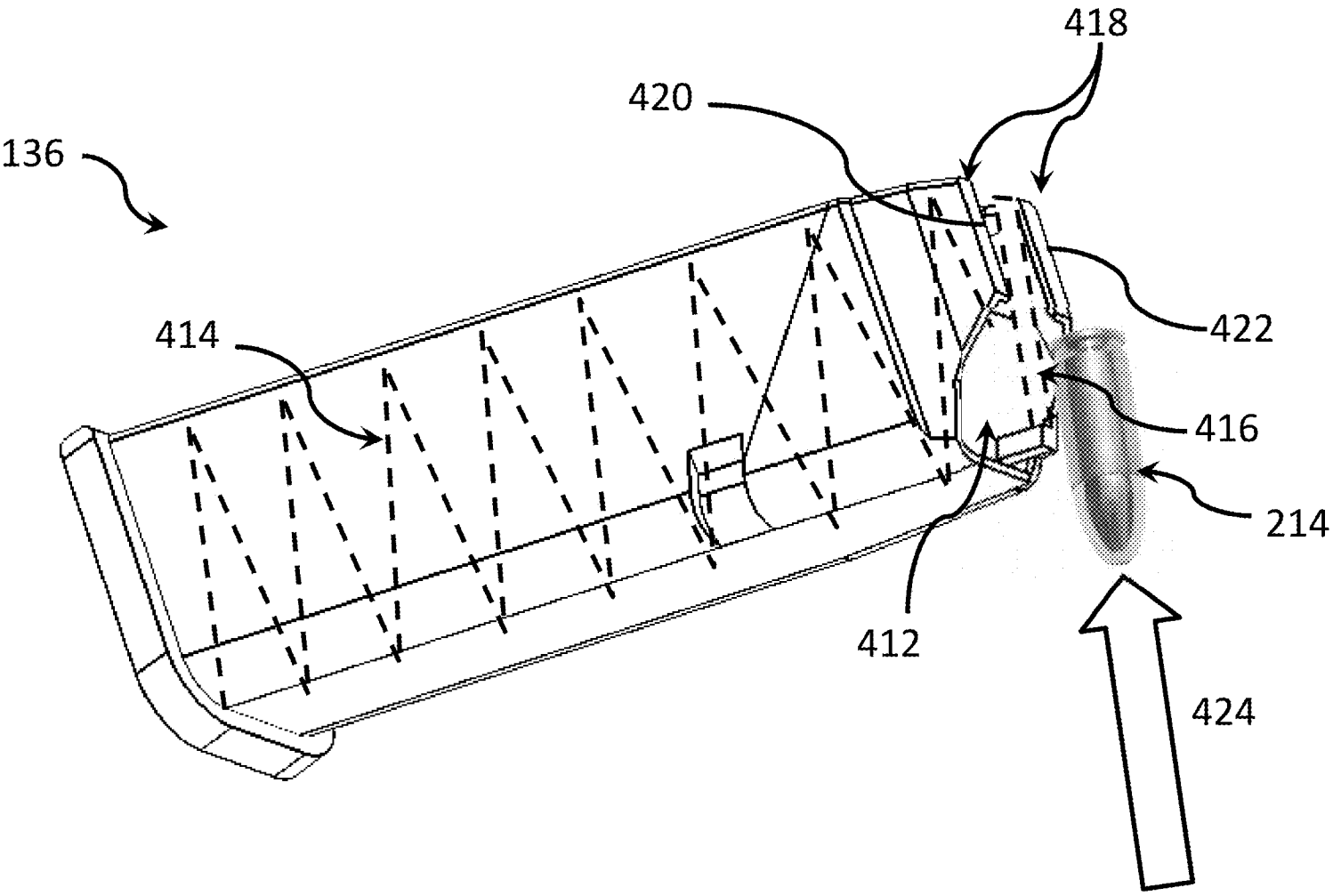
FIG. 59 is an isometric view of an embodiment of a firearm magazine, illustrating the movement of an ammunition cartridge unit toward the magazine opening.
Figure 60:
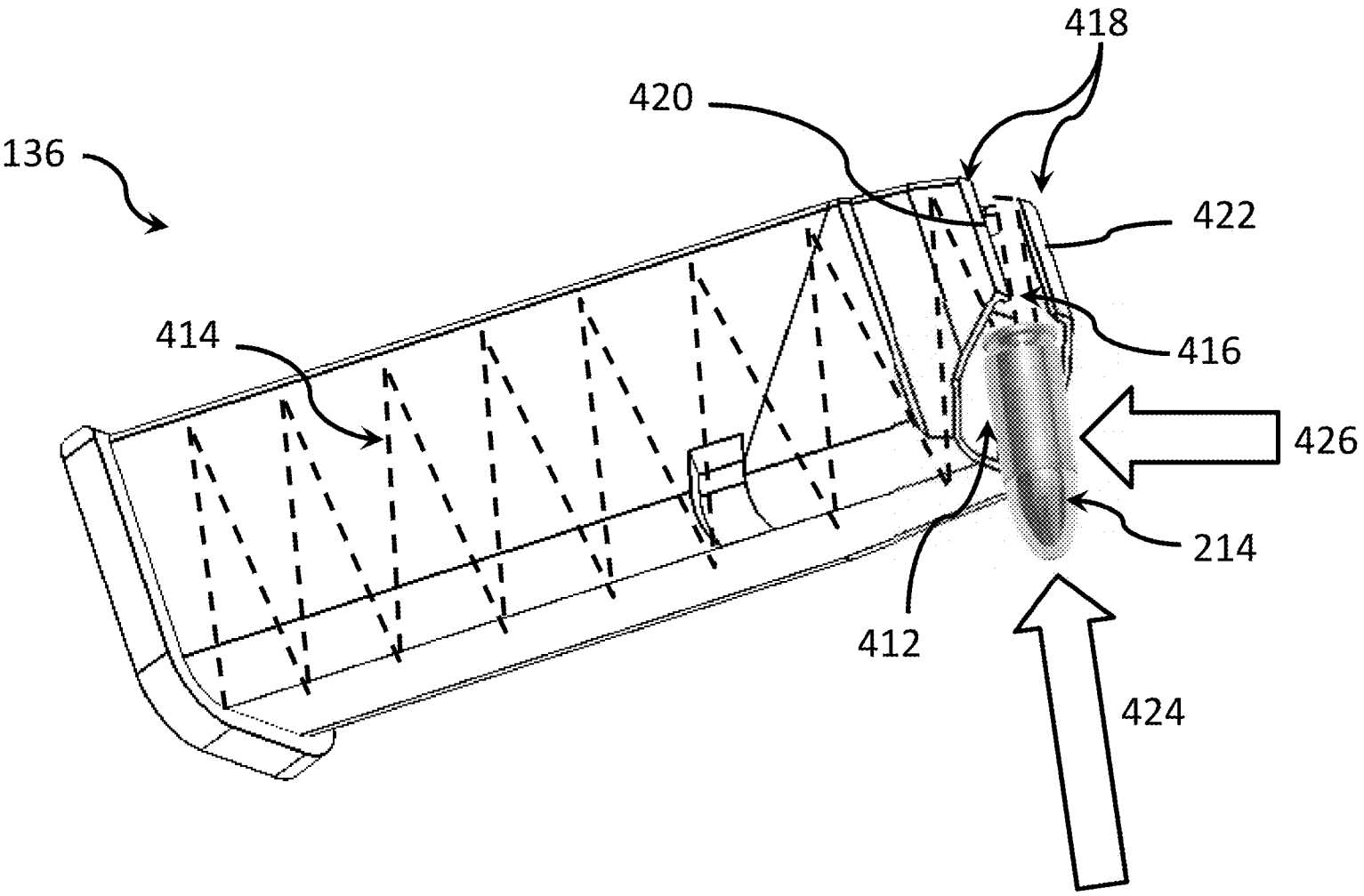
FIG. 60 is an isometric view of an embodiment of a firearm magazine, illustrating the upward movement of an ammunition cartridge unit into the magazine opening.
Figure 61:
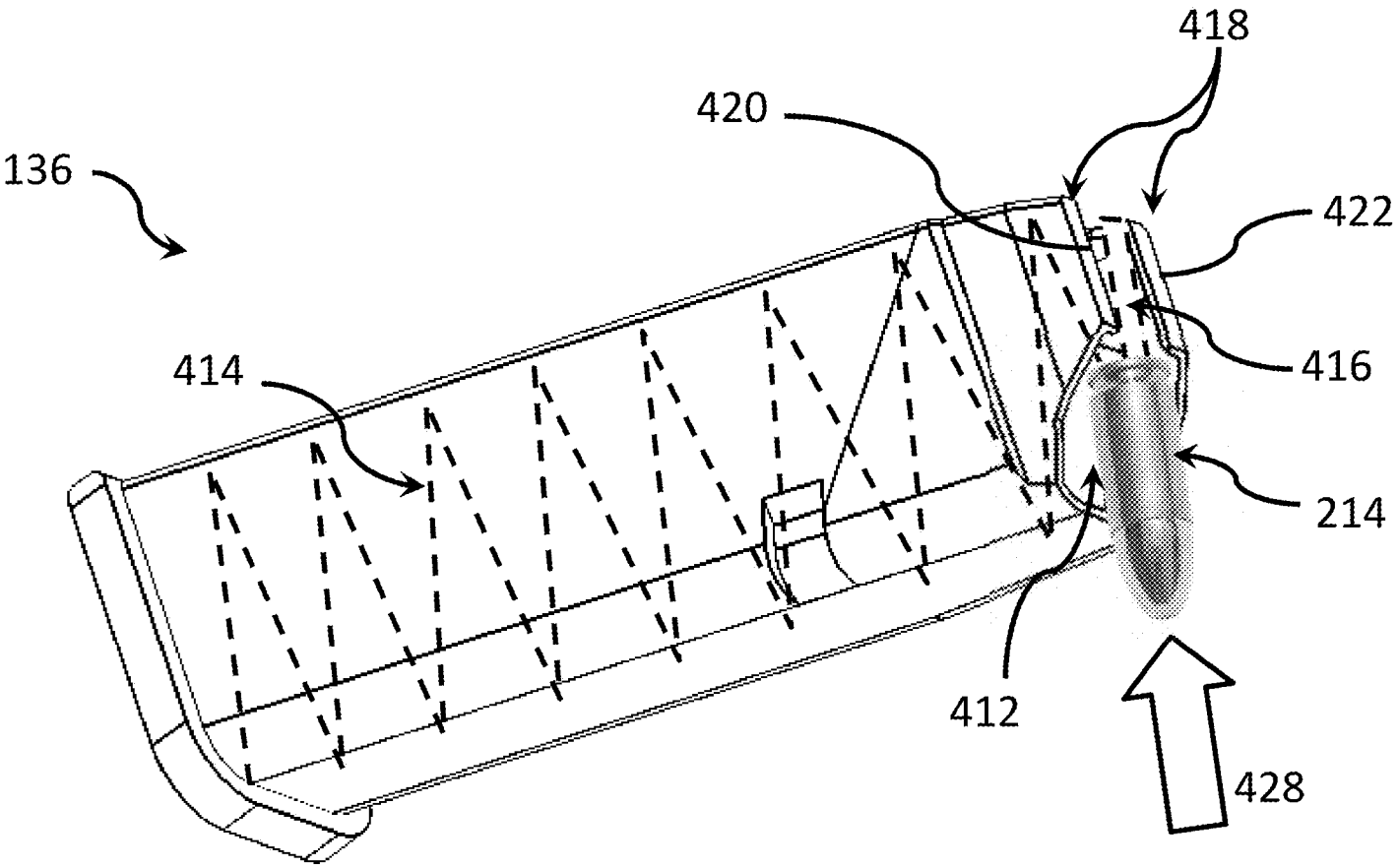
FIG. 61 is an isometric view of an embodiment of a firearm magazine, illustrating the upward movement of an ammunition cartridge unit into the magazine opening while the ammunition cartridge unit engages the follower.

In an example shown in FIGS. 12A-12C and 58-62, the magazine 136 houses a compression spring 414. The magazine 136 includes a follower 416 coupled to the spring 414. The magazine 136 also includes an ammunition retainer or cartridge retainer 418 which, in this example, includes a plurality of retaining lips 420, 422. As illustrated in FIG. 59, in the first step of loading, the primary driver 36 applies an initial upward force 424 to the ammunition cartridge unit 234. As illustrated in FIG. 60, in the second step of loading, delayed from the first step, the secondary driver 38 applies an initial horizontal or lateral force 426 to the ammunition cartridge unit 214 while the primary driver 36 continues to apply the initial upward force 424, as shown in FIG. 60. The lateral force 426 presses the ammunition cartridge unit 214 against the follower 416 causing the spring 414 to compress, which, in turn, causes the ammunition cartridge unit 234 to become entrapped by the retaining lips 420, 422. As illustrated in FIG. 61, in the third step of loading, the primary driver 36 applies a final upward force 428 which causes the ammunition cartridge unit 234 to entirely pass through the magazine opening 412 and become fully positioned within the magazine 136.

Figure 62:
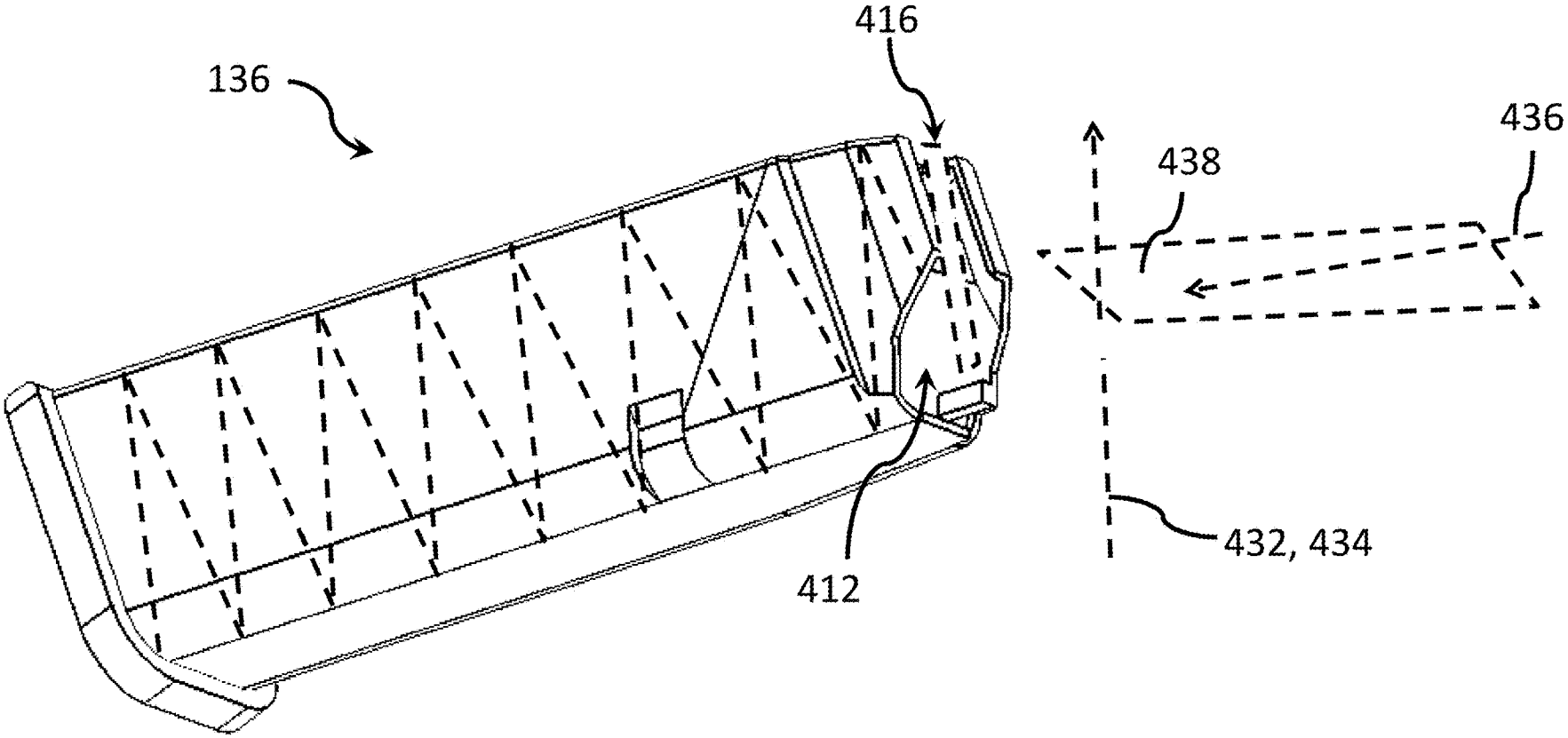
FIG. 62 is an isometric view of an embodiment of a firearm magazine, illustrating the plurality of driving forces, acting along intersecting planes, that urge the ammunition cartridge units into the magazine.

As illustrated in FIG. 62, the forces generated by the primary driver 36 act along a primary axis 432, which extends in a primary plane 434. It should be appreciated that, depending upon the embodiment, the primary axis 432 can be vertical, substantially vertical or upwardly angled. The forces generated by the secondary driver 38 act along a secondary axis 436, which extends in a secondary plane 438. It should be appreciated that, depending upon the embodiment, the secondary axis 436 can be horizontal, substantially horizontal or laterally angled.

Figure 38:
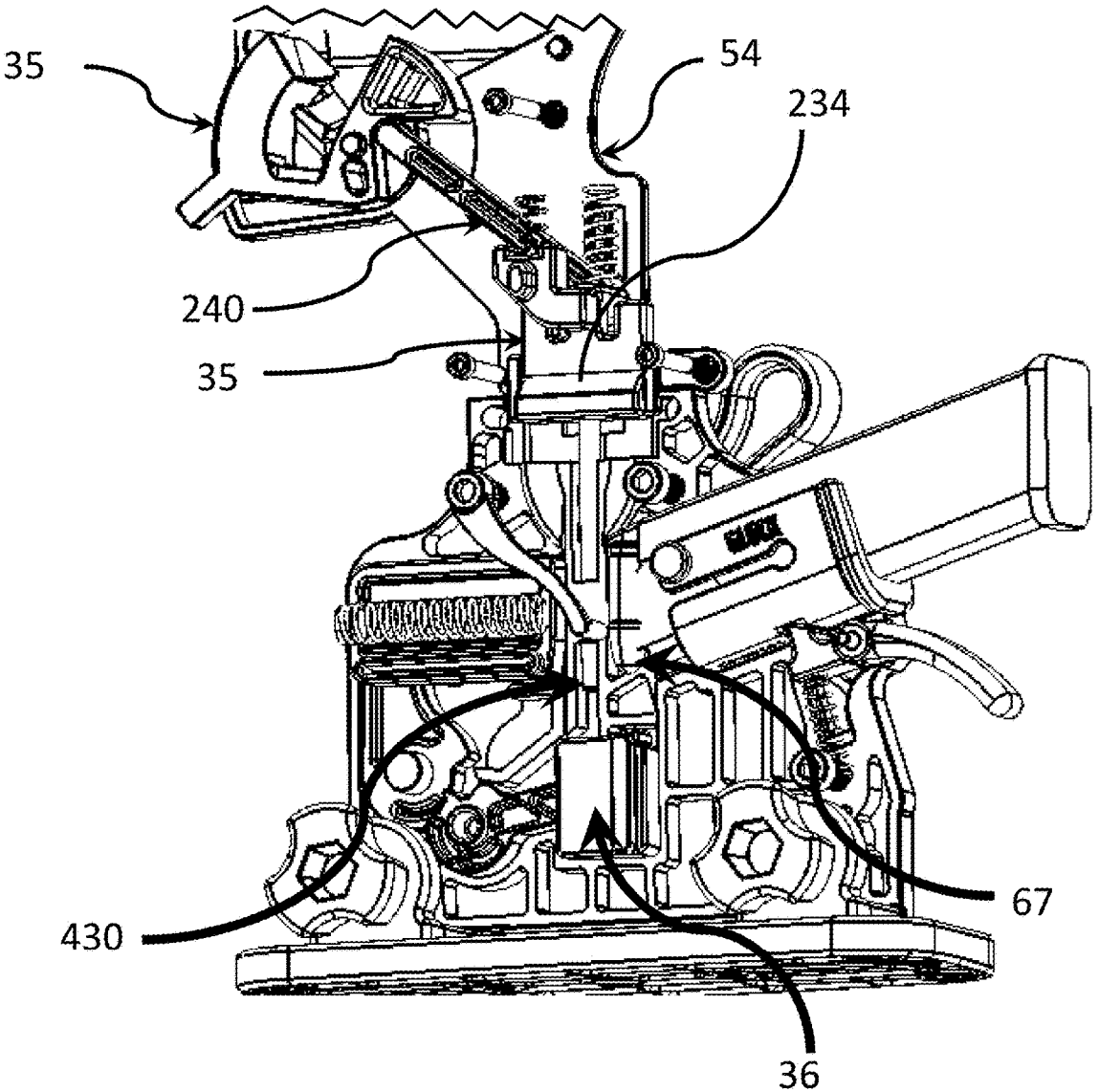
FIG. 38 is an isometric view of the firearm magazine loader of FIG. 1A, illustrating the interior elements exposed by the removal of a panel and intermediate portion.
Figure 39:
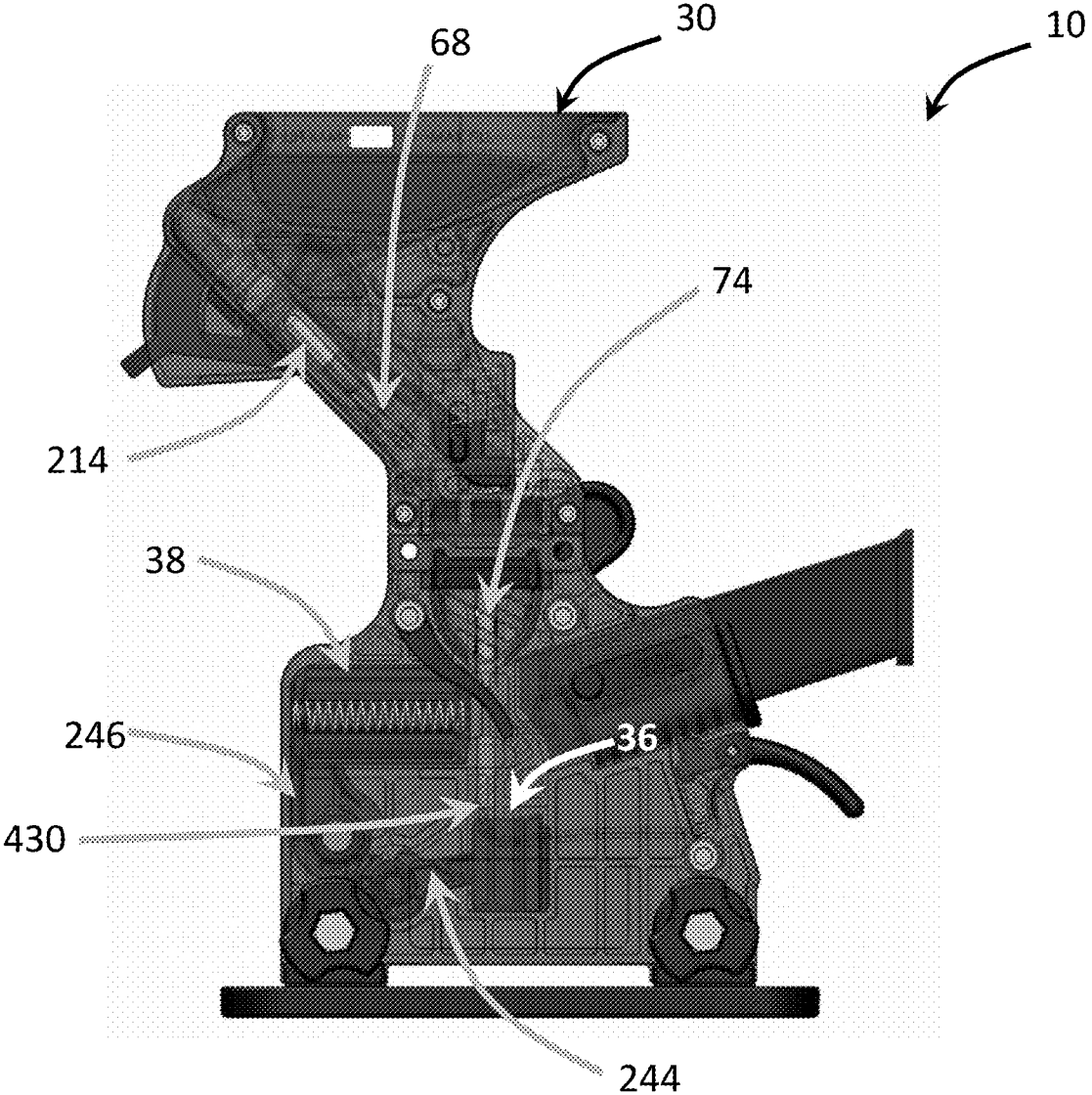
FIG. 39 is a side view of the firearm magazine loader of FIG. 1A, illustrating the traveling of an ammunition cartridge unit downward through the body of the firearm magazine loader.

Referring back to FIGS. 36-38, 47, 56 and 57A-57C, the drive assembly 40 includes the lifting rod or lifter 242, among other components. As shown, the lifting rod or lifter 242 is connected to the cartridge positioner 35. The lifter end 430 is located within the primary passage 68 above the primary driver 36. When the handle 406 is in the up or first handle position 408 (FIG. 1B), the primary driver 36 has the ready position 299 (FIG. 57A). As shown in FIG. 57A, the lifter end 430 is spaced apart from, and located above, the primary driver 36 in the ready position 299. When the user moves the handle 406 to the second handle position 410 (FIG. FIG. 55B), the primary driver 36 moves upward to the loading position 301 (FIG. 57C). In the loading position 301, the landing portion 300 of the primary driver 36 makes contact with, and pushes upward on, the lifter end 430. This causes the lifter 242 to move upward, which causes the cartridge positioner 35 to move upward, which causes the agitation driver 240 to move upward, which causes the agitator 34 to pivot, which causes the agitation or mixing of the pile of ammunition cartridge units 214 within the receptacle 30, as illustrated in FIG. 38. When the user releases the handle 406, the biasing member 308 (FIG. 51) urges the secondary driver 38 to the ready position 309, which urges the handle 406 to the first handle position 408 (FIG. 1B). As described above, in this embodiment, the drive assembly 40 operatively couples the actuator 42 to the agitator 34, primary driver 38 and secondary driver 38.

Figure 63:
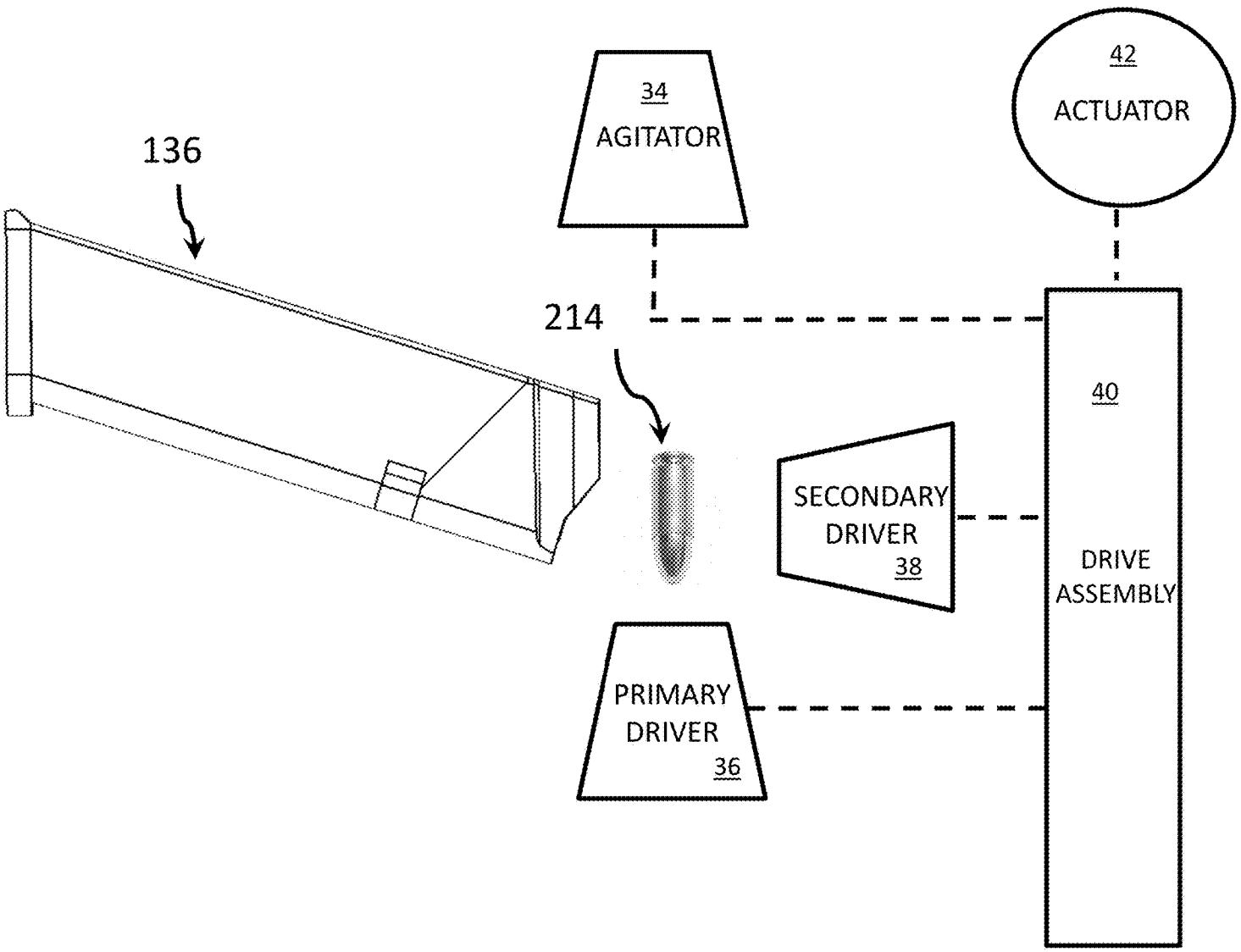
FIG. 63 is a schematic diagram illustrating interaction between the primary and secondary drivers, an ammunition cartridge unit, and a magazine of the firearm magazine loader of FIG. 1A.

Accordingly, as illustrated in FIG. 63, the actuator 42 is operable to generate a single input. Depending upon the embodiment, the single input can be a rotational movement, a translational movement or a combination thereof. Though the actuator 42 is illustrated in FIG. 1A as having a manually-operable handle 406, it should be appreciated that the actuator 42 can electrically generate the movement without the inclusion of a handle. For example, the actuator 42 can include a motor, solenoid or pneumatic device powered by a rechargeable battery or electricity supplied through an electrical cord. In such embodiment, the actuator 42 includes a switch, button or activation device operable to activate the electrical actuator 42. In any case, whether the actuator 42 is manually or electrically-configured, the actuator 42 generates the single input. Because the drive assembly 40 operatively couples the actuator 42 to the agitator 34, the primary driver 36 and the secondary driver 38, the single input has multiple outputs. The outputs are synchronized to apply differently-angled forces to the each ammunition cartridge unit 214 at designated times, all while agitating the ammunition cartridge units 214 within the receptacle 30.

Figure 64B:
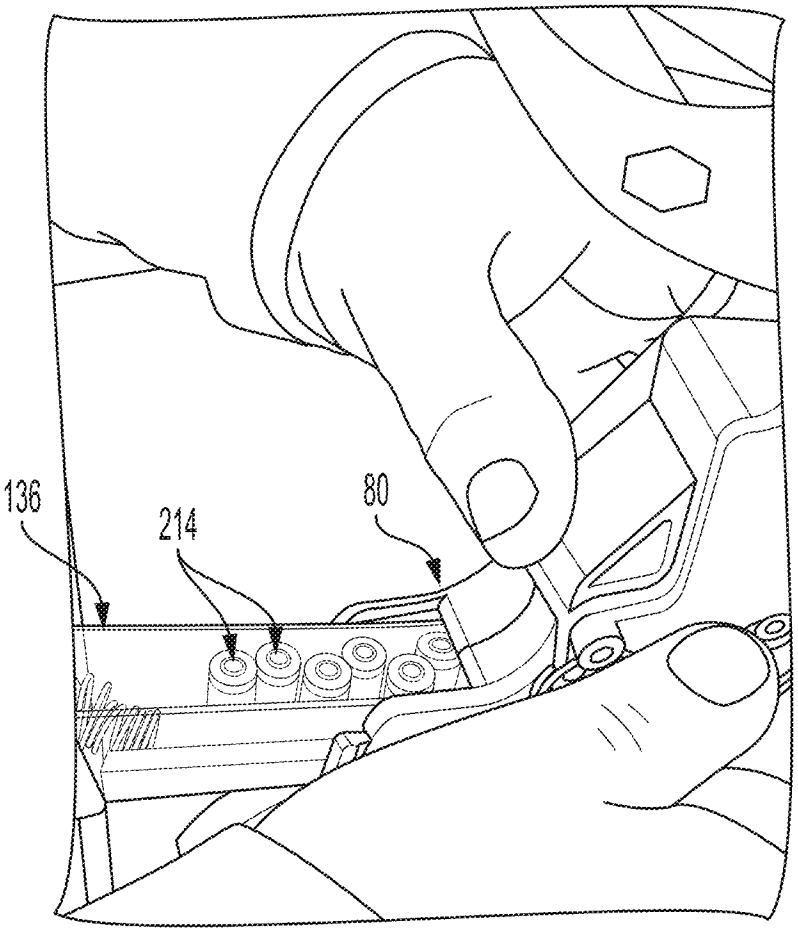
FIG. 64B is a top isometric view of additional ammunition cartridge units loaded into a firearm magazine through operation of the firearm magazine loader of FIG. 1A.
Figure 64A:
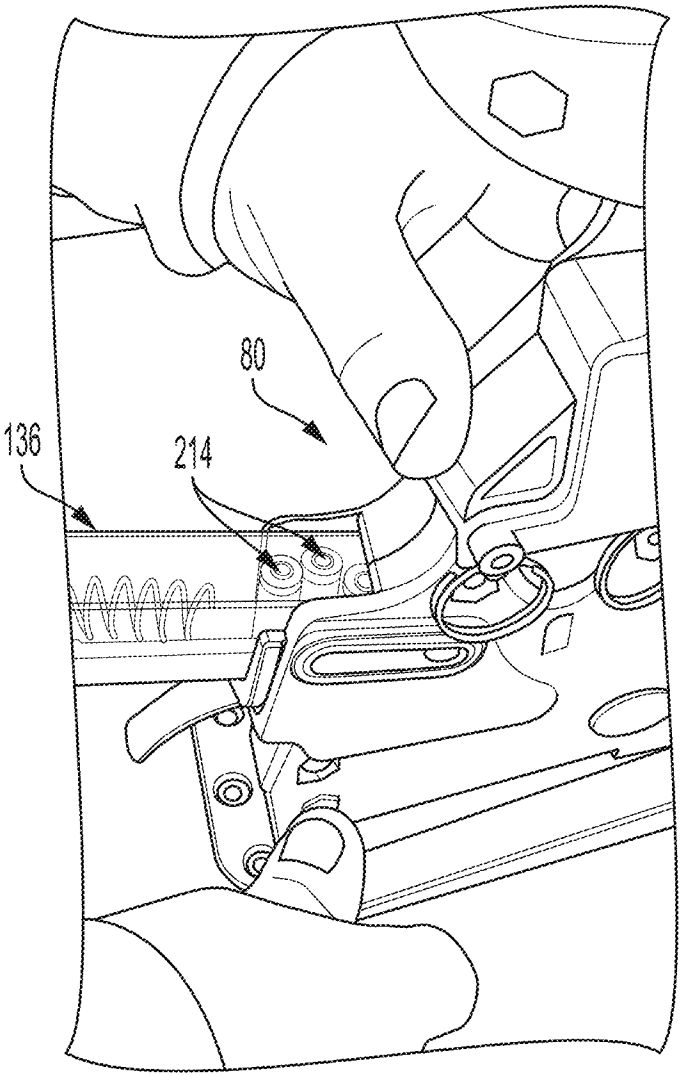
FIG. 64A is a top isometric view of an initial set of ammunition cartridge units loaded into a firearm magazine through operation of the firearm magazine loader of FIG. 1A.
Figure 65:
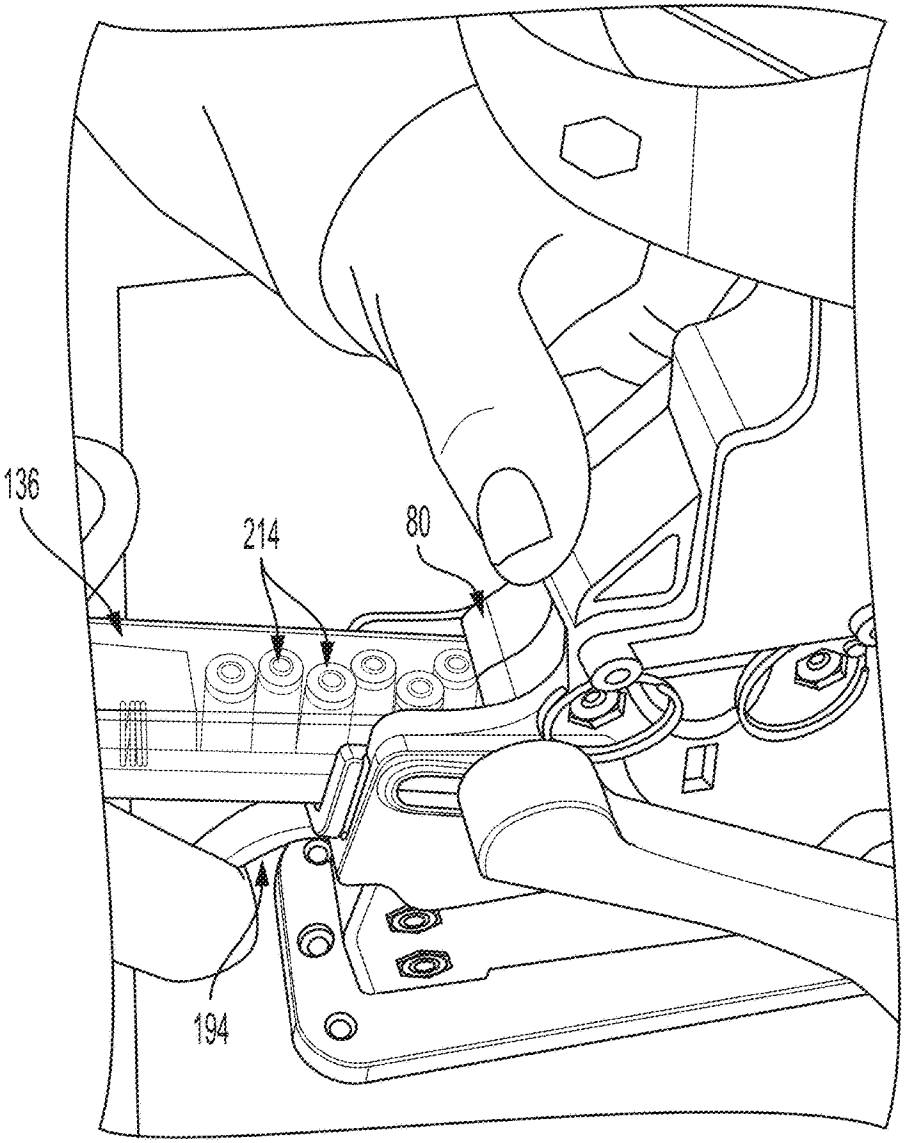
FIG. 65 is a top isometric view illustrating a user's manipulation of a grasp to decouple a magazine adapter, carrying a loaded firearm magazine, from the firearm magazine loader of FIG. 1A.
Figure 66B:
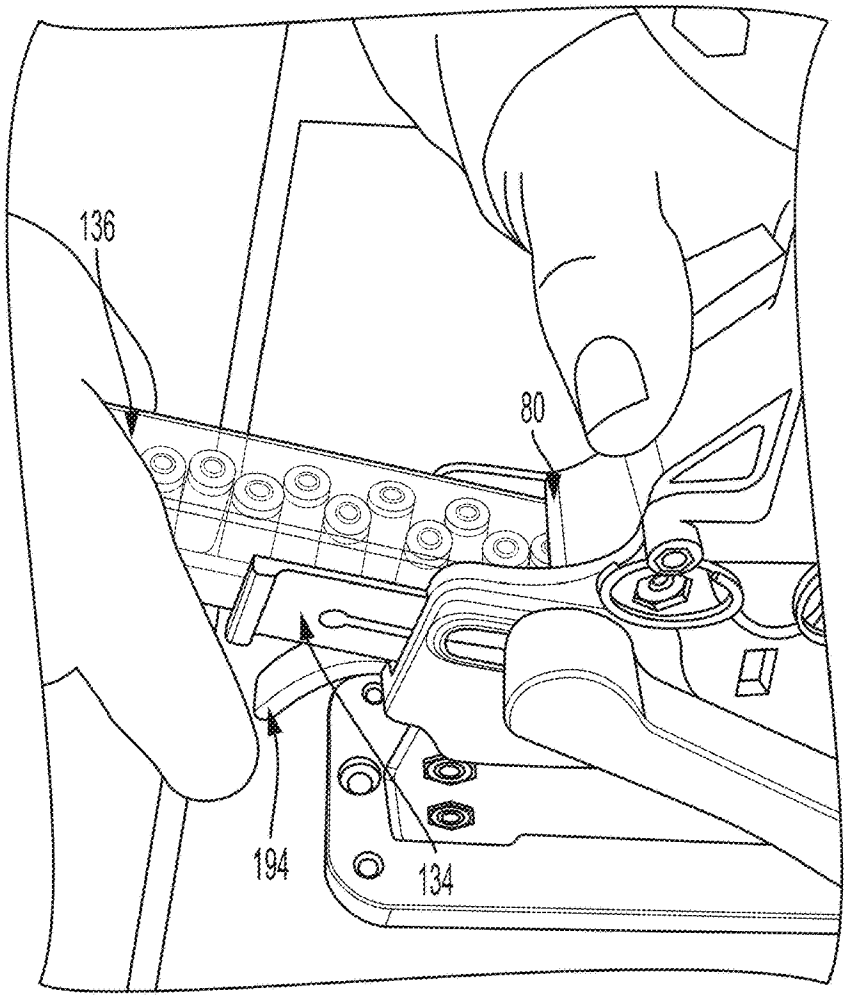
FIG. 66B is a top isometric view illustrating a magazine adapter, carrying a loaded firearm magazine, that has been partially withdrawn from the firearm magazine loader of FIG. 1A.
Figure 66A:
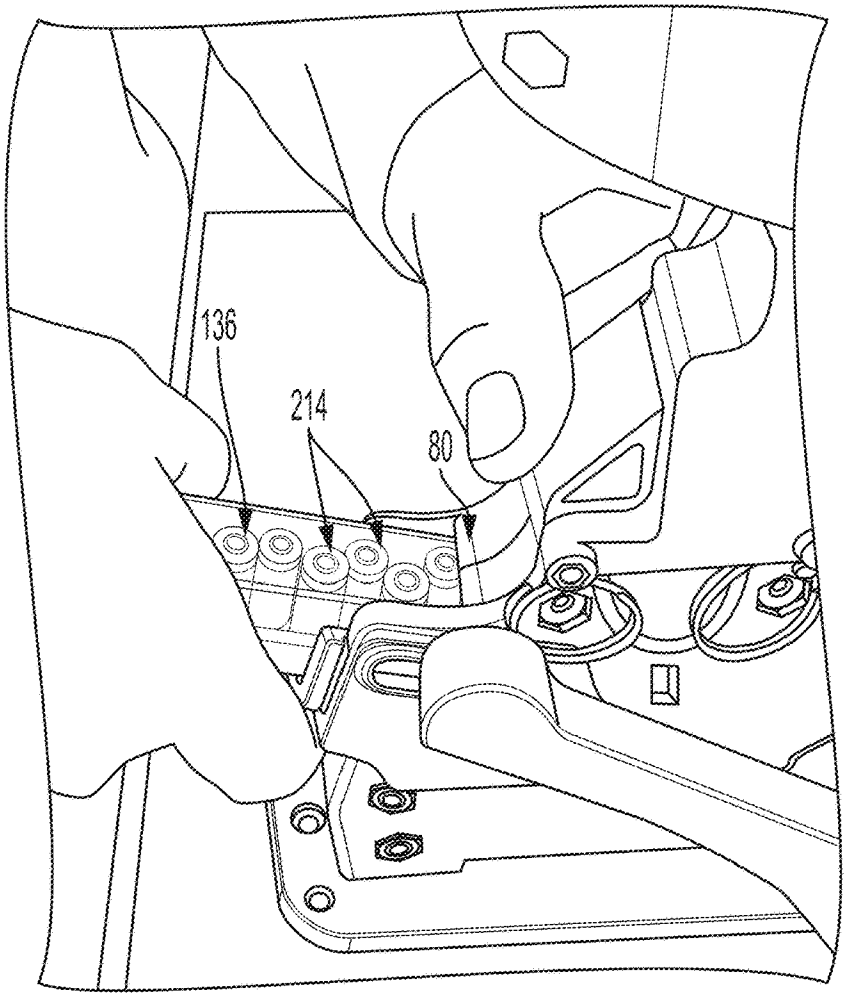
FIG. 66A is a top isometric view illustrating a user's partial withdrawal a magazine adapter, carrying a loaded firearm magazine, from the firearm magazine loader of FIG. 1A.
Figure 67B:
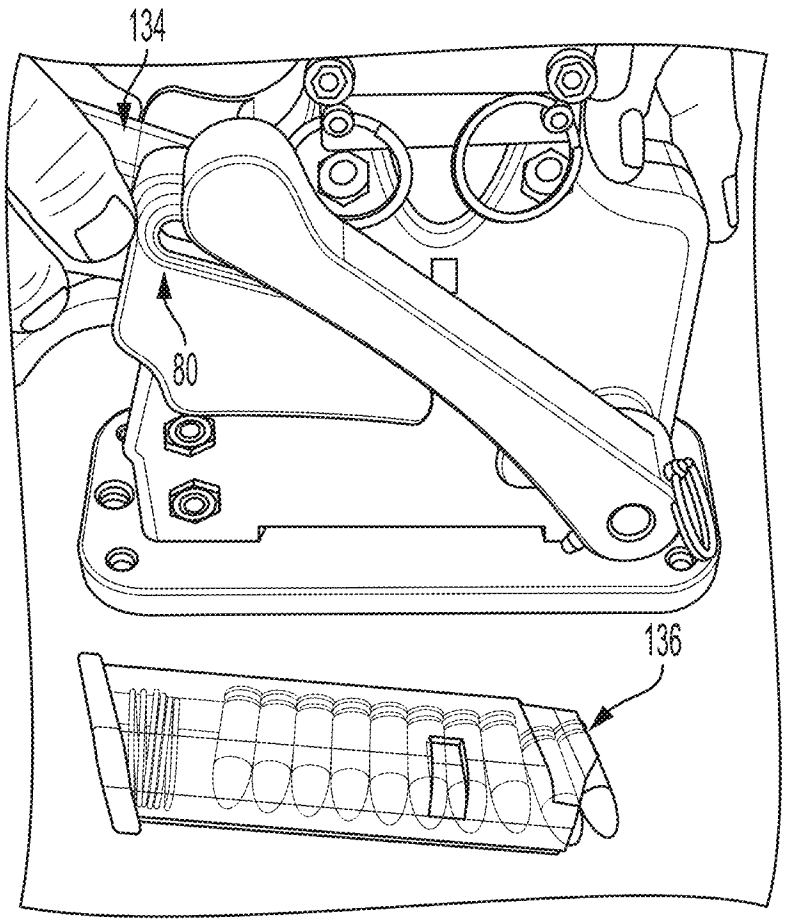
FIG. 67B is an isometric view illustrating a loaded firearm magazine that has been fully uninstalled and removed from the firearm magazine loader of FIG. 1A.
Figure 67A:
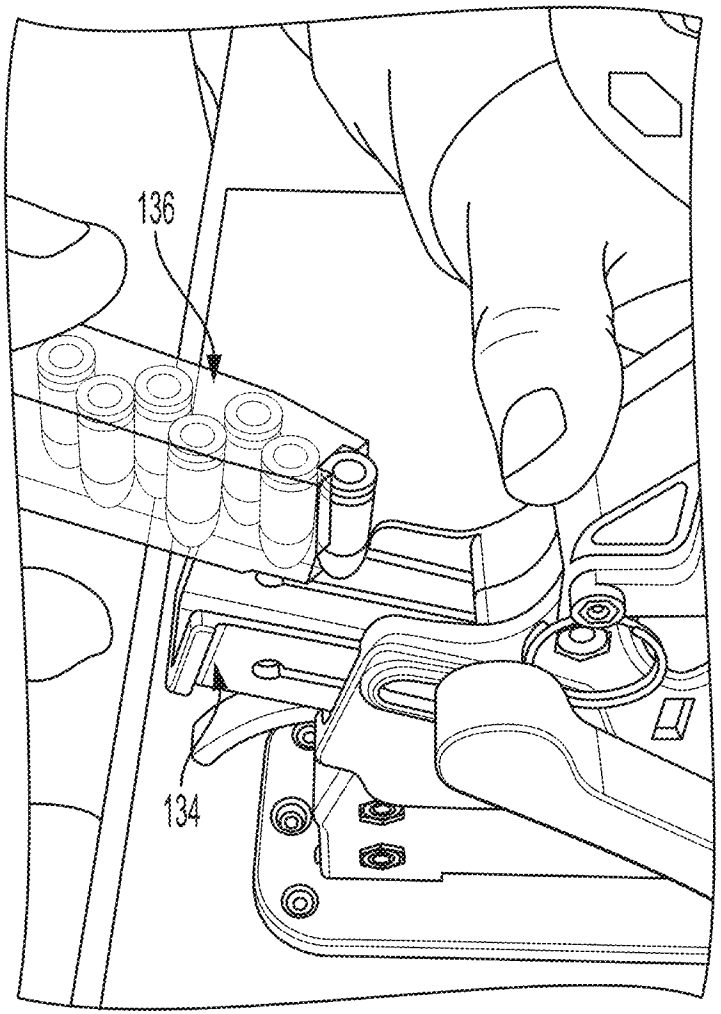
FIG. 67A is a top isometric view illustrating a user's removal of a loaded firearm magazine from a magazine adapter while the magazine adapter is supported by the firearm magazine loader of FIG. 1A.

Referring to FIGS. 64A-64B, each incremental movement of the actuator 42 (e.g., each downward travel of the handle 406) causes a single ammunition cartridge unit 214 to move into and be loaded within the magazine 136. As the ammunition cartridge units 214 are driven into the magazine 136, the magazine spring 414 is further compressed. When the magazine 136 is fully loaded or loaded to the user's satisfaction, the user can pull upward on the grasp 194, as illustrated in FIG. 65. Next, as illustrated in FIG. 66A, the user can pull the magazine 136 rearward. Since the magazine 136, at this point, remains interlocked with the magazine adapter 134, the retraction of the magazine 136 causes the magazine adapter 134 to pull outward, as illustrated in FIG. 66B. Finally, the user can detach the magazine 136 from the magazine adapter 134 because the interlocking is reversible, as illustrated in FIG. 67A. As illustrated in FIG. 67B, the loaded magazine 136 is then ready for installation into a firearm for shooting. By squeezing the magazine adapter 134, as described above, the user can detach the magazine adapter 134 from the loading structure 80, as illustrated in FIG. 67B.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with or otherwise interlock with each other.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An ammunition movement system comprising:

an agitator configured to be supported by a support, wherein the agitator is moveable relative to the support to agitate a plurality of ammunition cartridge units;

a first driver configured to be supported by the support, wherein the first driver is moveable relative to the support to apply a first force to a first one of the ammunition cartridge units, wherein the first force acts along a first axis that extends in a first plane;

a second driver configured to be supported by the support, wherein the second driver is moveable relative to the support to apply a second force to the first ammunition cartridge unit, wherein the second force acts along a second axis that extends in a second plane;

an actuator operatively coupled to the first driver and the second driver; and a drive assembly that operatively couples the actuator to the first and second drivers, wherein the drive assembly comprises:

a drive shaft coupled to the actuator;

a first link coupled to the drive shaft, wherein the first link is positioned to interface with the first driver; and a second link positioned to interface with the first link and the second driver, wherein the first plane intersects with the second plane, wherein the actuator is configured to receive an input, wherein, in response to the input, the first and second drivers are configured to cooperate to move the first ammunition cartridge unit through a magazine opening of a firearm magazine.

2. The ammunition movement system of claim 1, wherein:

the first link comprises a first gear portion;

the second link comprises a second gear portion and an extension;

the second gear portion is positioned to mate with the first gear portion; and the extension is positioned to engage the second driver.

3. A firearm magazine loader comprising:

the ammunition movement system of claim 1;

the support; and a receptacle supported by the support, wherein the receptacle is configured to hold a plurality of the ammunition cartridge units.

4. The ammunition movement system of claim 1, wherein:

the agitator is moveably coupled to a receptacle;

the receptacle is supported by the support; and the receptacle is configured to hold a plurality of the ammunition cartridge units.

5. The ammunition movement system of claim 4, wherein:

the actuator is operatively coupled the agitator;

in response to the input, the agitator is configured to reposition a plurality of the ammunition cartridge units in the receptacle; and the repositioning of the ammunition cartridge units occurs before the first and second drivers move the first ammunition cartridge unit through the magazine opening of the firearm magazine.

6. The ammunition movement system of claim 1, wherein:

the support comprises a portion of a body of a firearm magazine loader; and when the firearm magazine loader is vertically oriented, the first axis comprises a horizontal axis, and the second axis comprises a vertical axis.

7. The ammunition movement system of claim 1, wherein the actuator comprises a manually-operable handle.

8. An ammunition movement system comprising:

a first driver configured to be supported by a support, wherein the first driver is moveable relative to the support to apply a first force to an ammunition cartridge unit, wherein the first force acts along a first axis that extends in a first plane;

a second driver configured to be supported by the support, wherein the second driver is moveable relative to the support to apply a second force to the ammunition cartridge unit, wherein the second force acts along a second axis that extends in a second plane;

an actuator operatively coupled to the first driver and the second driver; and a drive assembly that operatively couples the actuator to the first and second drivers, wherein the drive assembly comprises:

a drive shaft coupled to the actuator;

a first link coupled to the drive shaft, wherein the first link is positioned to engage the first driver; and a second link positioned to engage the first link and the second driver, wherein the first plane intersects with the second plane, wherein the actuator, the first driver and the second driver are configured to cooperate to move the ammunition cartridge unit through a magazine opening of a firearm magazine.

9. The ammunition movement system of claim 8, wherein the actuator comprises a manually-operable handle.

10. The ammunition movement system of claim 8, wherein:

the actuator is operatively coupled to an energy source; and the energy source comprises one of an electricity source and a pneumatic source.

11. The ammunition movement system of claim 1, wherein:

the actuator is operatively coupled to an energy source; and the energy source comprises one of an electricity source and a pneumatic source.

12. The ammunition movement system of claim 1, wherein the input comprises one of (a) a force caused by a user; (b) a rotational movement caused by a user; (c) a translational movement caused by a user; and (d) a combination of the rotational and translational movements caused by a user.

13. The ammunition movement system of claim 1, comprising:

a cartridge positioner supported by the support, wherein the cartridge positioner is positioned to support the first ammunition cartridge before the first ammunition cartridge receives the first force or the second force; and a lifter supported by the support, wherein, in response to the input, at least one of the first and second drivers is configured to cause the lifter to move, wherein the movement of the lifter causes the cartridge positioner to move.

14. The ammunition movement system of claim 8, wherein:

the support comprises a portion of a body of a firearm magazine loader; and when the firearm magazine loader is vertically oriented, the first axis comprises a horizontal axis, and the second axis comprises a vertical axis.

15. The ammunition movement system of claim 8, wherein:

the first link comprises a first gear portion;

the second link comprises a second gear portion and an extension;

the second gear portion is positioned to mate with the first gear portion; and the extension is positioned to engage the second driver.

16. A firearm magazine loader comprising:

the ammunition movement system of claim 8;

the support; and a receptacle supported by the support, wherein the receptacle is configured to hold a plurality of the ammunition cartridge units.

17. The ammunition movement system of claim 8, comprising:

a cartridge positioner supported by the support, wherein the cartridge positioner is located higher than the first and second drivers; and a lifter supported by the support, wherein, in response to an operation of the actuator, at least one of the first and second drivers is configured to cause the lifter to move, wherein the movement of the lifter causes the cartridge positioner to move.

18. A method for manufacturing an ammunition movement system, the method comprising:

configuring a first driver to be supported by a support, wherein the configuring of the first driver comprises configuring the first driver so as to be moveable relative to the support to apply a first force to an ammunition cartridge unit, wherein the first force acts along a first axis that extends in a first plane;

configuring a second driver to be supported by the support, wherein the configuring of the second driver comprises configuring the second driver so as to be moveable relative to the support to apply a second force to the ammunition cartridge unit, wherein the second force acts along a second axis that extends in a second plane;

operatively coupling an actuator to the first driver and the second driver;

configuring a drive assembly to comprise a drive shaft, a first link and a second link;

coupling the drive shaft to the actuator;

coupling the first link to the drive shaft;

positioning the first link so as to engage the first driver; and positioning the second link so as to engage the first link and the second driver, wherein the first plane intersects with the second plane, wherein the actuator, the first driver and the second driver are operable to cooperate to move the ammunition cartridge unit through a magazine opening of a firearm magazine.

19. The method of claim 18, wherein:

the support comprises a portion of a body of a firearm magazine loader;

when the firearm magazine loader is vertically oriented, the first axis comprises a horizontal axis, and the second axis comprises a vertical axis; and the method comprises configuring the actuator to comprise a manually-operable handle.

20. The method of claim 18, comprising:

configuring a cartridge positioner to be supported by the support, wherein the cartridge positioner is located higher than the first and second drivers; and configuring a lifter to be supported by the support, wherein at least one of the first and second drivers is configured to cause the lifter to move, wherein the movement of the lifter causes the cartridge positioner to move.

* * * * *